US010590583B2

(12) United States Patent
Kitayama

(10) Patent No.: US 10,590,583 B2
(45) Date of Patent: Mar. 17, 2020

(54) WASHING AND DRYING MACHINE

(71) Applicant: Samsung Electronics Co., Ltd., Gyeonggi-do (KR)

(72) Inventor: Naoki Kitayama, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 240 days.

(21) Appl. No.: 15/674,435

(22) Filed: Aug. 10, 2017

(65) Prior Publication Data

US 2018/0094376 A1 Apr. 5, 2018

(30) Foreign Application Priority Data

Oct. 5, 2016 (JP) ..... 2016-197208
Jul. 13, 2017 (JP) ..... 2017-136809
Aug. 9, 2017 (KR) ..... 10-2017-0101289

(51) Int. Cl.
*D06F 25/00* (2006.01)
*D06F 37/22* (2006.01)
(Continued)

(52) U.S. Cl.
CPC ..... *D06F 25/00* (2013.01); *D06F 37/22* (2013.01); *D06F 37/304* (2013.01); *D06F 39/04* (2013.01);
(Continued)

(58) Field of Classification Search
CPC ..... D06F 25/00; D06F 39/04; D06F 58/00; D06F 58/02; D06F 58/04; D06F 58/20;
(Continued)

(56) References Cited

U.S. PATENT DOCUMENTS

2007/0169283 A1* 7/2007 Kim ..... D06F 25/00 8/158
2009/0211309 A1 8/2009 Kawabata et al.

FOREIGN PATENT DOCUMENTS

DE 1808534 A1 6/1970
JP 2007325838 A 12/2007
(Continued)

OTHER PUBLICATIONS

International Search Report, dated Nov. 17, 2017, regarding International Application No. PCT/KR2017/008699, 3 pages.
(Continued)

*Primary Examiner* — David G Cormier

(57) ABSTRACT

Improvement in heat exchange efficiency can be promoted, a heat exchange can be efficiently performed, a space can be saved, and drying time can be shortened. A washing and drying machine includes a drum configured to accommodate clothes, a motor configured to drive the drum, a tub configured to accommodate the drum and store washing water, and a circulation flow path configured to circulate drying air into and out of the drum. A circulation duct constituting a part of the circulation flow path is connected to a converging portion configured to converge drying air. A dehumidifier is installed in one or more duct systems of the circulation duct. The washing and drying machine further includes a controller configured to control the dehumidifier and two duct cleaning pipes installed in branch ducts and configured to supply water to the dehumidifier.

20 Claims, 83 Drawing Sheets

(51) Int. Cl.

| | |
|---|---|
| ***D06F 37/30*** | (2020.01) |
| ***D06F 39/04*** | (2006.01) |
| *D06F 58/28* | (2006.01) |
| *D06F 37/26* | (2006.01) |
| *D06F 58/24* | (2006.01) |
| *D06F 33/02* | (2006.01) |

(52) U.S. Cl.
CPC ..... *D06F 33/02* (2013.01); *D06F 37/267* (2013.01); *D06F 58/24* (2013.01); *D06F 2058/2806* (2013.01); *D06F 2204/086* (2013.01)

(58) Field of Classification Search
CPC .. D06F 58/24; D06F 58/26; D06F 2058/2806; D06F 2058/2816; D06F 2058/2819; D06F 2204/086; D06F 2204/10
See application file for complete search history.

(56) References Cited

FOREIGN PATENT DOCUMENTS

| | | | |
|---|---|---|---|
| JP | 2009142472 | A | 7/2009 |
| JP | 2010104487 | A | 5/2010 |
| JP | 2017104500 | A | 6/2017 |
| KR | 10-2004-0052299 | A | 6/2004 |

OTHER PUBLICATIONS

European Patent Office, "Supplementary European Search Report," Application No. EP17858600.4, dated Jun. 14, 2019, 10 pages.

* cited by examiner

WASHING AND DRYING MACHINE

CROSS-REFERENCE TO RELATED APPLICATIONS AND CLAIM OF PRIORITY

This application is related to and claims priority to Japanese Patent Application Nos. 2016-197208 and 2017-136809, filed on Oct. 5, 2016 and Jul. 13, 2017, respectively in the Japanese Patent Office, and Korean Patent Application No. 10-2017-0101289, filed on Aug. 9, 2017 in the Korean Intellectual Property Office, the contents of each are incorporated herein by reference.

TECHNICAL FIELD

The present disclosure relates to a washing and drying machine, and more particularly, to a washing and drying machine equipped with a dehumidifier.

BACKGROUND

A conventional drum type washing and drying machine generally has a circulation flow path provided in a tub and is configured to send high temperature air heated by a heater to an inside of the tub by a blowing fan. At the same time, the conventional drum type washing and drying machine is configured to dehumidify highly humid air delivered from the tub, reheat the dehumidified air, and send the reheated air to the inside of the tub.

A dehumidifier includes a water-cooling dehumidification type in which dehumidification is performed by supplying coolant to an inside of a circulation duct (a dehumidification duct), but there is a problem in that drying time is long. Although increasing the size of a dehumidification duct, increasing an amount of coolant, increasing an air flow rate, and the like may be considered for improving a dehumidification capability, there are problems in that a space occupied by a dehumidifier is increased, the volume of water consumption is increased, performance is deteriorated due to coolant being suctioned into a fan, and the like.

RELATED ART DOCUMENT

Patent Document

[Patent Document 1] Japanese Patent No. 54-57720

[Patent Document 2] Japanese Unexamined Patent Application Publication No. 2003-117283

[Patent Document 3] Japanese Patent No. 37-10725

[Patent Document 4] Japanese Patent No. 35-17618

SUMMARY

In Patent Document 1 above, although scattering of droplets of a dehumidifying liquid is suppressed, a bypass ventilation path is formed in a single duct, and the scattering is suppressed merely by shapes of a water supply and the ventilation path. Therefore, when an air flow rate is increased, circulation from the bypass ventilation path is increased, and the drying efficiency is deteriorated. Also, although the length of the ventilation path is increased by the ventilation path being folded back in a vertical direction, the ventilation path that contributes to dehumidification is only half of the length.

In Patent Document 2 above, as a way to deal with a case in which a circulating air flow rate is increased, a method of improving scattering of droplets of coolant when an air flow rate is increased is disclosed. Here, by forming a bypass suction hole in a single duct and enabling air to pass through the bypass suction hole, a circulating air flow rate is increased, and scattering of droplets of a dehumidifying liquid is suppressed. Thus, because air from the bypass suction hole is air that is not dehumidified, there is a problem in that drying efficiency is deteriorated as much as the amount of air that is not dehumidified.

In Patent Document 3, a partition plate is arranged in a water cooling duct to increase a heat exchange area. However, because a duct having a heat exchanger is not installed independently, there is a problem in that droplets of a dehumidifying liquid scatter when an air flow rate is increased.

In Patent Document 4, although a part of a tub is formed as a part of a peripheral wall of a dehumidifier, there is only one duct system. The present disclosure includes a plurality of duct systems up to a fan connection by a member that is separate from a tub or a member that is integrated with the tub.

To address the above-discussed deficiencies, it is an object to provide an improvement in heat exchange efficiency, suppress scattering of droplets of coolant to efficiently perform a heat exchange, and as a result, save a space and shorten drying time.

To achieve the above objectives, in the present disclosure, a circulation duct includes a plurality of duct systems so that a heat exchange area is increased and heat exchange efficiency is increased, scattering of droplets of dehumidifying coolant is suppressed because an air flow rate (an air velocity) in each of the duct systems of the circulation duct is smaller compared to a case in which there is only one duct system even when a circulating air flow rate is increased, and a space is saved and drying time is shortened by efficiently performing a heat exchange.

Specifically, according to a first aspect of the present disclosure, a washing and drying machine includes a drum configured to accommodate clothes to be washed and dried, a drum driver configured to drive rotation of the drum, a tub configured to accommodate the drum and store washing water, and a circulation flow path configured to circulate drying air into and out of the drum, wherein a circulation duct constituting a part of the circulation flow path has a plurality of independent duct systems, the plurality of duct systems are connected to a converging portion configured to converge drying air, and a dehumidifier is installed in one or more duct systems of the circulation duct. The washing and drying machine according to the first aspect of the present disclosure may further include a controller configured to control the dehumidifier and two or more water supply pipes installed in the duct systems and configured to supply water to the dehumidifier.

According to the first aspect, because the circulation duct has the plurality of independent duct systems, a circulating air flow rate may be increased due to an increase in total area of each of the duct systems, that is, a heat exchange area and a cross-sectional area of the dehumidifier, and drying time may be shortened. Also, because the controller configured to control the dehumidifier and the two or more water supply pipes configured to supply water to the dehumidifier are included, a drying operation may be optimized.

According to the first aspect, the water supply pipes may be branch pipes each having a branch portion that is branched into two or more parts, and the two or more branch pipes may be connected to any one or each of the plurality of duct systems.

When configured in this way, the plurality of duct systems may be surely supplied with water.

In this case, a lower stream side end of the water supply pipe may be connected to a water supply device configured to supply dehumidifying coolant, and the water supply device may be installed more upstream than converging portion of the plurality of duct systems.

When configured in this way, the water supply device configured to supply dehumidifying coolant may be installed at each of the branch pipes, and because the water supply device is installed more upstream than the converging portion, dehumidification may be surely performed in each of the duct systems.

Also, in this case, a valve configured to turn on or off a water supply operation to the water supply pipe by the controller may be installed at the water supply pipe.

When configured in this way, water supply to the dehumidifier may be surely controlled by the controller.

Also, in this case, a valve configured to adjust opening to the branch portion by the controller may be installed at the branch portion of the water supply pipe.

When configured in this way, water supply to the dehumidifier may be surely controlled by the controller.

Also, a valve configured to distribute variable flows to different branches by the controller may be installed. In this way, water supply amounts to the duct systems may be variably adjusted, and one of the duct systems may be used as a bypass flow path.

Also, the branch portion may be configured so that flows to different branches are different in the branch portion. When configured in this way, one of the branches may be used as a bypass flow path.

According to the first aspect, a duct system side end of the water supply pipe may be connected to a nozzle, and the nozzle may have a branch portion configured to branch the water supply pipe in the nozzle.

When configured in this way, water supply to the dehumidifier may be surely controlled by the controller.

According to the first aspect, a plurality of communication holes from the tub to the circulation duct in which the dehumidifier is installed may be installed.

In this way, a communication hole after a second communication hole may function as an auxiliary communication hole even when distribution resistance of air is increased and an air flow rate is decreased because sizes of the communication holes in the circulation duct are not sufficient. For example, when the auxiliary communication hole is installed in the vicinity of a main communication hole, lint (waste pieces of thread) may also be collected because air from the auxiliary communication hole is also sufficiently dehumidified.

In this case, the plurality of communication holes in the circulation duct in which the dehumidifier is installed may be partitioned from each other by a partition rib.

In this way, when the main communication hole and the auxiliary communication hole are partitioned from each other using the partition rib, a single duct may include two duct systems. For example, when a dehumidifying liquid is supplied to both of the two duct systems, the two duct systems may be separately used so that priority is given to a dehumidification function in one duct system and priority is given to securing an air flow rate in the other duct system. Also, a dehumidifying liquid may be reused by partitioning a single duct into two duct systems so that the dehumidifying liquid is supplied only to one duct system and the supplied liquid flows to the other duct system.

The washing and drying machine according to the first aspect of the present disclosure may further include a blowing device installed in the circulation flow path and configured to circulate air and a heating device configured to heat air. In this way, due to the increase in the heat exchange area and the cross-sectional area of the dehumidifier, a circulating air flow rate may be increased while suppressing scattering of a dehumidifying liquid. As a result, drying time may be shortened.

According to the first aspect, an inner peripheral surface of the dehumidifier at a rotary shaft side of the drum may be arranged at an outside of the drum driver.

When configured in this way, because, for example, two duct systems among the plurality of duct systems may be configured in an arc shape, a flow speed of drying air may be increased at an outer peripheral portion and be decreased at an inner peripheral portion in the duct system in which the dehumidifier is installed. Therefore, it may be difficult for droplets of the dehumidifying liquid to scatter at the inner peripheral portion.

Also, according to the first aspect, an inside of the dehumidifier of the circulation duct may have a height that is larger at an inner peripheral portion than at an outer peripheral portion when viewed from a cross-section of a flat surface including the rotary shaft of the drum.

When configured in this way, because a cross-sectional area of an inner peripheral portion of the duct system in which the dehumidifier is installed is larger than a cross-sectional area of an outer peripheral portion, it may be difficult for droplets of the dehumidifying liquid to scatter at the inner peripheral portion because a flow speed of drying air at the inner peripheral portion is further decreased.

According to the first aspect, the converging portion may be configured by lower stream portions of the plurality of duct systems, and a first vibration absorbing member may be installed to be airtight between a connection of the converging portion to the blowing device and the blowing device.

In this way, when the plurality of duct systems have the converging portion of drying air, because the first vibration absorbing member is installed to be airtight between connection (fan connection) of the converging portion to the blowing device and the blowing device, vibration transmitted from the drum and the tub to the blowing device may be absorbed by the first vibration absorbing member. As a result, a negative influence of vibration on the blowing device may be suppressed. Also, because a flow path to the blowing device becomes longer by installing the first vibration absorbing member, air may be smoothly introduced (suctioned) into the blowing device.

Also, according to the first aspect, the converging portion may be the first vibration absorbing member that is installed to be airtight between an air suctioner in the blowing device and connections of the plurality of duct systems, and separation walls configured to isolate the duct systems from each other may be installed up to the connections of the plurality of duct systems to the blowing device.

When the first vibration absorbing member installed to be airtight between the air suctioner in the blowing device and the connections of the plurality of duct systems is the converging portion as described above, vibration transmitted from the drum and the tub to the blowing device may be absorbed by the first vibration absorbing member. Also, because the flow path to the blowing device becomes longer by installing the first vibration absorbing member, air may be smoothly introduced (suctioned) into the blowing device.

According to the first aspect, a second vibration absorbing member may be installed to be airtight between the heating device in the circulation flow path and the tub.

In this way, vibration transmitted from the drum and the tub to the heating device may be absorbed by the second vibration absorbing member. Also, by installing the second vibration absorbing member, air may be smoothly introduced into the drum.

According to the first aspect, the converging portion may be configured by the lower stream portions of the plurality of duct systems, the connections to the blowing device and the blowing device may be connected to be airtight at the converging portion, and a third vibration absorbing member may be installed to be airtight between the plurality of duct systems and the tub.

In this way, because the third vibration absorbing member is installed to be airtight between the connections of the plurality of duct systems and the tub, vibration transmitted from the drum and the tub to the ducts and the blowing device may be absorbed by the third vibration absorbing member. Also, because the flow path from the tub to the connections of the ducts becomes longer by installing the third vibration absorbing member, air may be smoothly introduced (suctioned) into the ducts.

According to a second aspect of the present disclosure, a washing and drying machine includes a drum configured to accommodate clothes to be washed and dried, a drum driver configured to drive rotation of the drum, a tub configured to accommodate the drum and store washing water, a circulation flow path configured to circulate drying air into and out of the drum, a blowing device installed in the circulation flow path to circulate air, a heating device installed in the circulation flow path to heat air, and a water supply device configured to supply dehumidifying coolant to a dehumidifying device, wherein a circulation duct constituting a part of the circulation flow path has a fan connection and a plurality of independent duct systems that converge at an upstream side of the fan connection, a dehumidifier is installed in one or more duct systems of the circulation duct, and a controller configured to control the dehumidifier may be further included.

According to the second aspect, because the circulation duct has the plurality of independent duct systems, a circulating air flow rate may be increased while scattering of a dehumidifying liquid is suppressed due to an increase in total area of each of the duct systems, that is, a heat exchange area and a cross-sectional area of the dehumidifier, and drying time may be shortened. Also, because the controller configured to control the dehumidifier is included, a drying operation may be optimized.

According to the second aspect, in the duct system in which the dehumidifier is not installed among the plurality of duct systems, a lint filter and a lint filter cleaning nozzle configured to clean the lint filter which are consecutively arranged from a lower stream side between the tub and a converging portion to the fan connection may be further included.

In this way, because the duct system in which the dehumidifier is not installed may be used as a bypass flow path, a circulating air flow rate may be increased. Also, because accumulation of lint in a duct, a fan, a heater, or the like located more upstream than the lint filter may be prevented by the lint filter removing lint in circulating air, and lint attached to the lint filter may be removed by the lint cleaning nozzle at the same time, a function as the bypass flow path may also be maintained.

According to the second aspect, the plurality of duct systems may be three or more duct systems.

In this way, because a circulating air flow rate may be increased while suppressing scattering of a dehumidifying liquid due to the increase in the heat exchange area and the cross-sectional area of the dehumidifier, the drying time may be further shortened.

According to the second aspect, the circulation duct may be configured with a body of the plurality of duct systems that include the fan connection of the duct systems constituting the circulation duct and a cover configured to cover the body.

In this way, the plurality of duct systems may be surely configured.

According to the second aspect, in the circulation duct, a portion from the tub to the fan connection may be configured by at least branch ducts, and the branch ducts may converge at an upstream side of the fan connection.

In this way, only one blowing device may be included.

In this case, communication holes from the tub to the branch ducts may be located below a horizontal surface of a rotary shaft of the drum.

In this way, distances from the branch ducts to the fan connection may be increased, and distance from the water supply device to the communication holes of the tub may be increased at the same time. That is, because a large heat exchange area may be secured in the dehumidifier, a sufficient heat exchange may be performed.

Also, in this case, a dehumidifying liquid supply nozzle, which is the water supply device, may be installed at the dehumidifier, and the dehumidifying liquid supply nozzle may supply water to each of the branch ducts.

In this way, dehumidification may be efficiently performed.

In this case, the dehumidifying liquid supply nozzle may be integrally formed with the body or the cover.

In this way, a material cost and an assembly cost may be reduced.

In this case, the body may be integrally formed with the tub, and water from the dehumidifying liquid supply nozzle may be supplied to an inside of the tub.

In this way, because high temperature highly humid air may also be cooled from the inside of the tub, dehumidification inside the tub may be facilitated.

Also, a dehumidifying coolant nozzle, which is the water supply device, may be arranged in each of the branch ducts.

In this case, a water supply port of the dehumidifying coolant nozzle may be installed to face a bottom surface of the tub.

Also, in this case, the water supply port of the dehumidifying coolant nozzle may be in a direction lower than a horizontal direction and may face inner peripheral portions of the branch ducts.

When configured in this way, a dehumidifying liquid is toward a bottom surface side of the tub and is surely supplied toward the inner peripheral portions of the branch ducts. That is, a downward force and a force toward the inner peripheral portions of the branch ducts are applied to the dehumidifying liquid.

Also, when the dehumidifying coolant nozzle is arranged at outer peripheral portions of the branch ducts, because a flow speed of drying air is increased at the outer peripheral portions and at a duct cover, the dehumidifying liquid is supplied from the bottom surface side of the tub toward the inner peripheral portions at which the flow speed is low by avoiding air flowing at a high flow speed at the outer peripheral portions and at the duct cover when the water supply port of the dehumidifying coolant nozzle is installed to face the bottom surface of the tub, more specifically, installed to face the bottom surface and face the inner peripheral portions of the branch ducts in a lower direction of a vertical direction.

Also, in this case, a guide plate configured to guide water from the water supply port may be installed at the water supply port of the dehumidifying coolant nozzle, and the guide plate may be installed to have an upper surface of the guide plate inclined toward the bottom surface of the tub.

When configured in this way, the dehumidifying liquid may be supplied toward the bottom surface of the tub and toward the inner peripheral portions of the branch ducts at which the flow speed is low by avoiding air blowing at a high flow speed at the outer peripheral portions of the branch ducts and the duct cover.

According to the second aspect, the circulation duct may have a duct cleaning nozzle, and the duct cleaning nozzle may be installed to be able to clean the plurality of duct systems and the fan connection.

In this way, lint (waste pieces of thread) attached to an area inside of the circulation duct not reached by the dehumidifying coolant may be cleaned.

When the circulation duct is configured with a body and a cover configured to cover the body, the duct cleaning nozzle may be integrally formed with the body or the cover.

In this way, a material cost and an assembly cost may be reduced.

The body and the cover of the branch ducts of the tub may be integrated by welding.

In this way, by forming the circulation duct including the branch ducts in an integrated structure by welding, the number of assemblers may be decreased and leakage due to an assembly error may be avoided compared to a case in which a seal material is interposed between the body and the cover and the body and the cover are assembled by fixing with a screw.

In this case, inner peripheral surfaces of the branch ducts at the rotary shaft side of the drum may be arranged more outward than an outer peripheral surface of the drum driver.

In this way, sufficient drying performance may be obtained by securing a duct area (a heat exchange area) of the circulation duct while avoiding interference between the circulation duct and a driver (including a vibration at the time of dehydration).

Also, the drum driver may be a direct drive (DD) motor arranged at a rear surface of the tub.

In this way, the present disclosure may also correspond to a DD motor without a belt.

In this case, the communication holes from the tub to the branch ducts may be integrated into a single communication hole, and the branch ducts may respectively form paths from the single communication hole.

In this case, the DD motor without a belt may be employed.

Also, in this case, a partition configured to divide a central portion of the communication hole may be formed in the communication hole from the tub, and the partition may extend up to the circulation duct.

In this way, circulating air may be smoothly sent to each of the branch duct systems, and strengths of the branch duct systems may be improved.

When the circulation duct is formed with a body and a cover configured to cover the body, the body may be integrally formed with the tub.

In this way, a material of the circulation duct whose size is increased due to having the plurality of duct systems may be reduced.

In this case, at the rear surface of the tub, radial ribs extending outward from a central portion thereof may be installed for securing a strength, and radial ribs with a height of, for example, about 1 mm to 5 mm that does not significantly impede a circulating air flow rate may be formed at positions corresponding to those of the radial ribs of the tub at inner portions of the plurality of duct systems formed in the tub.

In this way, an improvement in a strength of each of the duct systems may be promoted, and because air containing moisture is mixed with a dehumidifying liquid by a stirring action of the radial ribs formed at the tub, a heat exchange may be efficiently performed.

In this case, an aluminum die-cast portion that also serves as a drum bearing holder may be insert-molded at the rear surface of the tub, and an outer peripheral portion of the aluminum die-cast portion may extend up to a side portion of the tub.

In this way, a strength of the rear surface of the tub may be secured.

In this case, the aluminum die-cast portion may be formed by a cylindrical rib that is raised rearward and forward at the outer peripheral portion thereof, and an outer peripheral rib having a size that is larger than other portions only at a front side may be installed at the converging portion of the circulation duct.

In this way, the aluminum die-cast portion may secure strengths of the outer peripheral portion thereof and the converging portion without impeding airflow at the converging portion of the circulation duct.

In this case, the converging portion of the circulation duct at the aluminum die-cast portion may be formed of a smoothly curved surface toward the fan connection from the rear.

In this way, because the tub may also have a shape according to the aluminum die-cast portion, air may smoothly flow from the circulation duct toward the fan connection.

When the body is integrally formed with the tub, radial ribs having a T-shaped cross-section may be installed at positions corresponding to those of the radial ribs installed at the tub at a portion of the aluminum die-cast portion at which the circulation duct is arranged.

In this way, the strength of the aluminum die-cast portion may be secured without significantly impeding airflow inside the circulation duct.

Also, when the body is integrally formed with the tub, the circulation duct from the tub to the fan connection may be formed by the branch ducts, and the body and the cover of the branch ducts may have a double wall structure at a portion of an inner wall up to the converging portion of the branch ducts.

In this way, the strength of the circulation duct may be improved.

In this case, the double wall structure may be arranged by extending higher than a height of a water surface when submerging occurs at a portion that is submerged when washing and rinsing are performed.

In this way, because a watertight portion in the tub is formed of a double structure, safety against leakage is improved.

In this case, a space placed between double walls of the double wall structure may be formed to enable communication between the branch duct systems.

In this way, an airtightness test for the whole double wall structure of the circulation duct may be performed at once.

In this case, at portions at which the branch ducts communicate, an inner wall portion near the converging portion of the branch ducts may have a shape in which a duct width is maintained.

In this way, the portion at which the duct width is maintained may serve as a guide of circulating air and may smoothly guide circulating airflow from each of the ducts toward the converging portion.

In this case, in the circulation duct, a testing aperture for testing watertightness of the space between the double walls of the double wall structure may be installed higher than the height at which submerging occurs when washing and rinsing are performed.

In this way, being watertight after the test is not required.

Also, in this case, the testing aperture may be installed at each portion at which the duct width is maintained near the converging portion of the branch ducts.

In this way, a space in the branch ducts may be effectively utilized, and narrowing of duct flow paths due to the testing aperture may be avoided.

Also, an inner wall side and an outer wall side of the double wall structure may be connected to each other via one or more ribs.

In this way, an improvement in strength of the duct systems may be promoted.

Here, the ribs may be arranged at positions at which the ribs of the body and the cover face each other.

In this way, when welding the tub and the duct cover to each other, because the ribs thereof may also be welded to each other and a weld area increases as much as the ribs thereof being welded to each other, the strength of the circulation duct may be improved.

Also, when the rib is arranged at a position at which the ribs of the body and the cover face each other, at least one side may be set to be lower between a rib height of the body and a wall surface height of the body and between a rib height of the cover and a wall surface height of the cover.

In this way, because communication is not impeded in the space of the double wall structure, the airtightness test may be surely performed.

Conversely, the rib may be arranged at a position at which the ribs of the body and the cover are misaligned with each other.

Even in this case, because communication is not impeded in the space of the double wall structure, the airtightness test may be surely performed.

Also, the body and the cover may include the double wall structure and may be integrated by welding.

In this way, the strength of the tub is improved.

Also, an aluminum die-cast portion that also serves as a drum bearing holder may be insert-molded at the rear surface of the tub, and an outer peripheral portion of the aluminum die-cast portion may be arranged more inward than the inner peripheral surfaces of the branch ducts at the rotary shaft side of the drum In this way, because the strength of the tub is improved and the aluminum die-cast portion is arranged only at a portion that is more inward than the inner peripheral surfaces of the branch ducts, a cross-sectional height of a flow path may be sufficiently secured.

Also, an aluminum die-cast portion that also serves as a drum bearing holder may be insert-molded at the rear surface of the tub, and an outer peripheral portion of the aluminum die-cast portion may be arranged between the inner peripheral surfaces and the outer peripheral surfaces of the branch ducts at the rotary shaft side of the drum.

In this way, an increase in material cost of the aluminum die-cast portion may be suppressed to be minimum, and improving the strength and securing a cross-sectional area of the duct (cavity) are both possible at the rear surface of the tub.

Also, an aluminum die-cast portion that also serves as a drum bearing holder may be insert-molded at the rear surface of the tub, and an outer peripheral portion of the aluminum die-cast portion may extend up to a side portion of the tub.

In this way, the strength of the rear surface of the tub may be further improved.

Also, when the body is integrally formed with the tub, radial ribs that are radial from the same central point as the radial ribs installed at the rear surface of the tub may be installed at the cover.

In this way, because the radial ribs of the tub and the radial ribs of the duct cover coincide with each other and form an integrated structure, an overall strength of the tub may be secured.

In this case, the cover may be integrally formed by being welded to the circulation duct installed in the tub.

In this way, reinforced ribs of the cover and the radial ribs formed in the tub may be integrated and form an integrated structure as a whole, and a strength may be secured.

In this case, a bead (a groove) may be installed in an arc shape at an inside of the cover.

In this way, because the strength of the cover is secured and the bead serves as a guide of airflow at the same time, air may smoothly flow.

According to the second aspect, an outer peripheral surface of the circulation duct except the converging portion of the fan connection may be arranged more inward than the outer peripheral surface of the tub.

In this way, when vibration occurs during washing or dehydration, a capacity of the circulation duct may be secure while avoiding damage to the circulation duct due to the circulation duct coming into contact with a housing or the like.

When the body is integrally formed with the tub, ribs having a gentle shape may be installed at an opening of the circulation duct communicating with the inside of the tub.

In this way, a strength of the opening of the circulation duct may be secured and airflow in the opening may be facilitated at the same time.

Also, according to the first aspect or the second aspect of the present disclosure, the circulation duct constituting a part of the circulation flow path may have a fan connection and branch ducts of a bifurcated shape that converge at an upstream side of the fan connection, at least one branch duct system of the two branch duct system that reach the fan connection from the tub may have a dehumidifier, a water supply device may be installed in the dehumidifier, and a controller may control the water supply device and a blowing device in the branch ducts.

When configured in this way, because the circulation duct is bifurcated, a heat exchange area of the dehumidifier may be increased, and there are two communication holes reaching the circulation duct of high temperature air so that an air flow rate per one duct may be dispersed even when a circulating air flow rate is increased. Due to this, because scattering of dehumidifying coolant may be prevented, an operation that is concordant with a drying process may be realized by controlling an air flow rate by the blowing device and controlling supply of the dehumidifying coolant.

In this case, the controller may control supply of the dehumidifying coolant to the branch ducts to be turned on or off.

In this way, because the dehumidifying coolant may be supplied as needed, water may be efficiently saved.

In this case, the controller may independently control supply of the dehumidifying coolant to each of the branch ducts to be turned on or off.

In this way, because the dehumidifying coolant may be supplied to each of the branch ducts as needed, water may be efficiently saved and water supply may be controlled when a duct at one side is used as a bypass flow path at the same time.

In this case, the controller may control a supplied flow of the dehumidifying coolant to the branch ducts.

In this way, because a required amount of the dehumidifying coolant may be supplied in real time, water may be efficiently saved.

In this case, the controller may independently control a flow of the dehumidifying coolant to each of the branch ducts.

In this way, because a required amount of the dehumidifying coolant may be supplied to each of the branch ducts, water may be efficiently saved, and water supply may be controlled when a duct at one side is used as a bypass flow path at the same time.

In this case, the controller may control any one of the branch ducts of the branch ducts to be used as a bypass flow path when the dehumidifying coolant is supplied to each of the branch ducts.

In this way, a circulating air flow rate may increase and water may be saved.

In this case, the controller may control a total supply amount of the dehumidifying coolant at one side of the branch duct used as a bypass flow path to be smaller than a total supply amount thereof at the other side of the branch duct.

In this way, water may be saved while a sufficient amount of dehumidifying coolant is supplied also to the bypass flow path as needed.

In this case, the controller may control a supply amount of dehumidifying coolant to be repeatedly increased and decreased alternately within a predetermined period when the dehumidifying coolant is supplied to each of the branch ducts.

In this way, because a duct used as a bypass flow path is alternatively changed, an internal temperature of the tub may be made uniform, and a branch duct being cooled may be alternatively changed at the same time.

When a supplied flow of the dehumidifying coolant to the branch ducts is controlled, the controller may control so that diffusion of the dehumidifying coolant in the communication hole of the tub does not stop after falling-rate drying when the dehumidifying coolant is supplied to each of the branch ducts.

In this way, lint (waste pieces of thread) that scatter much in the latter part of the drying process may be surely recovered.

When a supplied flow of the dehumidifying coolant to the branch ducts is controlled, the controller may control so that diffusion of the dehumidifying coolant in the communication hole of the tub does not stop during cool down when the dehumidifying coolant is supplied to each of the branch ducts.

In this way, lint that scatter much in the latter part of the drying process may be surely recovered.

In this case, the controller may temporarily decrease an air flow rate of the blowing device at the start of supplying the dehumidifying coolant and then return to an ordinary air flow rate.

In this way, scattering of the dehumidifying coolant due to air blowing right after the start of supplying the dehumidifying coolant may be suppressed.

In this case, the controller may control an air flow rate at the time of cool down to be smaller than an air flow rate at ordinary times with respect to the blowing device.

In this way, scattering of the dehumidifying coolant may be further suppressed, and fine drying quality may be achieved.

In this case, the controller may simultaneously start supplying the dehumidifying liquid to each of the branch ducts and the drying operation.

In this way, drying time may be shortened.

In this case, supplying the dehumidifying liquid to each of the branch ducts may start after a predetermined amount of time from the start of the drying operation.

In this way, because a temperature in the drum rises rapidly, the drying time may be shortened and water may be saved.

BRIEF DESCRIPTION OF THE DRAWINGS

These and/or other aspects of the disclosure will become apparent and more readily appreciated from the following description of the embodiments, taken in conjunction with the accompanying drawings of which:

FIG. 2 is a perspective view from the rear side of the washing and drying machine illustrated in FIG. 1 in a state excluding a housing and the like;

FIG. 13 is a perspective view from the rear side of a washing and drying machine having a circulation duct with three duct systems according to a modified example of the first embodiment in a state excluding a housing and the like;

FIG. 20 is a perspective view from the rear side of a washing and drying machine according to a second embodiment of the present disclosure in a state excluding a housing and the like;

FIG. 44 is a perspective view from the rear side of a washing and drying machine having a circulation duct with three duct systems according to a first modified example of the second embodiment in a state excluding a housing and the like;

DETAILED DESCRIPTION

Figure 1:
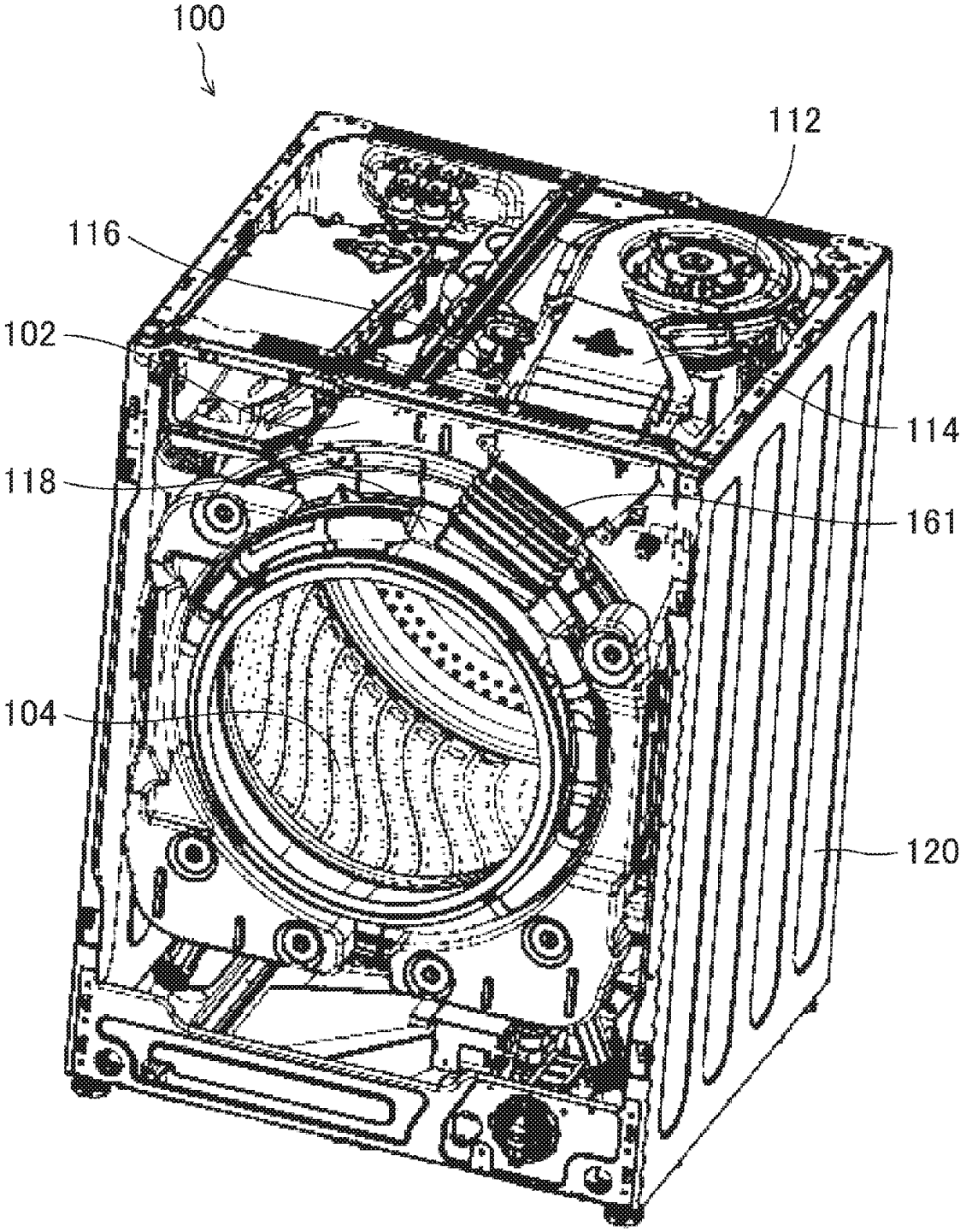
FIG. 1 is a perspective view of a washing and drying machine according to a first embodiment of the present disclosure from which a door, a ceiling plate, and the like are omitted.
Figure 83:
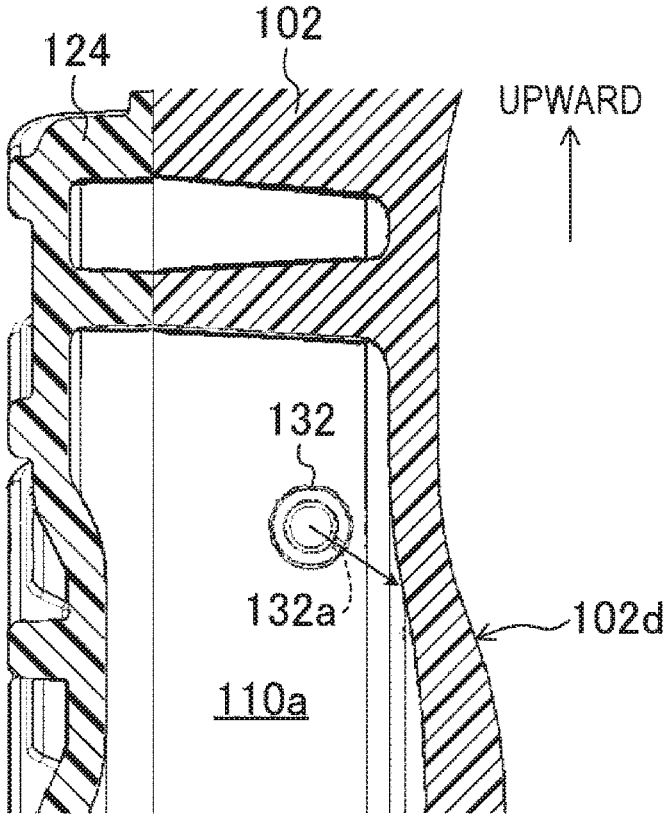
FIG. 83 is an enlarged cross-sectional view of a vertical cross-section of the portion in which the dehumidifying coolant nozzle is arranged in the branch duct constituting the washing and drying machine according to the second embodiment.

FIGS. 1 through 83, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, exemplary embodiments according to the present disclosure will be described in detail with reference to the accompanying drawings. The terms "front end," "rear end," "upper portion," "lower portion," "upper end," "lower end," and the like used in the following description are defined on the basis of the drawings, and shapes and positions of elements are not limited by the terms.

Hereinafter, "F" refers to a direction in which air introduced into a circulation duct 110 flows (see FIG. 2).

First Embodiment

A first embodiment will be described with reference to the drawings.

FIG. 1 is a perspective view illustrating a washing and drying machine according to the first embodiment from which a door, a ceiling plate, and the like are omitted for convenience. FIG. 2 is a perspective view from the rear side of the washing and drying machine illustrated in FIG. 1 in a state excluding a housing and the like.

Figure 2:
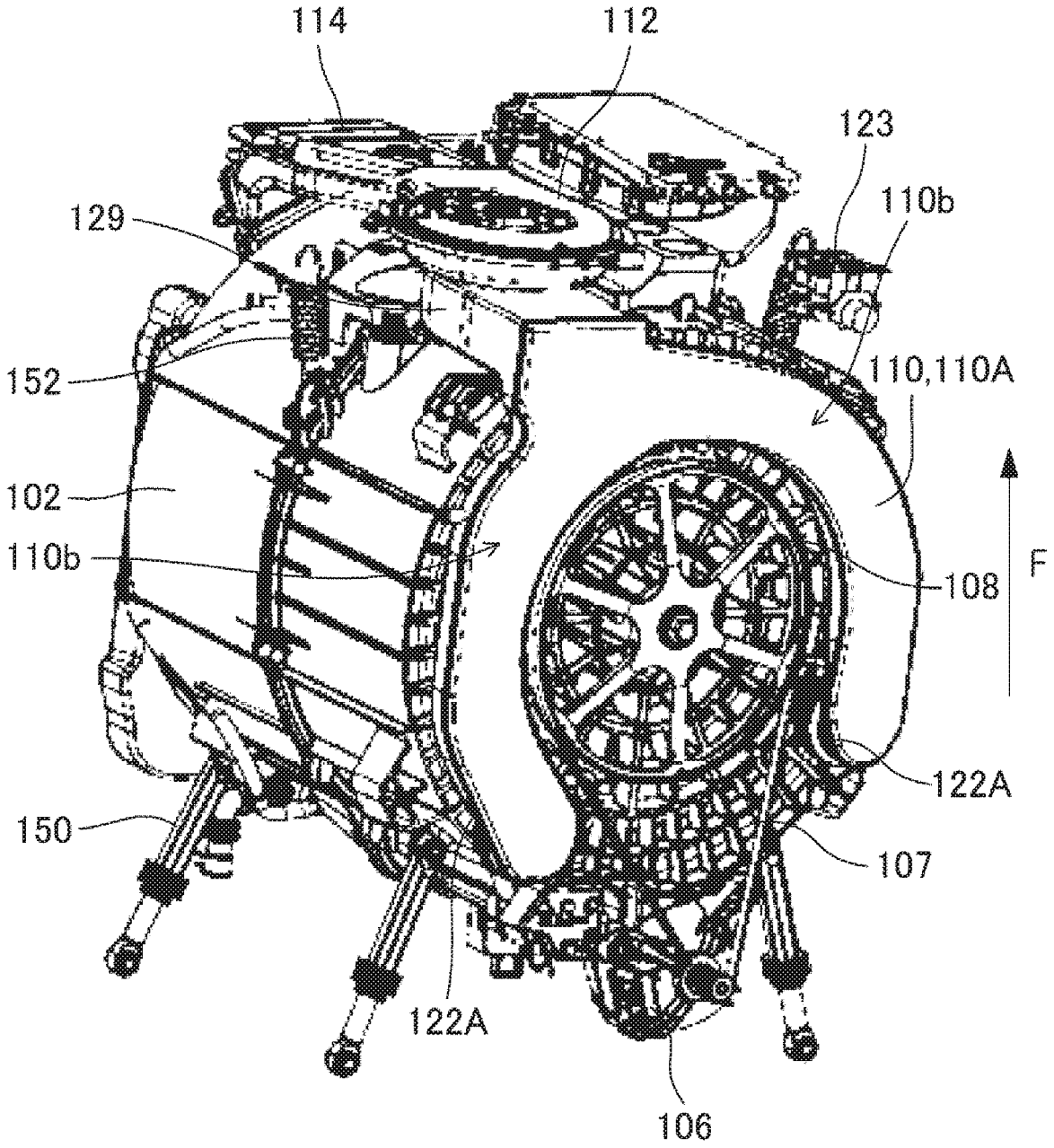

As illustrated in FIGS. 1 and 2, in a washing and drying machine 100 according to the present embodiment, a tub 102 may be arranged to be elastically supported by a damper 150 and a spring 152 inside a housing 120. The tub 102 may be provided at an outside of a drum 104 to accommodate the drum 104.

The drum 104 configured to accommodate clothes to be washed and dried may be arranged inside the tub 102. The drum 104 may be provided to be rotatable about a rotary shaft. A front portion of the drum 104 may be opened and closed by a door (not illustrated). The drum 104 has a plurality of dehydration holes that also serve as ventilation holes formed at a periphery of a side surface and a rear surface.

A driver configured to rotate the drum 104 is installed at a substantially central portion of a rear surface of the tub 102. As illustrated in FIG. 2, in the present embodiment, the driver has a motor 106 arranged below the tub 102 and drives a pulley 108 connected to the drum 104 via a belt 107. Also, the driver may also perform direct driving using a direct drive (DD) motor without the belt 107.

Also, the circulation duct 110 having a dehumidifier 110*b* with a dehumidification function is arranged at the rear surface of the tub 102, and the circulation duct 110 communicates with the tub 102 at a lower end thereof. An upper end of the circulation duct 110 communicates with a fan casing 112 (including a fan and a fan motor) that serves as a blowing device. The fan casing 112 communicates with a heater case 114 configured to accommodate a heater that serves as a heating device, and a thermistor 116 that serves as a temperature detector is arranged at an outlet of the heater case 114.

The heating device may be arranged on a circulation flow path to heat air.

The blowing device may be arranged on the circulation flow path to circulate air.

The circulation duct 110 may be provided on the circulation flow path. Also, the circulation duct 110 may include a plurality of independent duct systems. One or more dehumidifiers 110*b* may be installed in the circulation duct 110. In other words, the dehumidifier 110*b* may be installed in one or more of the plurality of duct systems.

An opening formed in the tub 102 in the heater case 114 may communicate with a communication port protruding from a diaphragm 118 that is elastically deformable, and hot air is blown into the drum 104. The hot air blown into the drum 104 removes moisture from laundry, flow into the tub 102 via a plurality of holes (drum holes) installed in the drum 104, and is introduced into the circulation duct 110 via openings (communication holes which will be described below) that communicate with the circulation duct 110. In this way, the circulation flow path is formed by the fan casing 112, the heater case 114, the communication port of the diaphragm 118, the drum 104, the circulation duct 110, and a roof of the fan casing 112. The circulation flow path may be provided so that air circulate into and out of the drum 104.

Also, although not illustrated, for example, a controller including a microcomputer may be installed as a control means for electrically controlling at least the motor 106, the fan casing 112 including the fan, the heater case 114 including the heater, the dehumidifier 110*b*, and a water supply valve 123 (which will be described below) in the washing and drying machine 100 according to the present embodiment.

According to the present embodiment, a duct system constituting the circulation duct 110 is divided into a plurality of duct systems, and the plurality of duct systems are configured to converge at an upstream side of a connection with the fan casing 112, for example, at a portion right before the connection with the fan casing 112. Also, the dehumidifiers 110*b* installed in the plurality of duct systems may be installed in all of the duct systems as in the present embodiment but are not necessarily installed in all of the duct systems as long as the dehumidifier 110*b* is installed in at least one duct system.

FIG. 2 is an example illustrating the circulation duct 110 with two duct systems, i.e., branch ducts 110A, but embodiments are not limited to having two duct systems, and a third duct system may also be installed. The third duct system may be installed to, for example, converge from a side surface of the tub 102 to a blowing device connection, i.e., a fan connection (fan casing connection) 129. A configuration in which the third duct system is installed will be described below as a modified example of a duct system.

Figure 3:
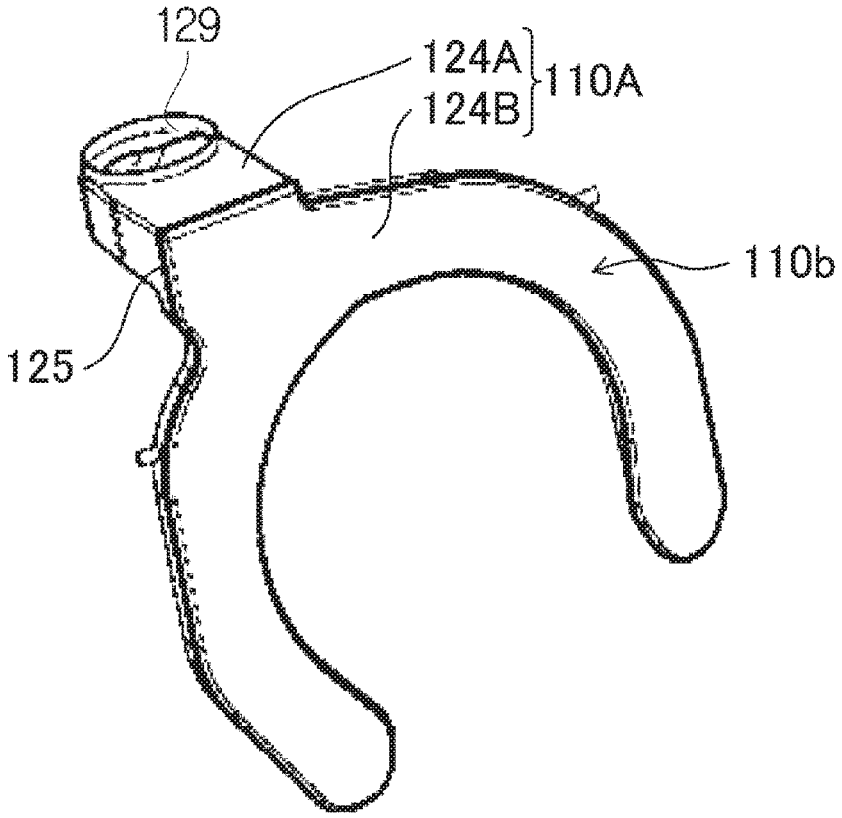
FIG. 3 is a perspective view of a circulation duct constituting the washing and drying machine according to the first embodiment from the front.
Figure 4:
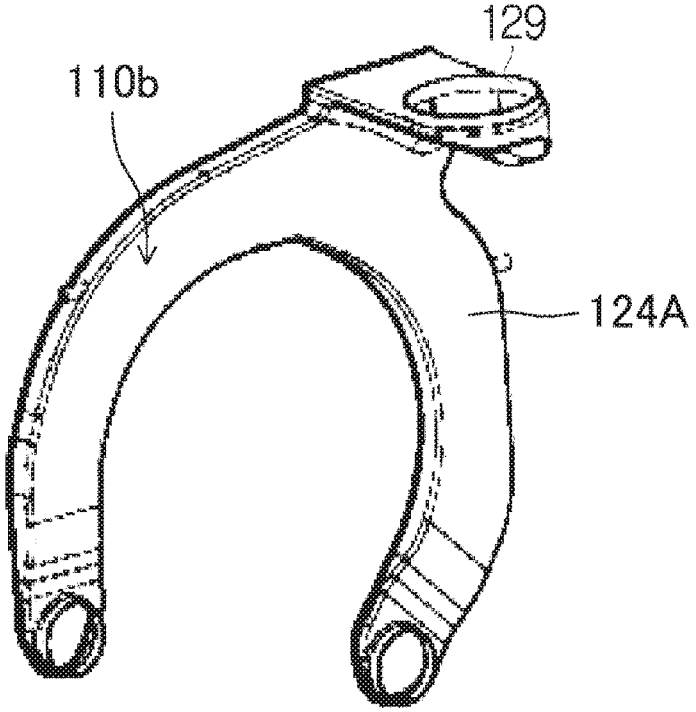
FIG. 4 is a perspective view from the rear side of FIG. 3.

As illustrated in FIGS. 3 and 4, the branch duct 110A may include a blowing device connection 129 connected to the blowing device so that air that passed through the branch duct 110A is introduced into the blowing device. Also, the branch duct 110A may further include a body 124A at which the blowing device connection 129 is provide. Also, the branch duct 110A may further include a cover 124B coupled to the body 124A to define the plurality of duct systems together with the body 124A. Specifically, as an example, the branch duct 110A includes the body 124A that is integrally formed with a connection with the tub 102 and a connection with the fan casing 112, and the cover 124B configured to cover a side surface of the body 124A to be airtight (watertight). The connection with the tub 102 and the connection with the fan casing 112 are, for example, substantially circular openings. Also, the body 124A and the cover 124B may be implemented with, for example, an integrated structure having a welded portion 125 which is welded. However, the body 124A and the cover 124B may also be coupled by interposing a seal material therebetween and fixing the seal material by a screw.

In FIG. 2, a vibration absorbing member 122A may be arranged between the tub 102 and the circulation duct 110. Specifically, a lower end of the circulation duct 110 is connected to the tub 102 via the vibration absorbing member 122A, and the circulation duct 110 is installed in the housing 120 (see FIG. 1). Also, the fan casing 112 and the heater case 114 installed in the housing 120 are directly connected to the circulation duct 110 by a seal material interposed therebetween.

Due to this, vibration that occurs in the drum 104 during rotation and is transmitted to the branch duct 110A and the fan casing 112 via the tub 102 that supports the rotary shaft of the drum 104 may be absorbed by the vibration absorbing member 122A. As a result, a negative influence of the vibration from the drum 104 on the branch duct 110A and the fan casing 112 may be suppressed. Also, when the vibration absorbing member 122A is installed, because a flow path to the branch duct 110A becomes longer, air is smoothly introduced (suctioned) into the branch duct 110A.

Conversely, the circulation duct 110 may be fixed to the tub 102 to be watertight by interposing a seal material therebetween, and the fan casing 112 and the heater case 114 installed in the housing 120 may be connected to the circulation duct 110 by interposing a vibration absorbing member (not illustrated) therebetween. Because a configuration of installing the vibration absorbing member will be described below in description of a second embodiment, an effect thereof will also be described in the description of the second embodiment.

Although not illustrated, the fan casing 112 and the heater case 114 may also be installed in the tub 102. In this case, the circulation duct 110 may be directly connected to the fan casing 112 by a seal material interposed therebetween, and a vibration absorbing member is not required.

Figure 5:
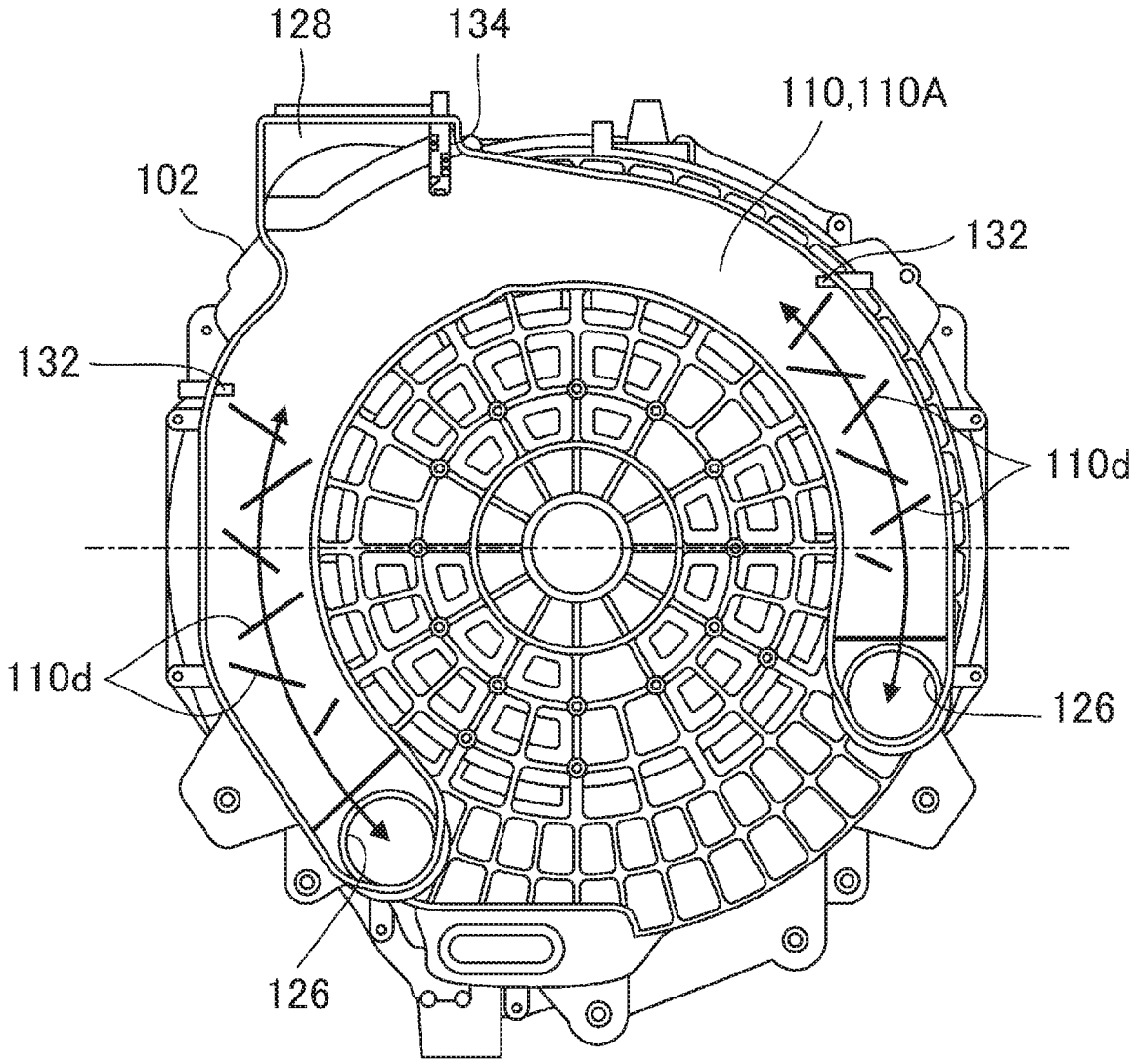
FIG. 5 is a front view illustrating a state in which a cover of the circulation duct constituting the washing and drying machine according to the first embodiment is omitted.

As illustrated in FIG. 5, one or more communication holes 126 may be provided at one or more of the plurality of duct systems in which the dehumidifier 110*b* is installed to communicate with the tub 102. Detailed description of the one or more communication holes 126 is as follows. The communication hole 126 communicating with the tub 102 may be installed at each of the lower ends of the branch duct 110A. Specifically, each of the communication holes 126 may be installed in the body 124A of the branch duct 110A. Also, each of the communication holes 126 may be arranged below a horizontal surface of the rotary shaft of the drum 104 (see FIG. 1). In other words, the communication holes 126 may be arranged to be located more upstream than the rotary shaft of the drum 104 in a direction in which air introduced into the circulation duct 110 flows. The one or more communication holes 126 may include a first communication hole and a second communication hole formed to have different heights. As illustrated in FIG. 5, the first communication hole located at the right side may be formed at a relatively higher position than the second communication hole located at the left side.

Figure 6:
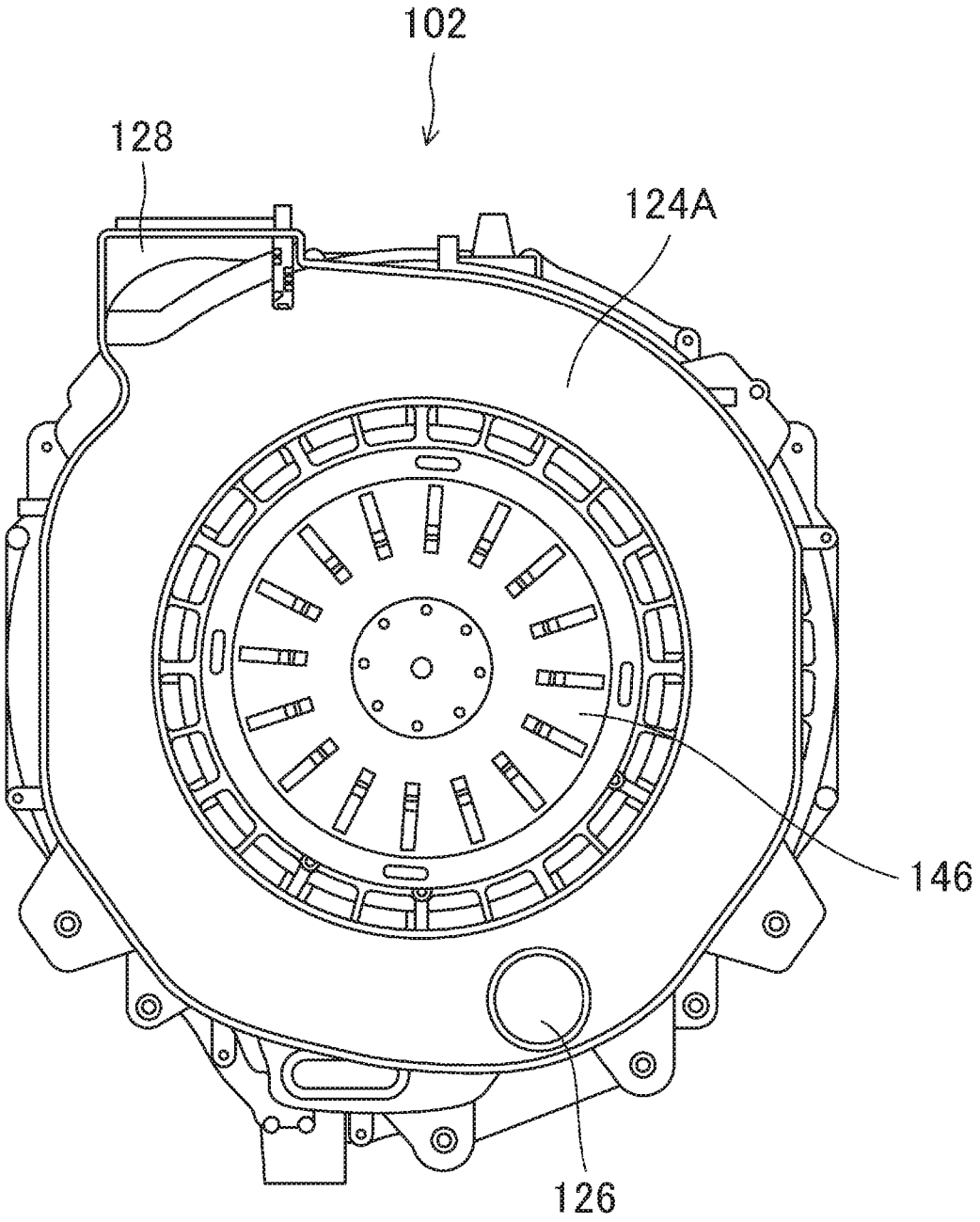
FIG. 6 is the circulation duct constituting the washing and drying machine according to the first embodiment and is a front view illustrating a body according to a modified example.
Figure 7:
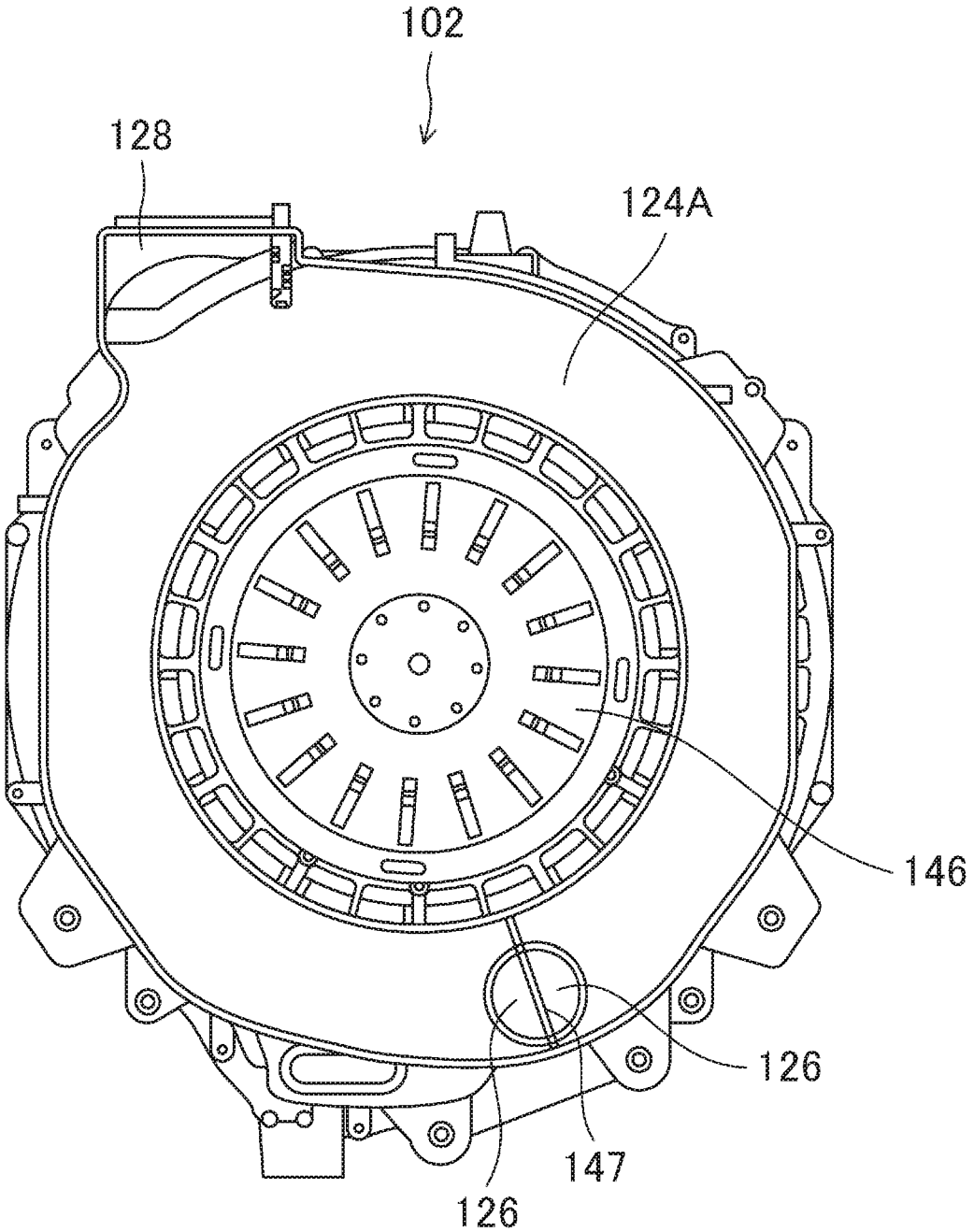
FIG. 7 is the circulation duct constituting the washing and drying machine according to the first embodiment and is a front view illustrating a body according to another modified example.

As illustrated in FIG. 6, as a modified example of the body 124A, two communication holes 126 communicating with the tub 102 may be integrated into a single communication hole 126. In this case, the branch ducts 110A may be connected to a converging portion 128 to rotate from both sides and enter the converging portion 128. In this modified example, the drum 104 may be, for example, directly driven by a DD motor 146 instead of being driven by a belt. Even in this case, the single integrated communication hole 126 is equally distant from the converging portion 128 at a portion below the horizontal surface of the rotary shaft of the drum 104, and the single integrated communication holes 126 is arranged to be located at a lowermost end. In other words, the communication hole 126 may be arranged to be located most upstream in the direction in which air introduced into the circulation duct 110 flows. Also, as another modified example of the body 124A, as illustrated in FIG. 7, a partition 147 may be installed to divide the single integrated communication hole 126 at a substantially central portion. In this way, circulating air may smoothly flow to each of the duct systems. Also, an improvement in strength of the body 124A may be promoted.

The converging portion 128 may be provided on the circulation flow path so that air converges. Also, the converging portion 128 may be connected to the circulation duct 110. The converging portion 128 may be located at a lower stream side in the direction in which air introduced into the circulation duct 110 flows.

In FIG. 5, the washing and drying machine may include a dehumidifying device arranged on the circulation flow path to dehumidify air and a water supply device provided to supply dehumidifying coolant to the dehumidifying device. Specifically, a dehumidifying liquid supply nozzle 132 is arranged as a water supply between each of the communication holes 126 and the converging portion 128, and dehumidifying coolant (hereinafter, referred to as a dehumidifying liquid) may be supplied to each of the branch ducts 110A. Here, in each of the branch ducts 110A, for example, a plurality of dehumidifying liquid guide ribs 110*d* may be arranged in zigzag manner to cross the flow path as illustrated in FIG. 5. Due to the dehumidifying liquid guide ribs 110*d* arranged in zigzag manner, a residence time of a dehumidifying liquid in the circulation duct 110 may be extended, that is, a contact time of the dehumidifying liquid with high temperature highly humid air may be extended, and dehumidification may be accelerated.

Also, a duct cleaning nozzle 134 configured to clean insides of the branch ducts 110A using cleaning water may be arranged at the converging portion 128 of the branch ducts 110A.

Figure 8:
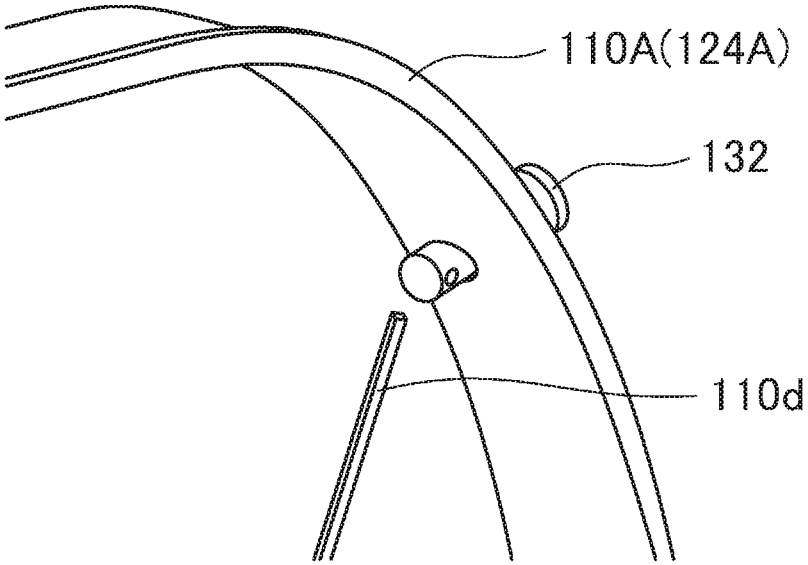
FIG. 8 is the circulation duct constituting the washing and drying machine according to the first embodiment and is an enlarged partial perspective view of a portion including a dehumidifying liquid supply nozzle that is separately arranged from the body.

As illustrated in FIG. 8, the dehumidifying liquid supply nozzle 132 may be configured with a part separate from the branch ducts 110A, i.e., the body 124A. The dehumidifying liquid supply nozzle 132 formed of a separate part may include, for example, two nozzle holes formed in the vicinity of a front end thereof and at positions facing each other in a direction perpendicular to an axial direction.

Figure 9:
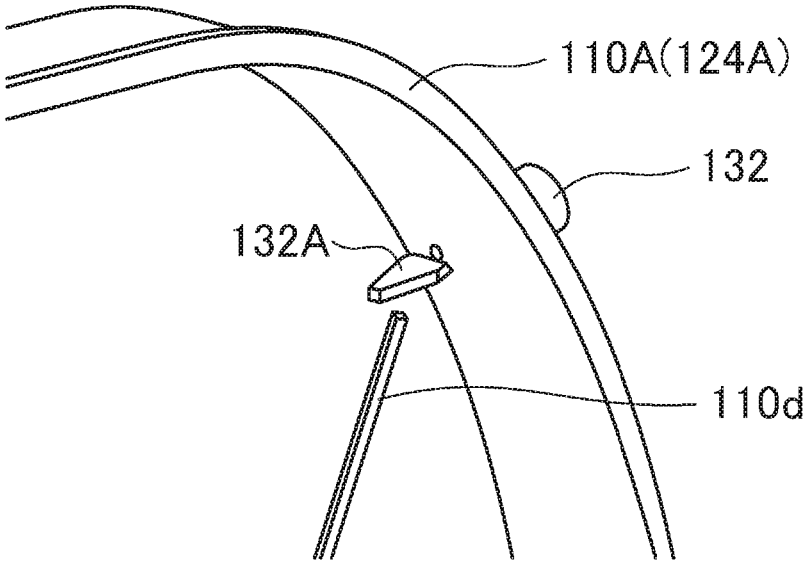
FIG. 9 is the circulation duct constituting the washing and drying machine according to the first embodiment and is an enlarged partial perspective view of a portion including a dehumidifying liquid supply nozzle that is integrally arranged with the body.

As illustrated in FIG. 9, the dehumidifying liquid supply nozzle 132 may also be integrally formed with the branch ducts 110A, i.e., the body 124A. Also, the dehumidifying liquid supply nozzle 132 may be integrally formed with the cover 124B. The dehumidifying liquid supply nozzle 132 formed of an integrated part may include, for example, a single nozzle hole formed in the vicinity of a front end thereof and a plate-shaped guide 132A installed at the front end. The guide 132A is inclined downward from a horizontal plane and has a width gradually decreasing further from the nozzle hole so that, without scattering around by moving due to flowing air, a dehumidifying liquid supplied from the nozzle flows over the guide 132A and is supplied to the dehumidifying liquid guide ribs 110*d* or to a wall surface (a surface on which the dehumidifying liquid guide ribs 110*d* are arranged) of the body 124A or to a wall surface (a surface facing the surface at which the dehumidifying liquid guide ribs 110*d* are arranged) of the cover 124B in a case in which the dehumidifying liquid supply nozzle 132 is integrally formed with the cover 124B.

Figure 10:
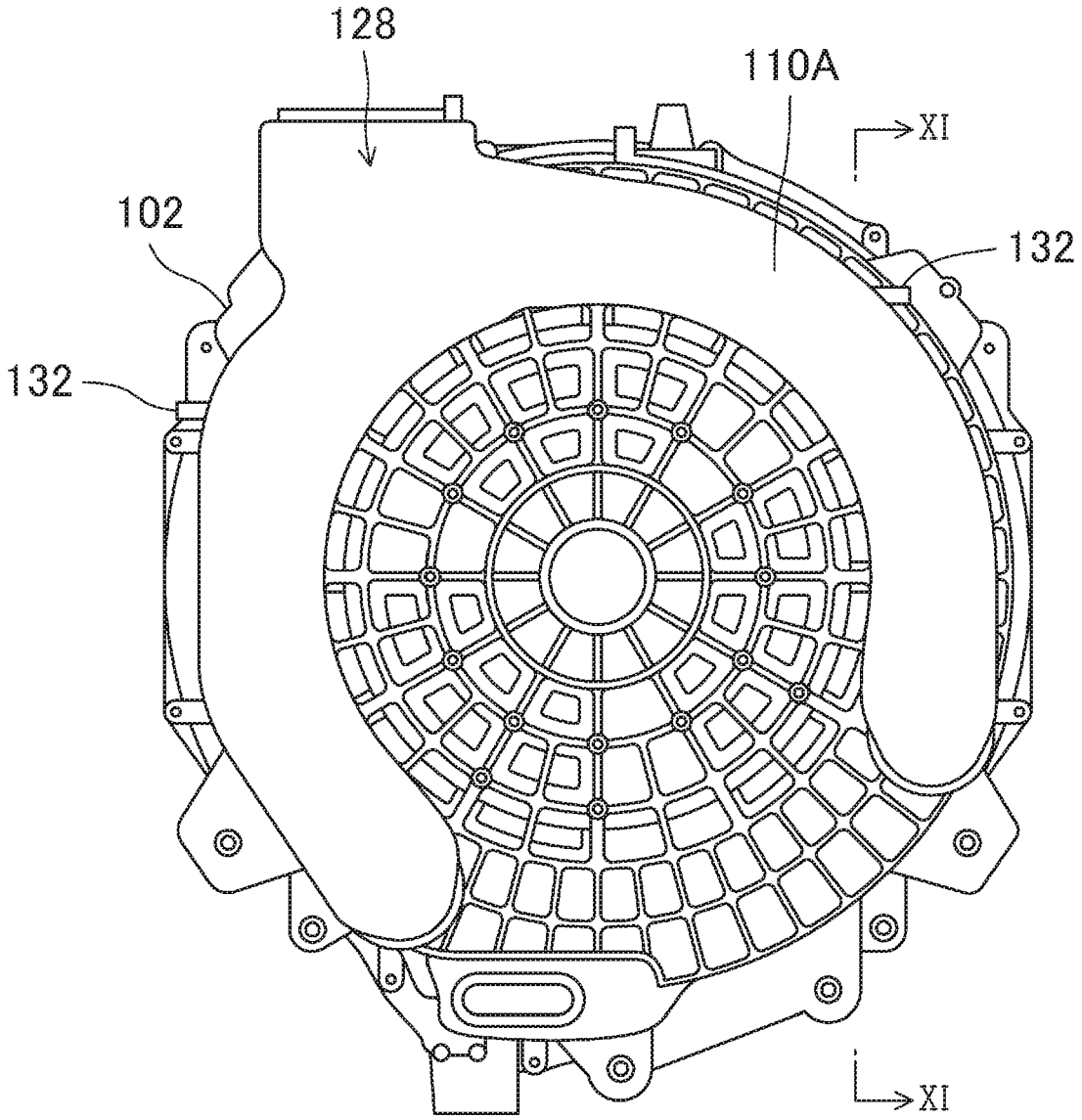
FIG. 10 is a rear view illustrating a state in which the circulation duct is arranged in a tub constituting the washing and drying machine according to the first embodiment.
Figure 11:
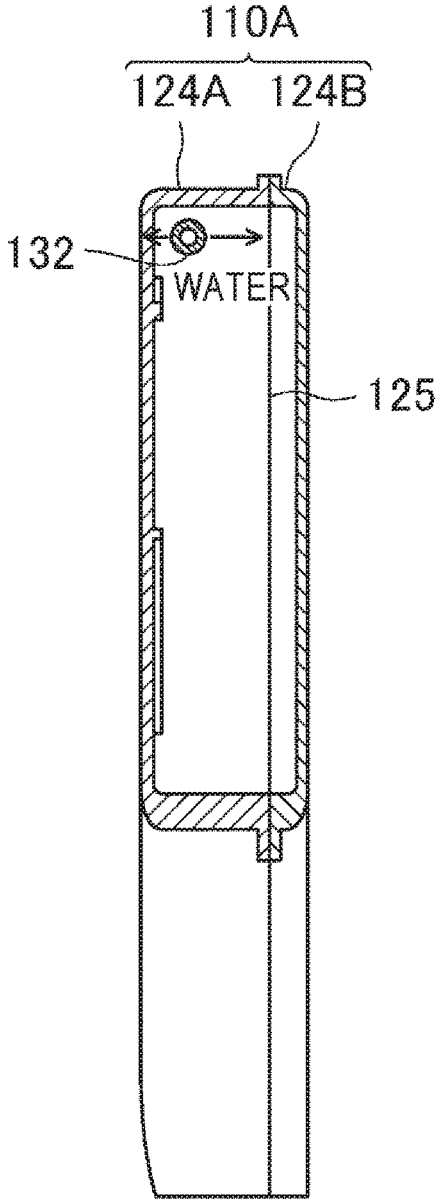
FIG. 11 is a cross-sectional view taken along line XI-XI in FIG. 10.

As illustrated in FIGS. 10 and 11, particularly in FIG. 11, a direction in which the dehumidifying liquid is supplied from the dehumidifying liquid supply nozzle 132 into the branch ducts 110A may be toward the body 124A (toward the rear surface of the tub 102), toward the cover 124B, or toward both the body 124A and the cover 124B.

Also, in the first embodiment, a dehumidifying liquid may not be supplied to the circulation duct 110, that is, the dehumidifying liquid supply nozzle 132 may not be installed. In other words, a dehumidifying liquid may not be used in drying clothes after doing laundry, and dehumidification may be performed by air-cooling actions of duct systems.

Figure 12:
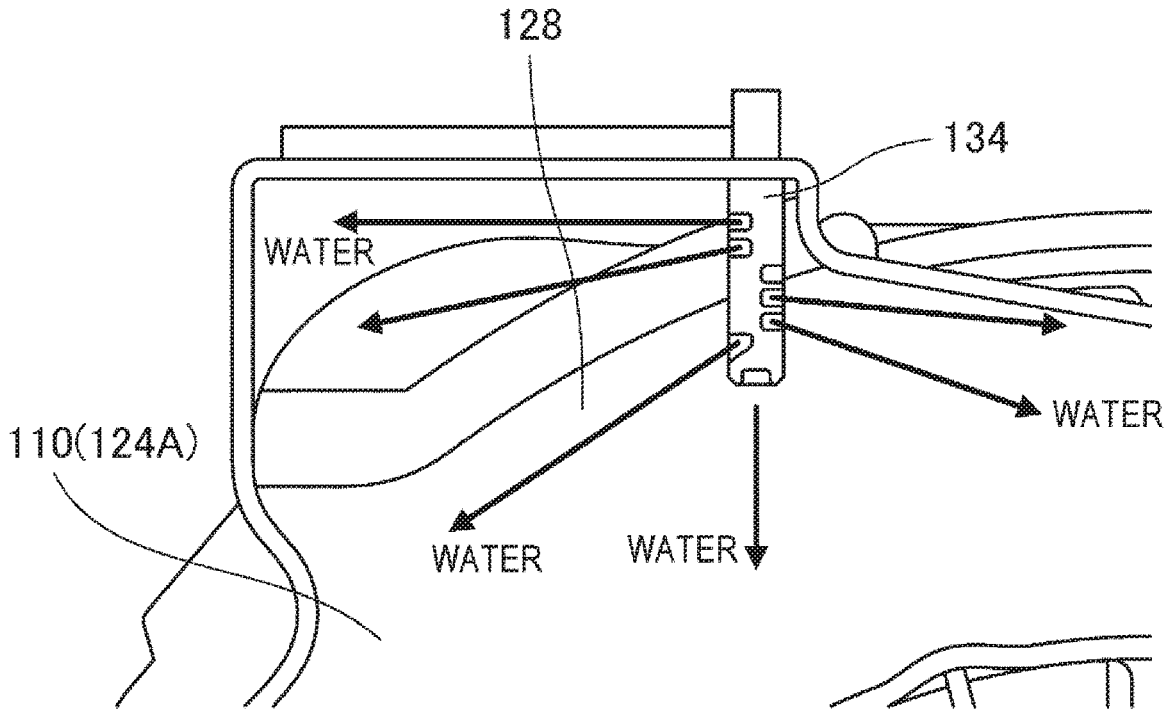
FIG. 12 is the circulation duct constituting the washing and drying machine according to the first embodiment and is an enlarged partial rear view of a portion including a duct cleaning nozzle.

Next, an example of supplying cleaning water from the duct cleaning nozzle 134 is illustrated in FIG. 12. As illustrated in FIG. 12, the duct cleaning nozzle 134 is arranged near the center of the converging portion 128 of the circulation duct 110 and enables simultaneous cleaning in directions in which the circulation duct 110 is bifurcated and a direction in which the fan casing is connected (the rear side in the drawing). Therefore, the plurality of nozzle holes of the duct cleaning nozzle 134 may be arranged to release cleaning water in a shower shape in various cleaning directions.

The duct cleaning nozzle 134 may be formed with a separate part or may be integrally formed with the circulation duct 110 (the body 124A or the cover 124B).

The inner peripheral surface of the rotary shaft side of the drum 104 in the circulation duct 110 may be arranged more outward than an outer peripheral surface of the pulley 108 configured to drive rotation of the drum 104 or a DD motor configured to directly drive the drum 104 and may be arranged at a location for avoiding interference with a motor driver and the like during dehydration vibration.

One Modified Example of the Circulation Duct According to the First Embodiment Hereinafter, a modified example of the circulation duct according to the first embodiment will be described with reference to FIGS. 13 to 15. In the present modified example, like reference numerals will be assigned to elements which overlap those of the above-described embodiment.

Figure 13:
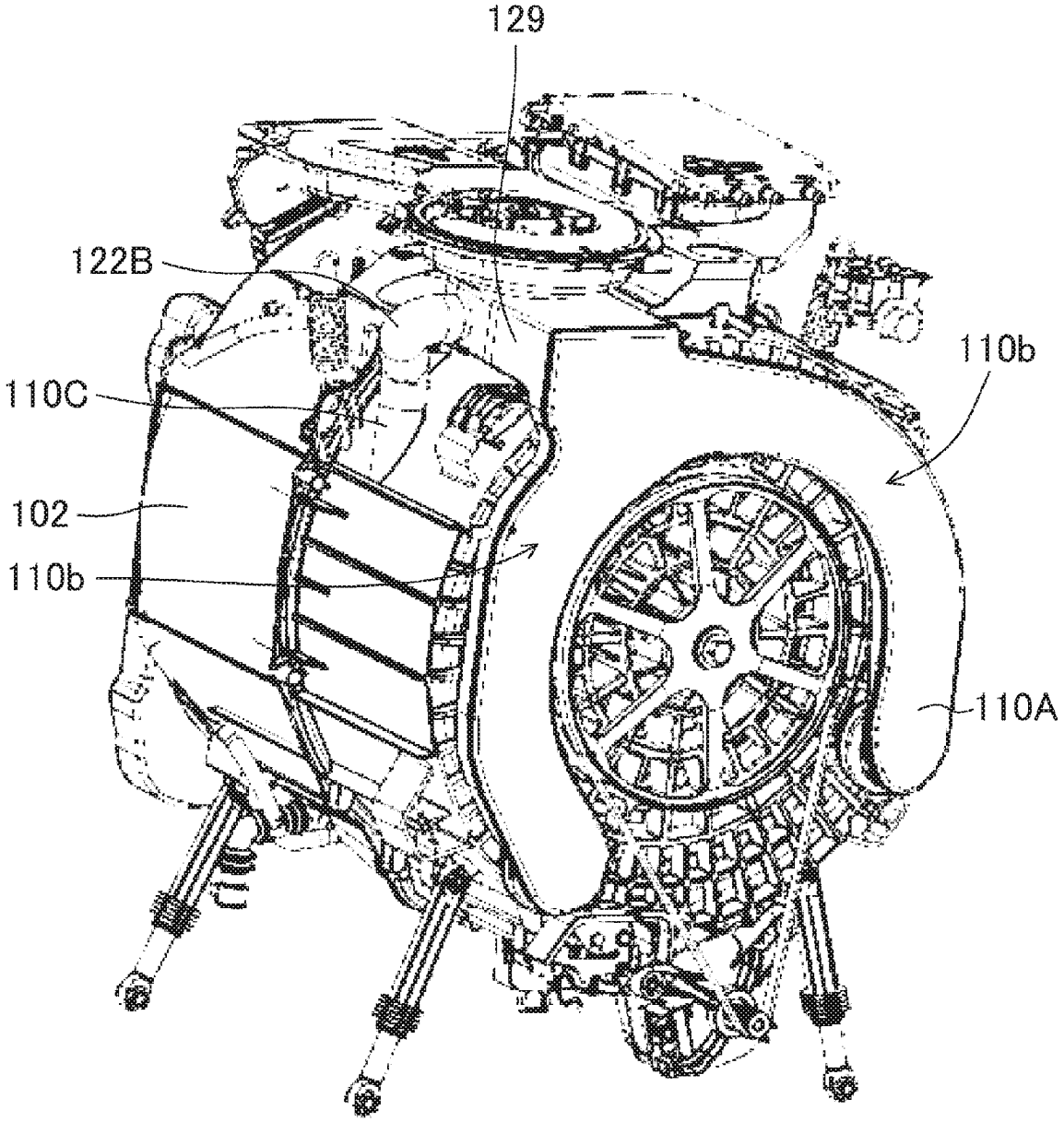
Figure 14:
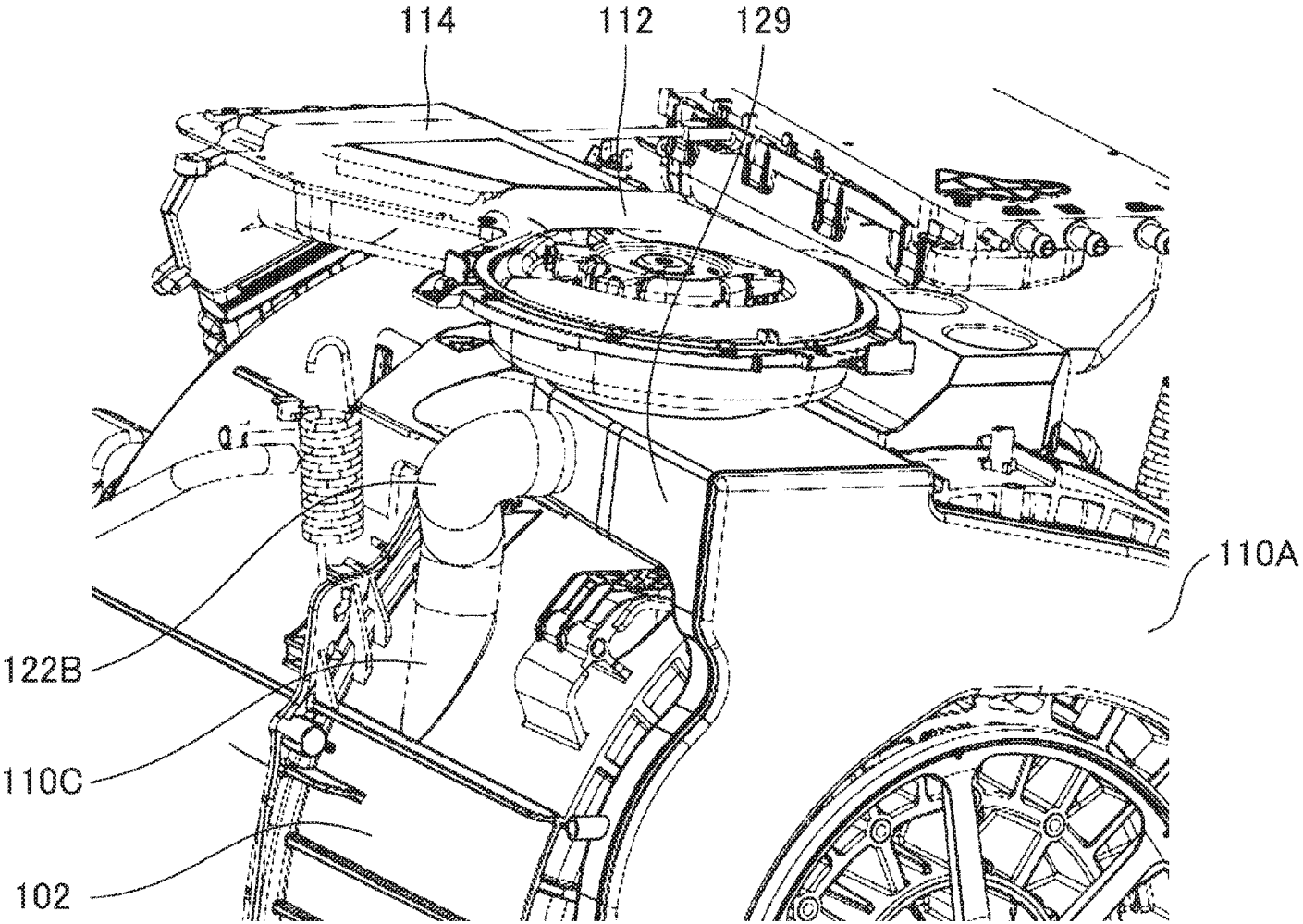
FIG. 14 is an enlarged partial perspective view illustrating a main portion of FIG. 13.
Figure 15:
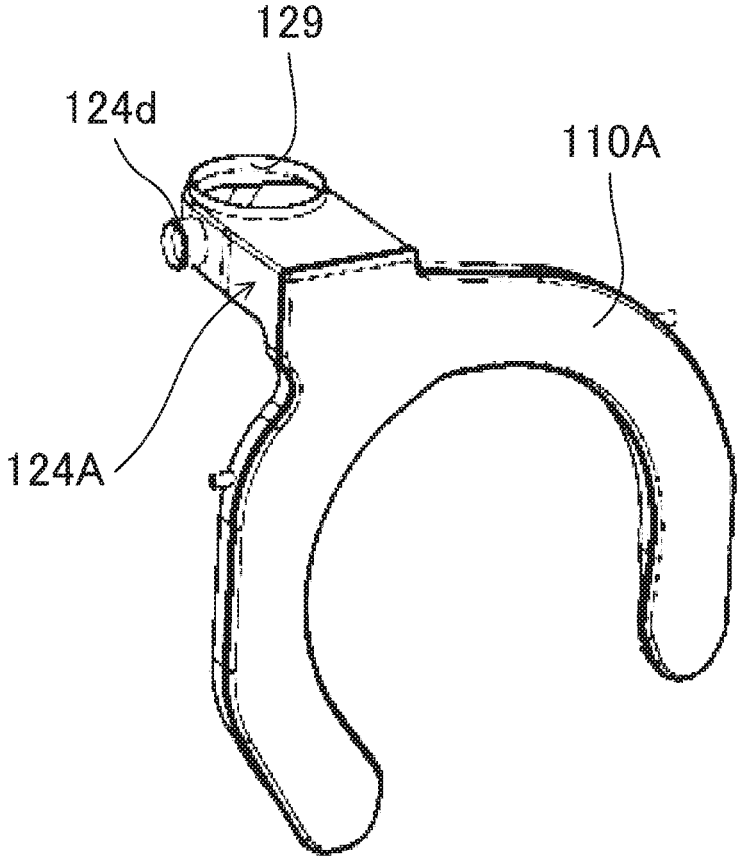
FIG. 15 is a perspective view from the front side of a circulation duct according to a modified example constituting the washing and drying machine according to the first embodiment.

As illustrated in FIG. 13 and FIG. 14, which is an enlarged partial view of FIG. 13, in addition to the branch ducts 110A constituting the circulation duct 110, a third duct system 110C is, for example, installed to converge to the fan connection 129 from an upper side surface of the tub 102. Here, the dehumidifiers 110*b* are respectively installed in the duct systems constituting the branch ducts 110A while the dehumidifier 110*b* is not installed in the third duct system 110C. The third duct system may be used as a bypass flow path for increasing a circulating air flow rate.

As illustrated in FIG. 14, the third duct system 110C may be, for example, formed in a cylindrical shape that is raised from the upper side surface of the tub 102 and may be integrally formed with the tub 102. As illustrated in FIGS. 14 and 15, an opening 124*d* communicating with the fan connection 129 may be installed in the fan connection 129 in the body 124A, and the opening 124*d* and the cylindrical duct system 110C may communicate with each other via a vibration absorbing member 122B.

Figure 16:
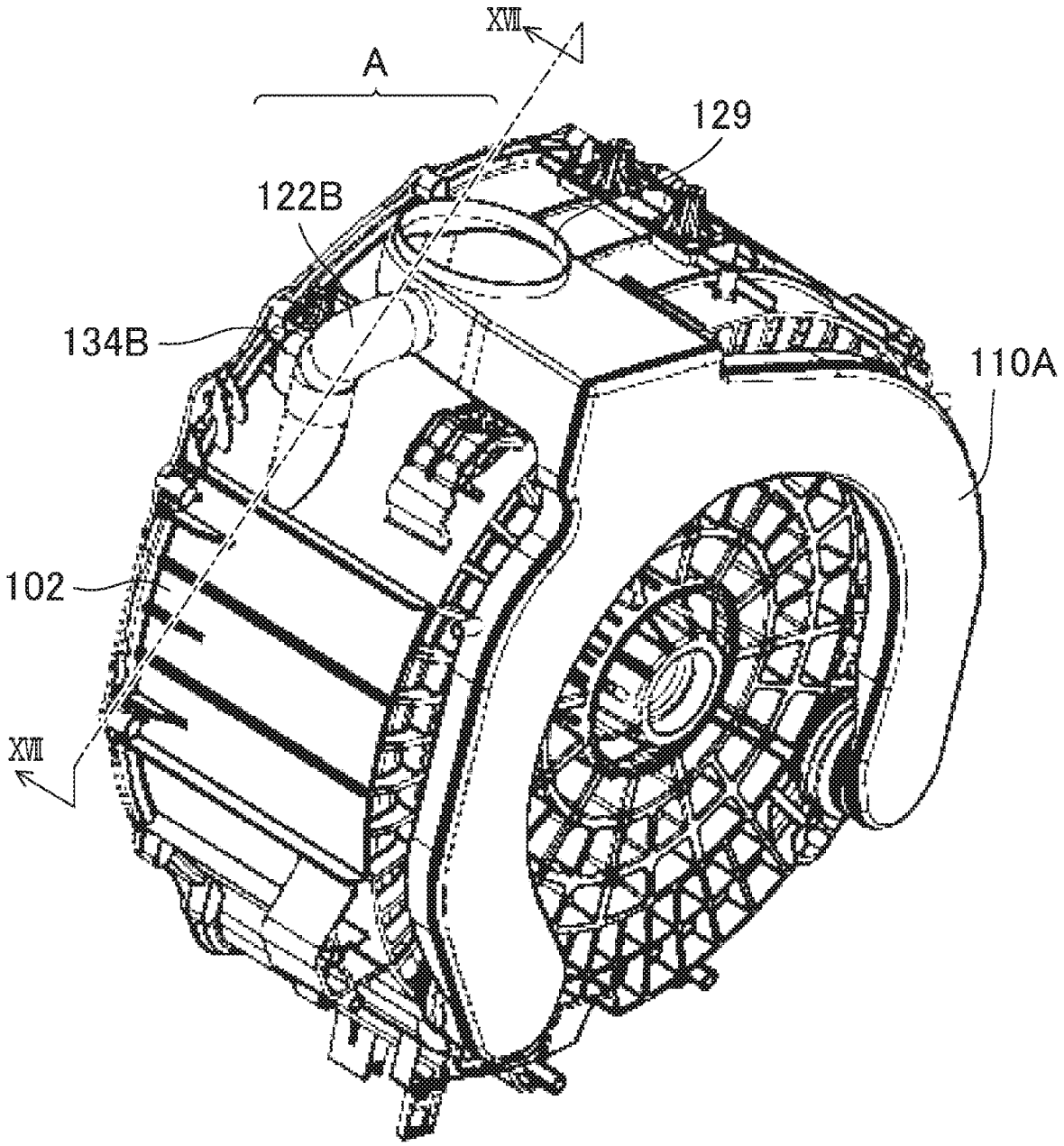
FIG. 16 is a partial perspective view illustrating a cleaning nozzle installed in a third duct system of the circulation duct according to another modified example.
Figure 17:
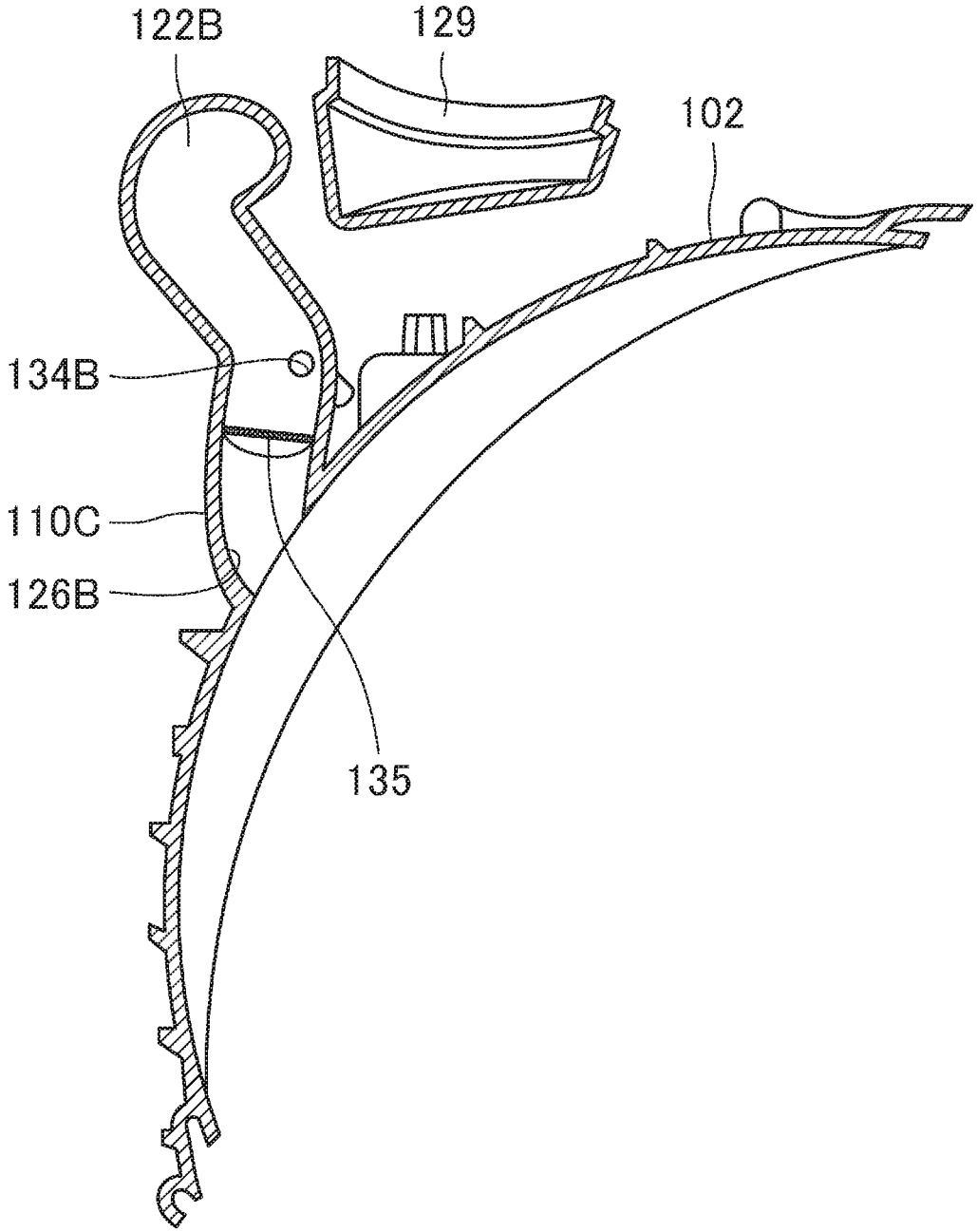
FIG. 17 is a cross-sectional view taken along line XVII-XVII in FIG. 16.
Figure 18:
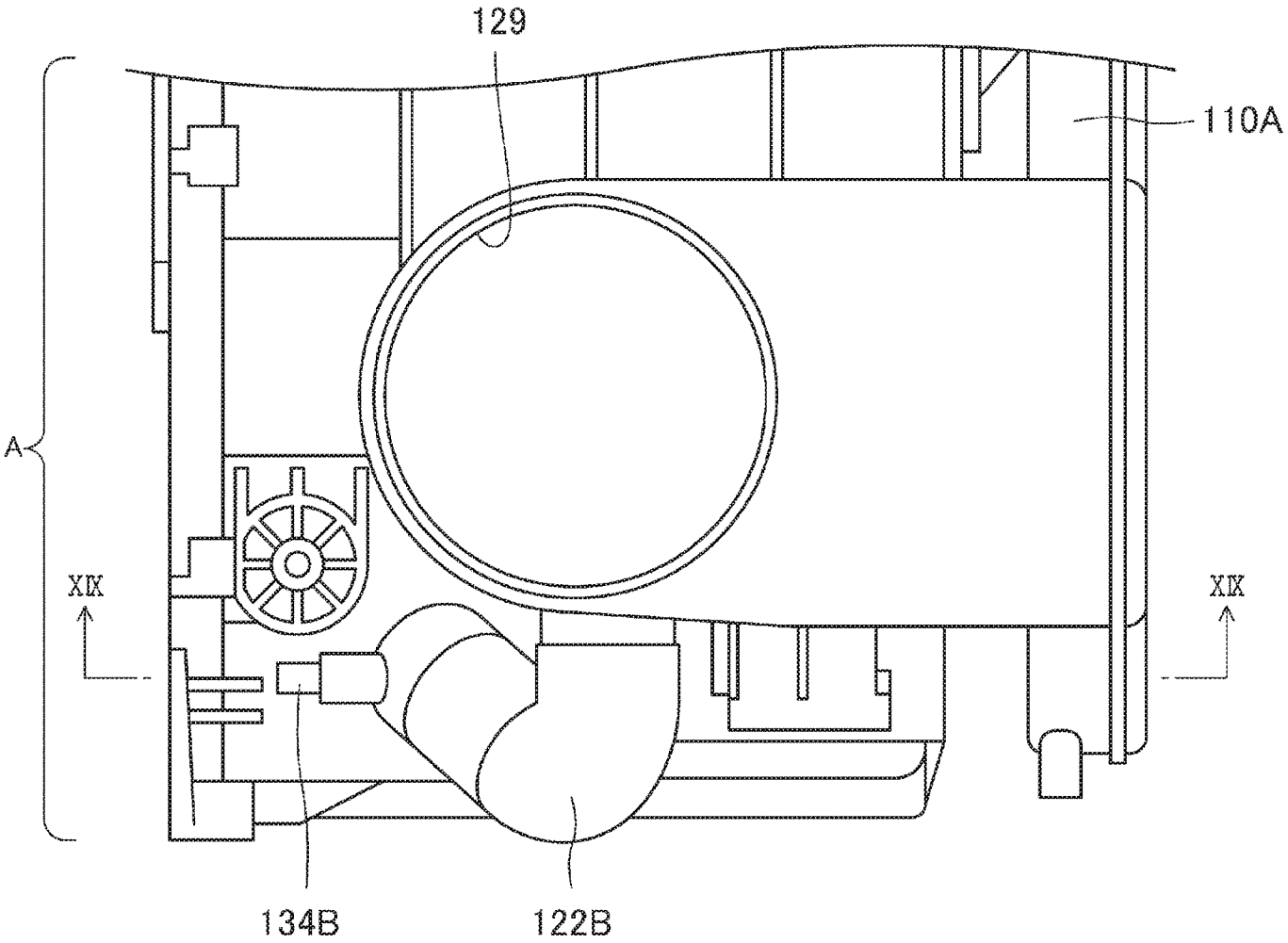
FIG. 18 is a partial plan view illustrating a region A in FIG. 16.
Figure 19:
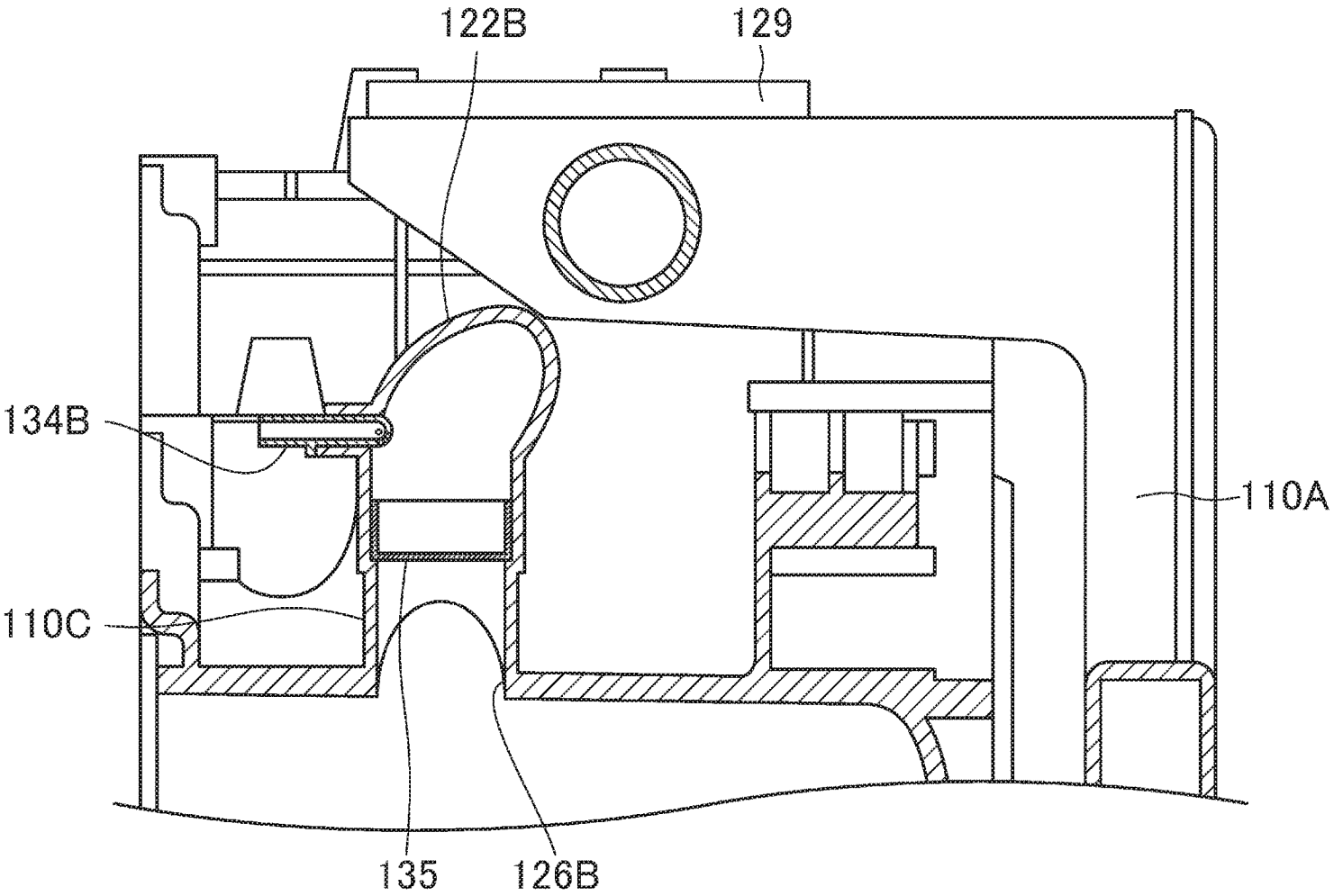
FIG. 19 is a cross-sectional view taken along line XIX-XIX in FIG. 18.

As another modified example of the third duct system 110C, as illustrated in FIG. 16 and FIG. 17, which is a cross-sectional view of FIG. 16, a mesh type lint filter 135 may be arranged in a communication hole 126B from the tub 102 of the third duct system 110C, and, for example, a cleaning nozzle 134B configured to clean the lint filter 135 may be installed at the vibration absorbing member 122B. An arrangement position of the cleaning nozzle 134B is not limited to the vibration absorbing member 122B, and the cleaning nozzle 134B may also be arranged in the duct system 110C or the fan connection 129. FIG. 18 illustrates a partial plan view illustrating a region A in FIG. 16, and FIG. 19 is a cross-sectional view taken along line XIX-XIX in FIG. 18

Second Embodiment

Hereinafter, a second embodiment of the present disclosure will be described with reference to the drawings. In the second embodiment, like reference numerals will be given to elements that overlap those of the above-described first embodiment, and description thereof will be omitted.

Figure 20:
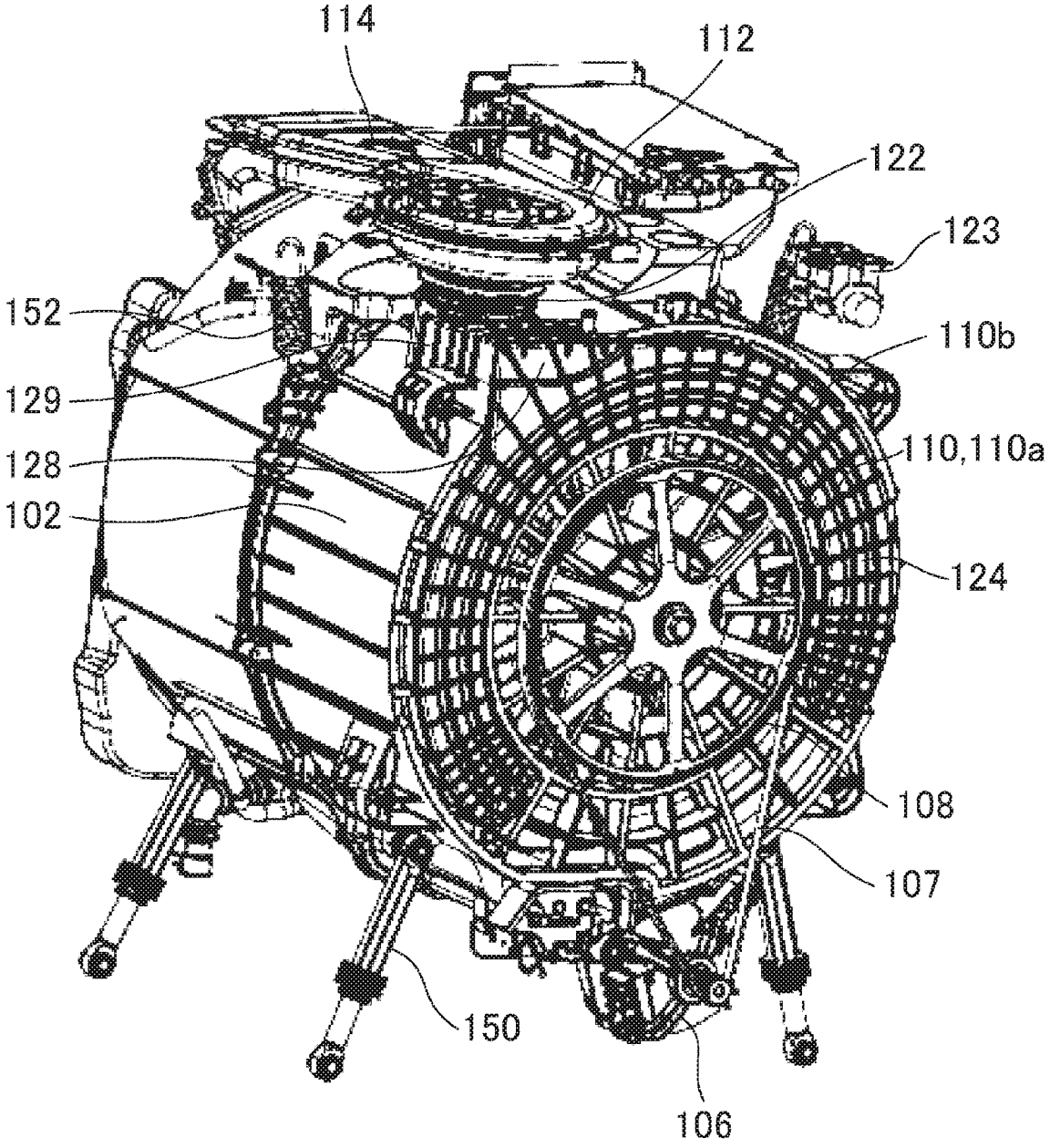

FIG. 20 is a perspective view from the rear side of a washing and drying machine according to the second embodiment in a state excluding a housing and the like.

Even in the second embodiment, a duct system constituting the circulation duct 110 may be branched into a plurality of duct systems, and the plurality of duct systems are configured to converge at an upstream side of a connection with the fan casing 112, for example, at a portion right before the connection with the fan casing 112. Also, the dehumidifiers 110*b* installed in the plurality of duct systems may be installed in all of the duct systems but are not necessarily installed in all of the duct systems as long as the dehumidifier 110*b* is installed in at least one duct system.

FIG. 20 is an example illustrating the circulation duct 110 with two duct systems, i.e., the branch ducts 110A, but embodiments are not limited to having two duct systems, and a third duct system may also be installed. The third duct system may be installed to, for example, converge from the side surface of the tub 102 to the fan connection (fan casing connection) 129. A configuration in which the third duct system is installed will be described below as a modified example of a duct system.

In the present embodiment, the fan casing 112 and the heater case 114 are installed in the housing 120 and are connected to the circulation duct 110 by the vibration absorbing member 122 interposed therebetween. Although not illustrated, the fan casing 112 and the heater case 114 may also be installed in the tub 102. In this case, the vibration absorbing member 122 is not required because the circulation duct 110 and the fan casing 112 are directly connected to each other.

Figure 21:
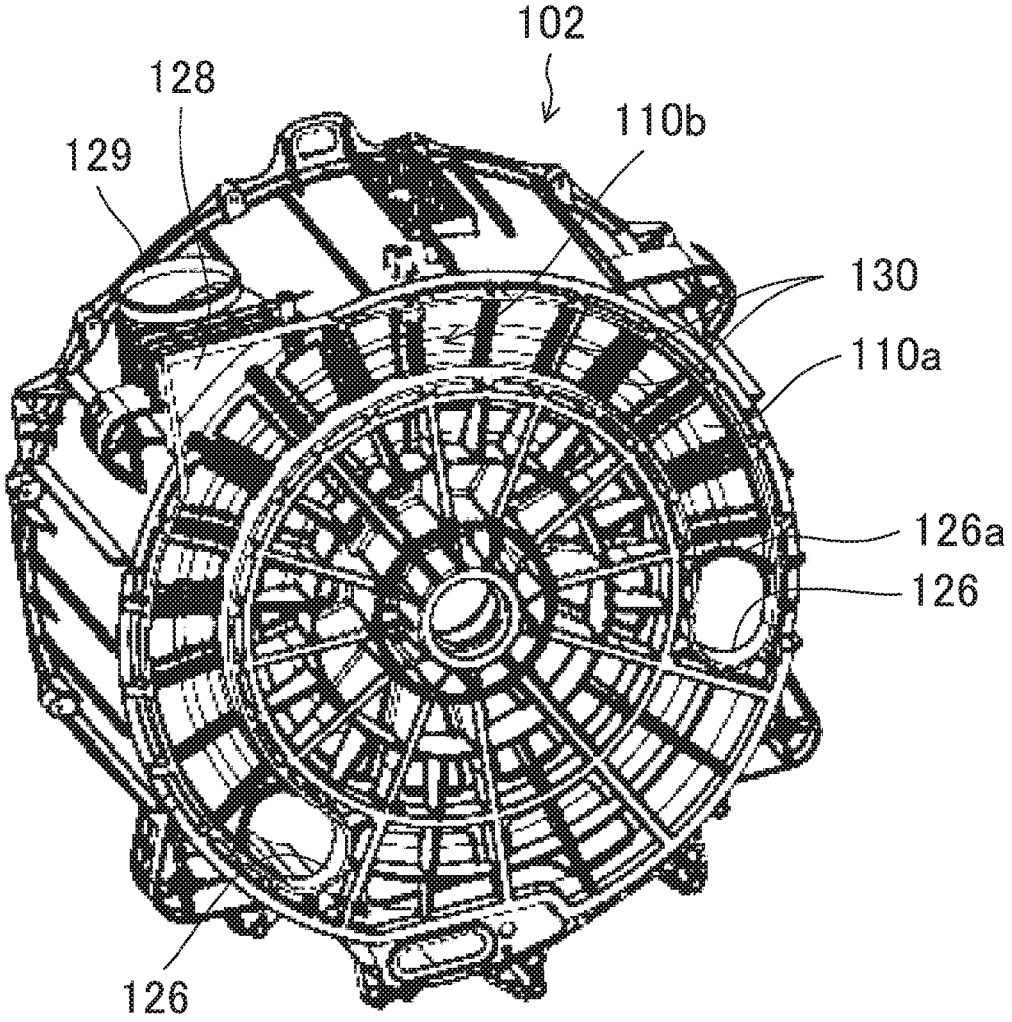
FIG. 21 is a tub constituting the washing and drying machine according to the second embodiment and is a perspective view from the rear side from which a duct cover is omitted.
Figure 36:
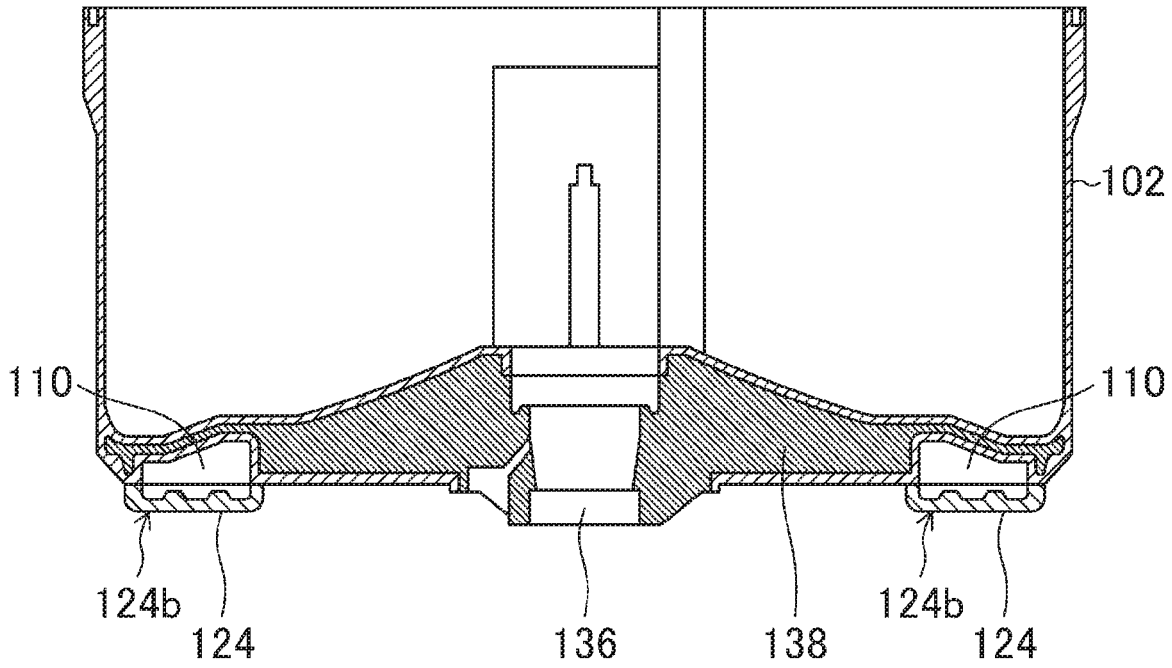
FIG. 36 is a cross-sectional view taken along line XXXVI-XXXVI in FIG. 24.
Figure 37:
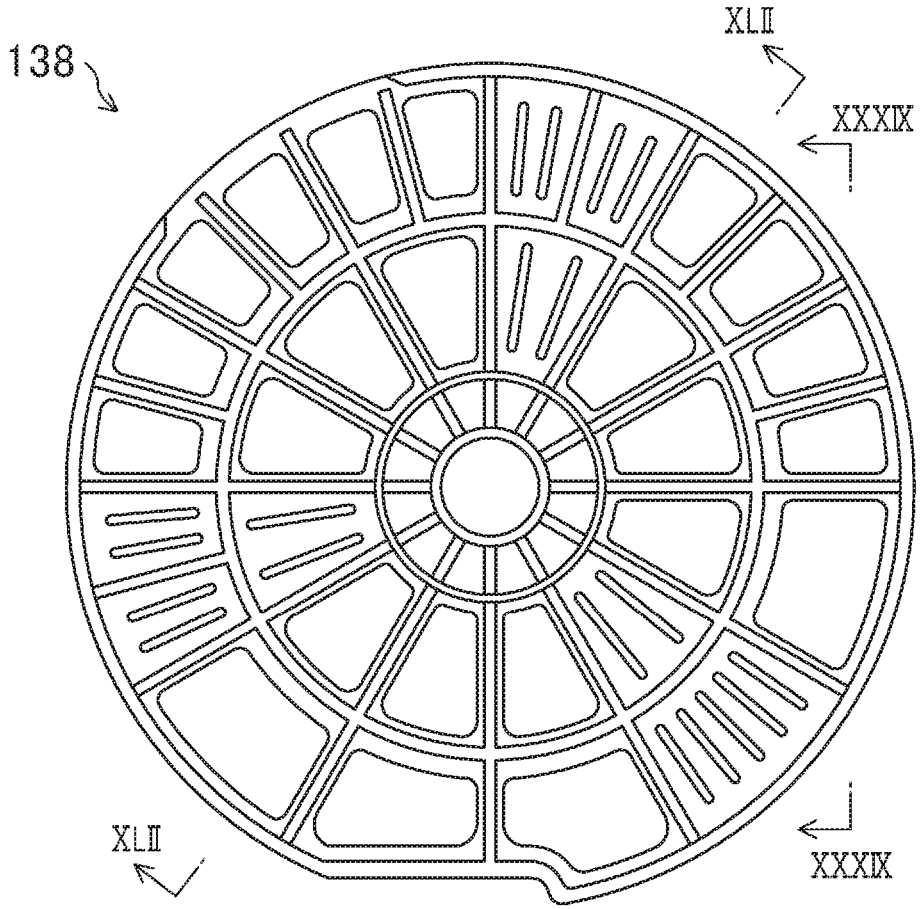
FIG. 37 is a rear view illustrating an aluminum die-cast portion, which is a drum bearing holder, insert-molded at a rear surface of the tub constituting the washing and drying machine according to the second embodiment.
Figure 38:
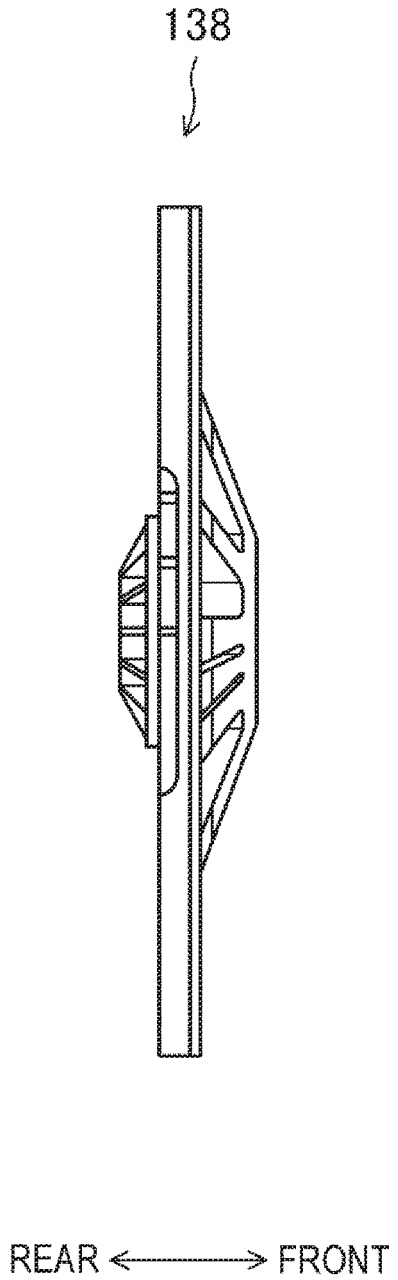
FIG. 38 is a right side view of FIG. 37.

In an example illustrated in FIG. 21, three surfaces (a bottom surface and both side surfaces) constituting the duct and the fan connection 129 are integrally formed by a member constituting the tub 102, and a duct cover 124 (the remaining ceiling surface of the duct) is integrally formed with the tub 102 by, for example, welding (see FIG. 36). Therefore, in the present embodiment, the bottom surface and the both side surfaces constituting the branch ducts 110A correspond to the body 124A described in the first embodiment. Also, in FIG. 21, the tub 102 is formed by being divided into substantially two one-half members in a depth direction thereof. Here, for convenience, a front side member is omitted, and only a rear side member is illustrated. The duct cover 124 may also be coupled to the tub 102 by interposing a seal material therebetween and fixing the seal material by a screw.

Figure 22:
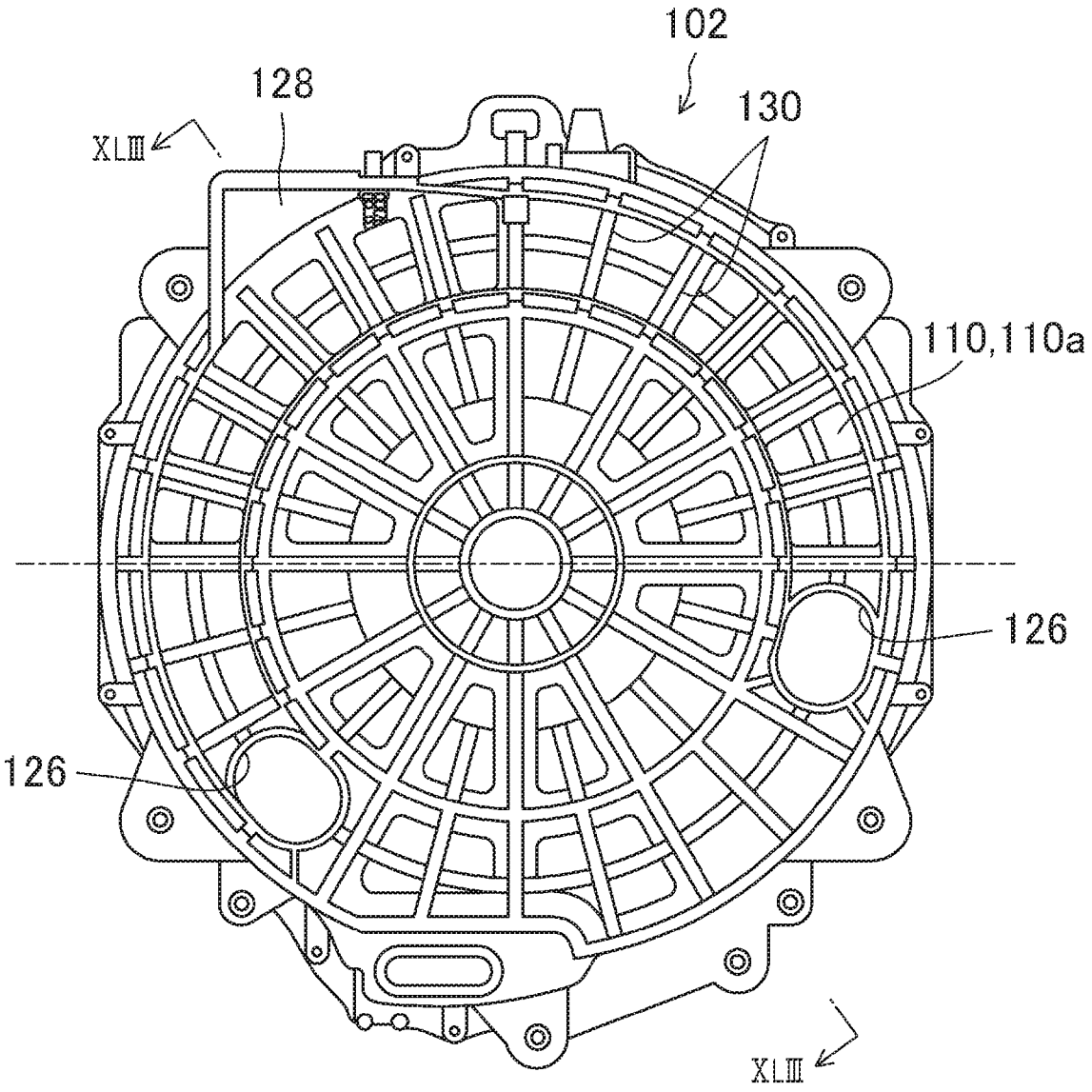
FIG. 22 is the tub constituting the washing and drying machine according to the second embodiment and is a rear view from which the duct cover is omitted.

As illustrated in FIG. 22, the communication holes 126 communicating with the circulation duct 110 (the branch ducts 110A) may be installed at two positions. Both of the two communication holes 126 may be arranged below the horizontal surface of the rotary shaft in the drum 104. In other words, the two communication holes 126 may be arranged to be located more upstream than the rotary shaft of the drum 104 in the direction in which air introduced into the circulation duct 110 flows.

Figure 23:
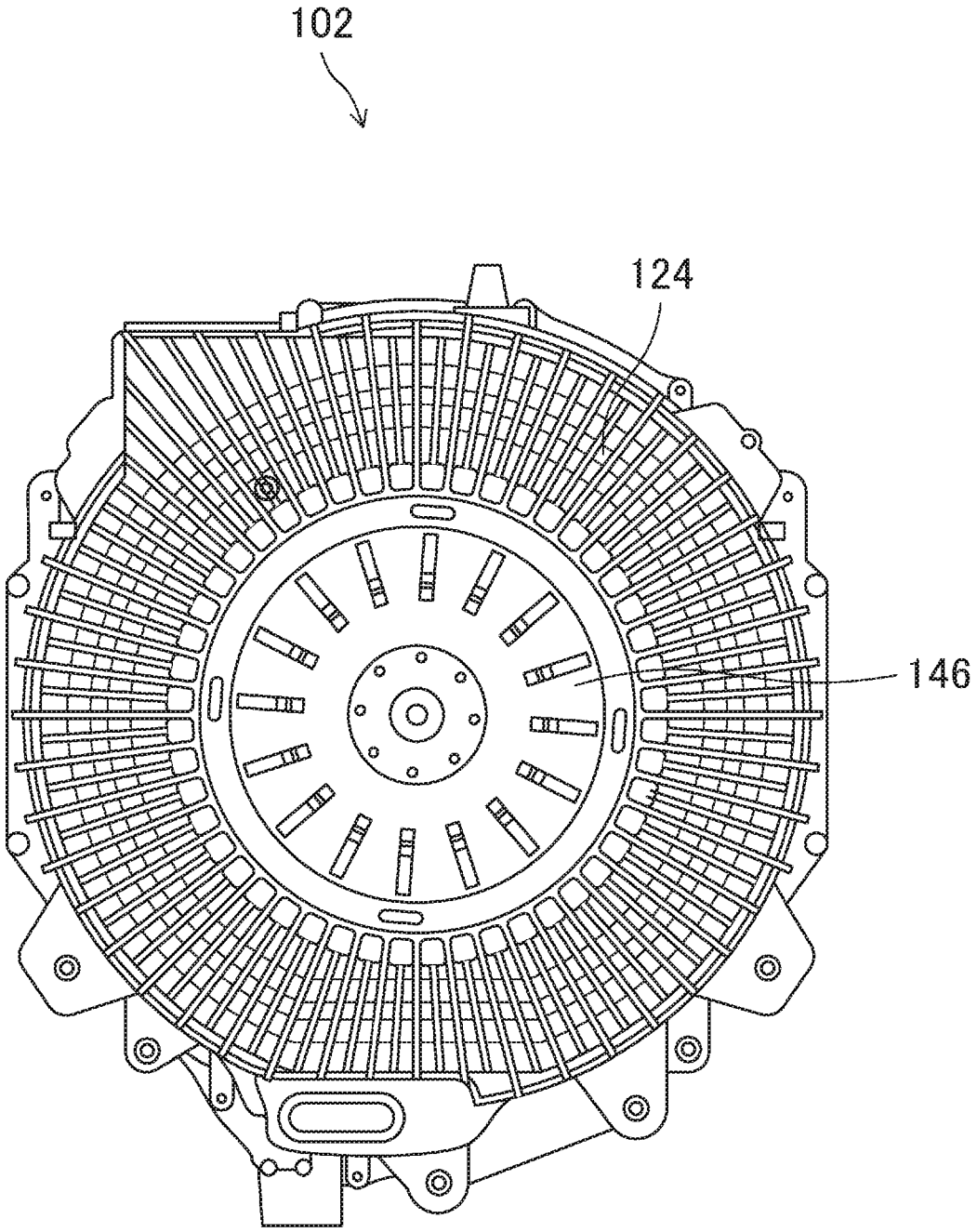
FIG. 23 is the tub constituting the washing and drying machine according to the second embodiment and is a rear view illustrating a branch duct 110A according to a modified example.

Although the same configuration will be described with reference to FIGS. 57 and 58 which will be described below, as a modified example of the branch ducts 110A, the two communication holes 126 communicating with the tub 102 may be integrated into a single communication hole. In this case, the branch ducts 110A may be connected to the converging portion 128 to rotate from both sides and enter the converging portion 128. In this modified example, the drum 104 may be, for example, directly driven by the DD motor 146, which is illustrated in FIG. 23, instead of being driven by a belt. Even in this case, the single integrated communication hole 126 is equally distant from the converging portion 128 at a portion below the horizontal surface of the rotary shaft of the drum 104, and the single integrated communication holes 126 is arranged to be located at a lowermost end. In other words, the single integrated communication hole 126 may be arranged to be located most upstream in the direction in which air introduced into the circulation duct 110 flows. Also, although the same configuration will be described with reference to FIGS. 59 and 60 which will be described below, as another modified example of the branch ducts 110A, the partition 147 may be installed to divide the single integrated communication hole 126 at a substantially central portion. In this way, circulating air may smoothly flow to each of the duct systems. Furthermore, an improvement in strengths of the branch ducts 110A may be promoted.

At the rear surface of the tub 102, which is a portion at which the circulation duct 110 is formed, radial ribs 130 with a height in the range of, for example, 0.5 mm to 10 mm or 1 mm to 5 mm that does not significantly impede a circulating air flow rate may be formed at positions corresponding to those of the radial ribs 130 formed in the tub 102.

In the opening of the circulation duct 110 communicating with an inside of the tub 102, ribs having a gentle shape (opening ribs 126*a* (see FIG. 24)) may be installed at an opening end in a circulating direction of the duct not surrounded by a peripheral wall (toward the converging portion 128), and the opening ribs 126*a* having a gentle shape serves to reinforce a strength of the opening and facilitate airflow.

Figure 24:
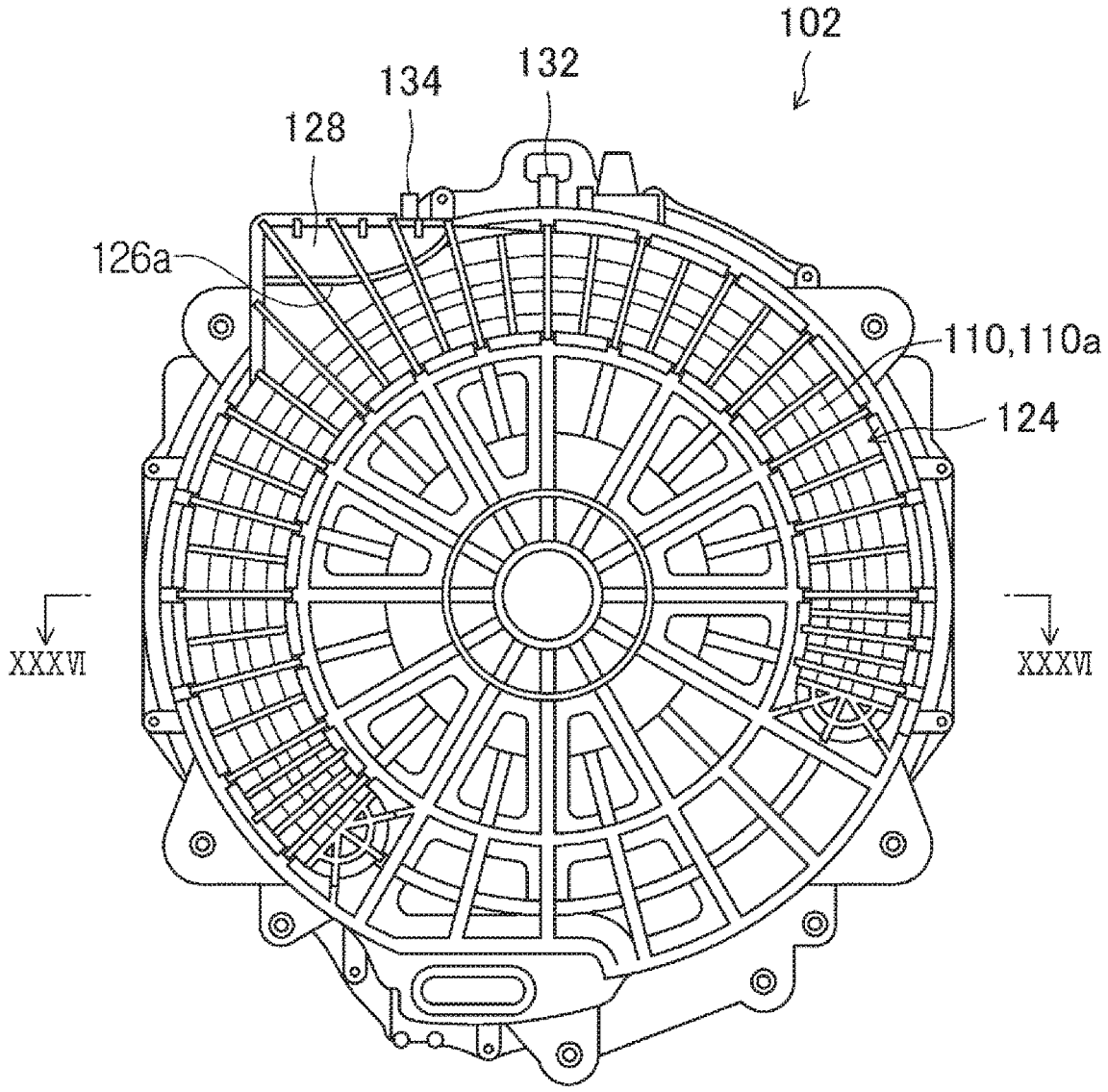
FIG. 24 is a rear view illustrating a state in which the duct cover of the tub constituting the washing and drying machine according to the second embodiment is attached.
Figure 25:
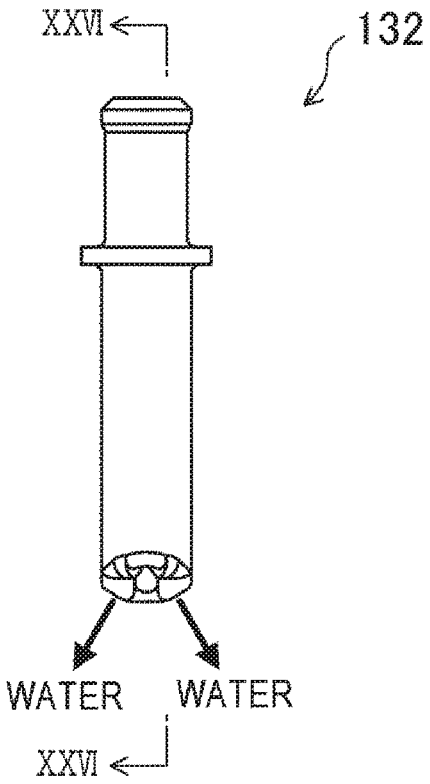
FIG. 25 is a front view illustrating a dehumidifying liquid supply nozzle constituting a dehumidifier of the washing and drying machine according to the second embodiment.
Figure 26:
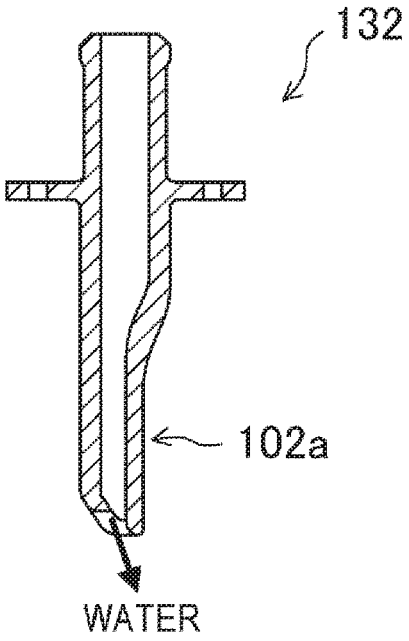
FIG. 26 is a cross-sectional view taken along line XXVI-XXVI in FIG. 25.
Figure 27:
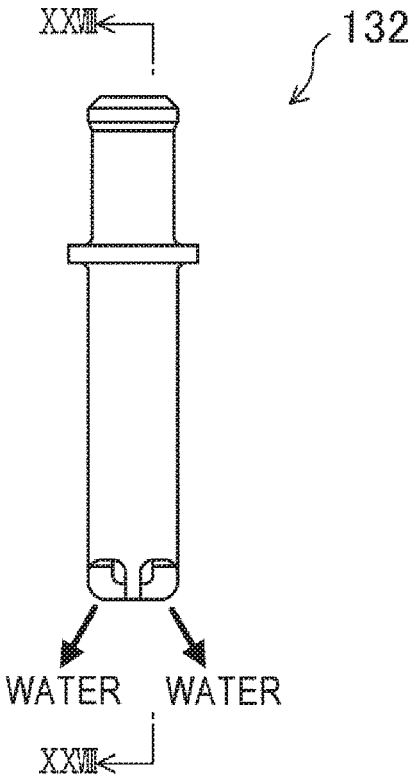
FIG. 27 is a front view illustrating a dehumidifying liquid supply nozzle according to another example constituting the dehumidifier of the washing and drying machine according to the second embodiment.
Figure 28:
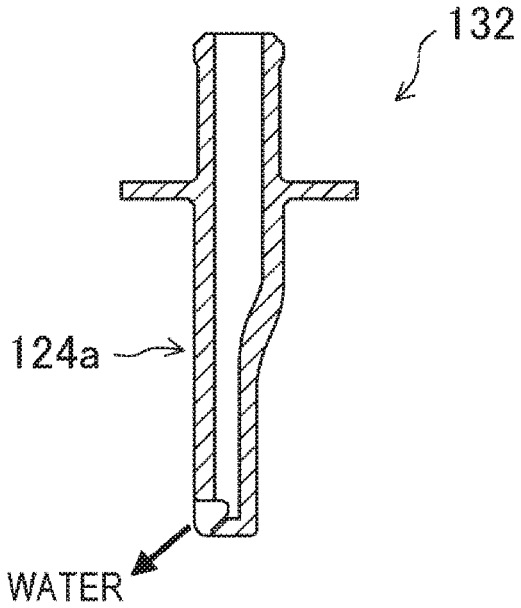
FIG. 28 is a cross-sectional view taken along line XXVIII-XXVIII in FIG. 27.

As illustrated in FIG. 24, the dehumidifying liquid supply nozzle 132 configured to supply dehumidifying coolant to insides of the branch duct 110A via the water supply valve 123 illustrated in FIG. 20 is arranged at an upper portion of the circulation duct 110. Here, the dehumidifying liquid supply nozzle 132 may supply a dehumidifying liquid to each of the branched branch ducts 110A. Also, as long as desired drying efficiency (heat exchange efficiency) can be obtained, the dehumidifying liquid supply nozzle 132 may be able to supply a dehumidifying liquid to only one of the branch ducts 110A. The dehumidifying liquid supply nozzle 132 may be formed with a part separate from the tub 102. The dehumidifying liquid supply nozzle 132 may also be integrally formed with the tub 102. Also, a direction in which the dehumidifying liquid supply nozzle 132 supplies a dehumidifying liquid to each of the branch ducts 110A may be toward a rear surface 102*a* (inward) of the tub as illustrated in FIGS. 25 and 26 or may be toward the duct cover 124*a* (outward) as illustrated in FIGS. 27 and 28. The case in which the dehumidifying liquid supply nozzle 132 is formed with a separate part is illustrated in FIGS. 25 to 28.

Figure 29:
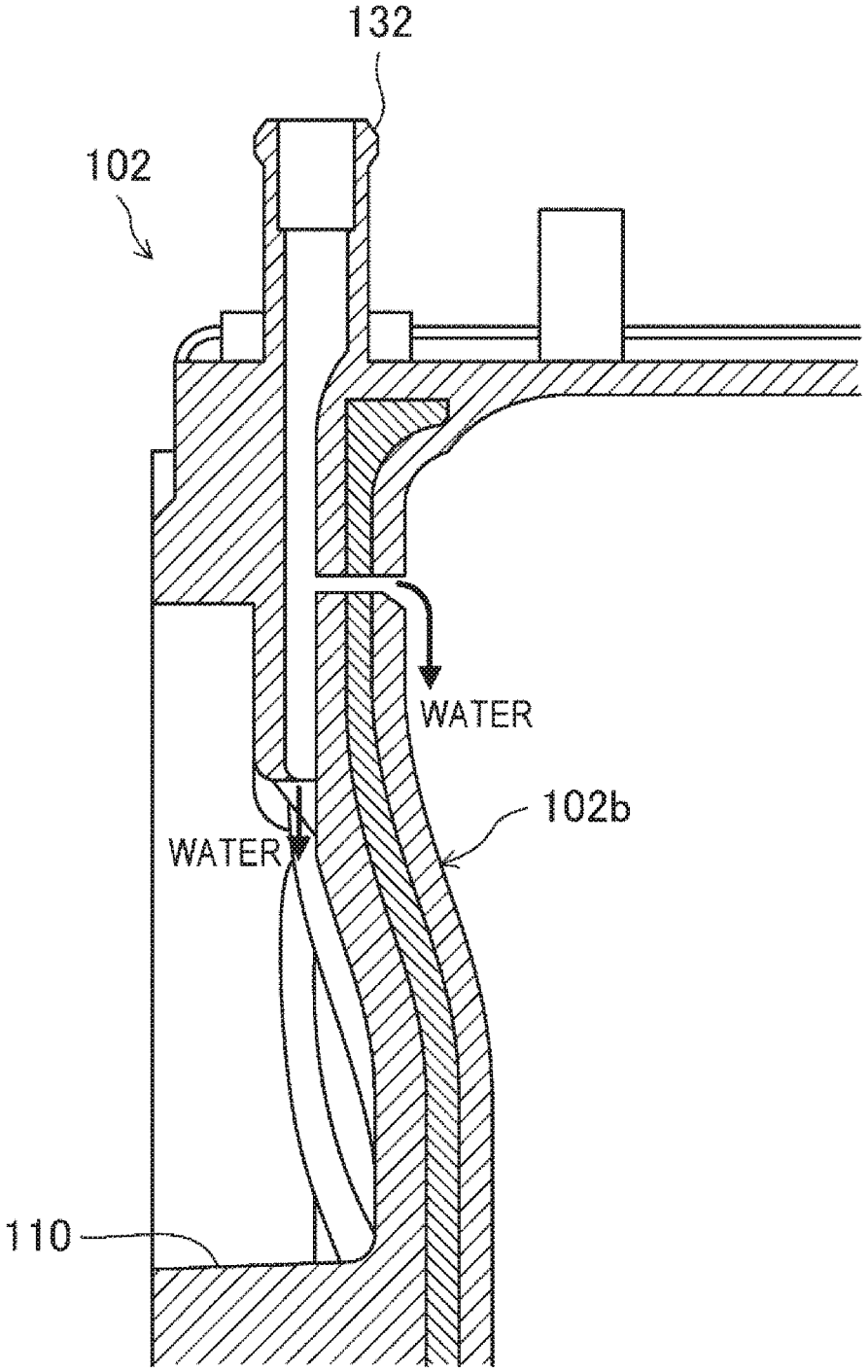
FIG. 29 is a cross-sectional view illustrating a dehumidifying liquid supply nozzle according to still another example constituting the dehumidifier of the washing and drying machine according to the second embodiment.

As illustrated in FIG. 29, the dehumidifying liquid supply nozzle 132 may also be installed so that some of the dehumidifying liquid is supplied also to an inner surface 102*b* of the tub 102.

Figure 30:
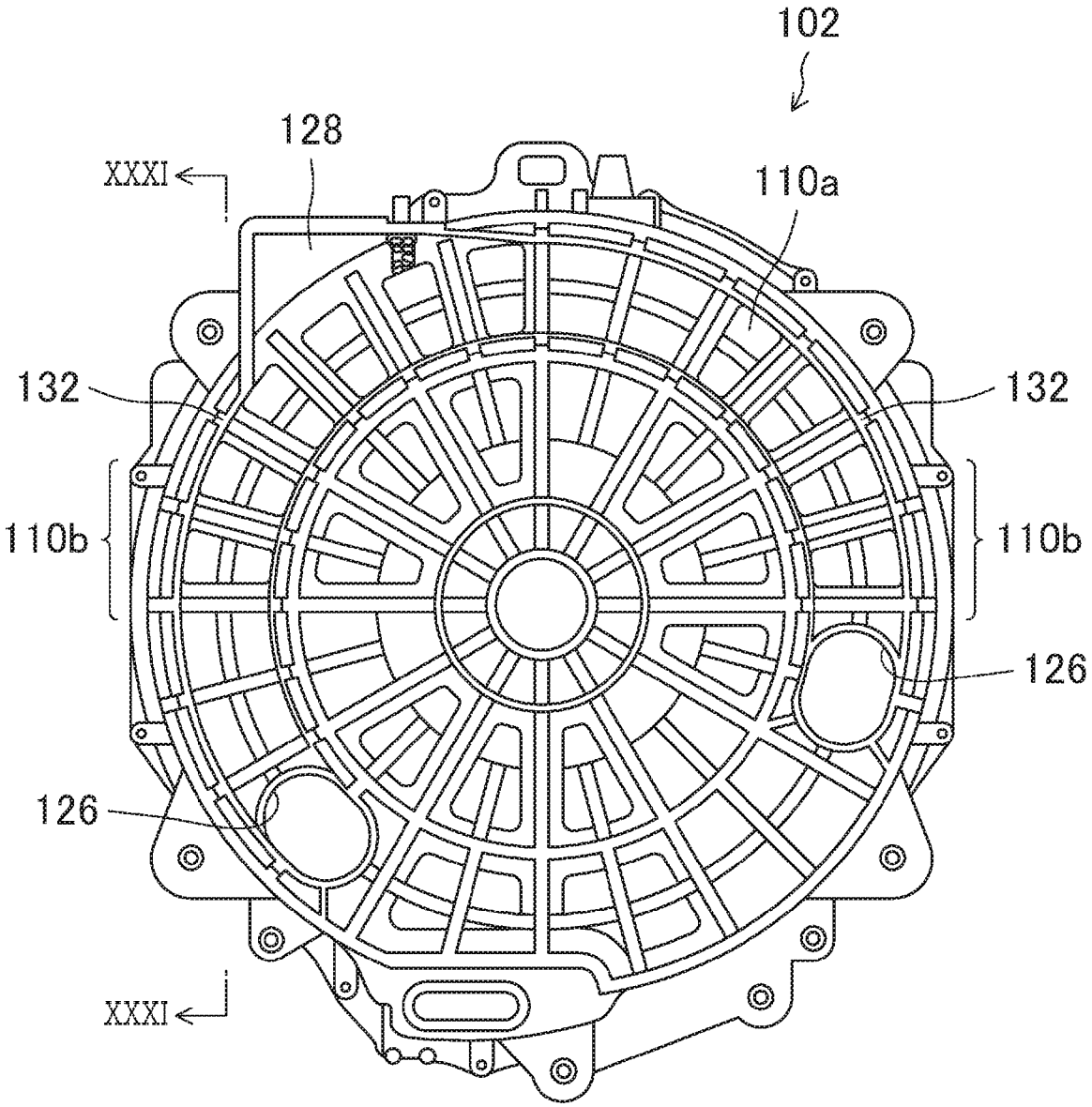
FIG. 30 is the tub constituting the washing and drying machine according to the second embodiment and is a rear view of a configuration in which a dehumidifier is installed in every branch duct and from which the duct cover is omitted.
Figure 31:
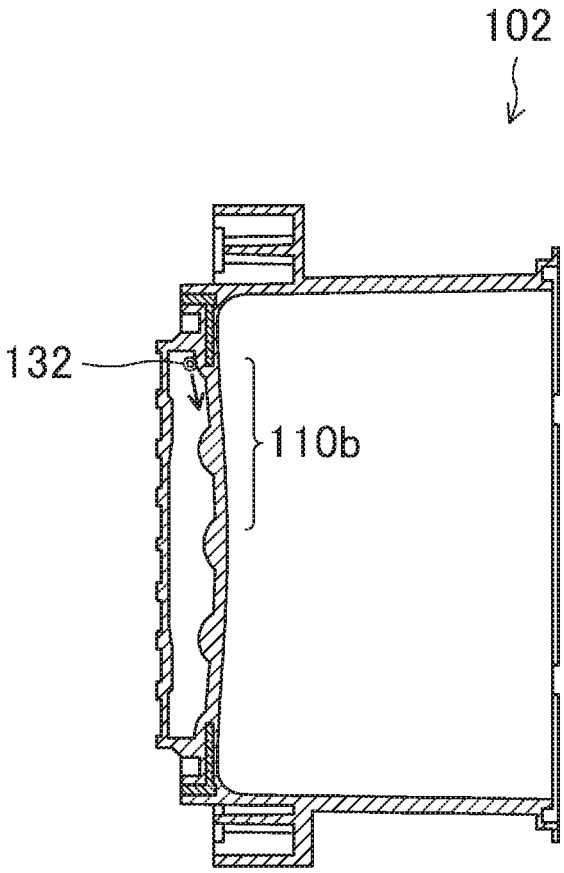
FIG. 31 is a cross-sectional view taken along line XXXI-XXXI in FIG. 30.

As a modified example of an arrangement of the dehumidifying liquid supply nozzle 132, as illustrated in FIGS. 30 and 31, the dehumidifying liquid supply nozzle 132 may be arranged in each of the branch ducts 110A, and independent dehumidifiers 110*b* may be respectively installed therein. In this case, an example of a pipe configuration for supplying a dehumidifying liquid and duct cleaning water from the water supply valve 123 will be described with reference to FIGS. 79 and 80.

Figure 79:
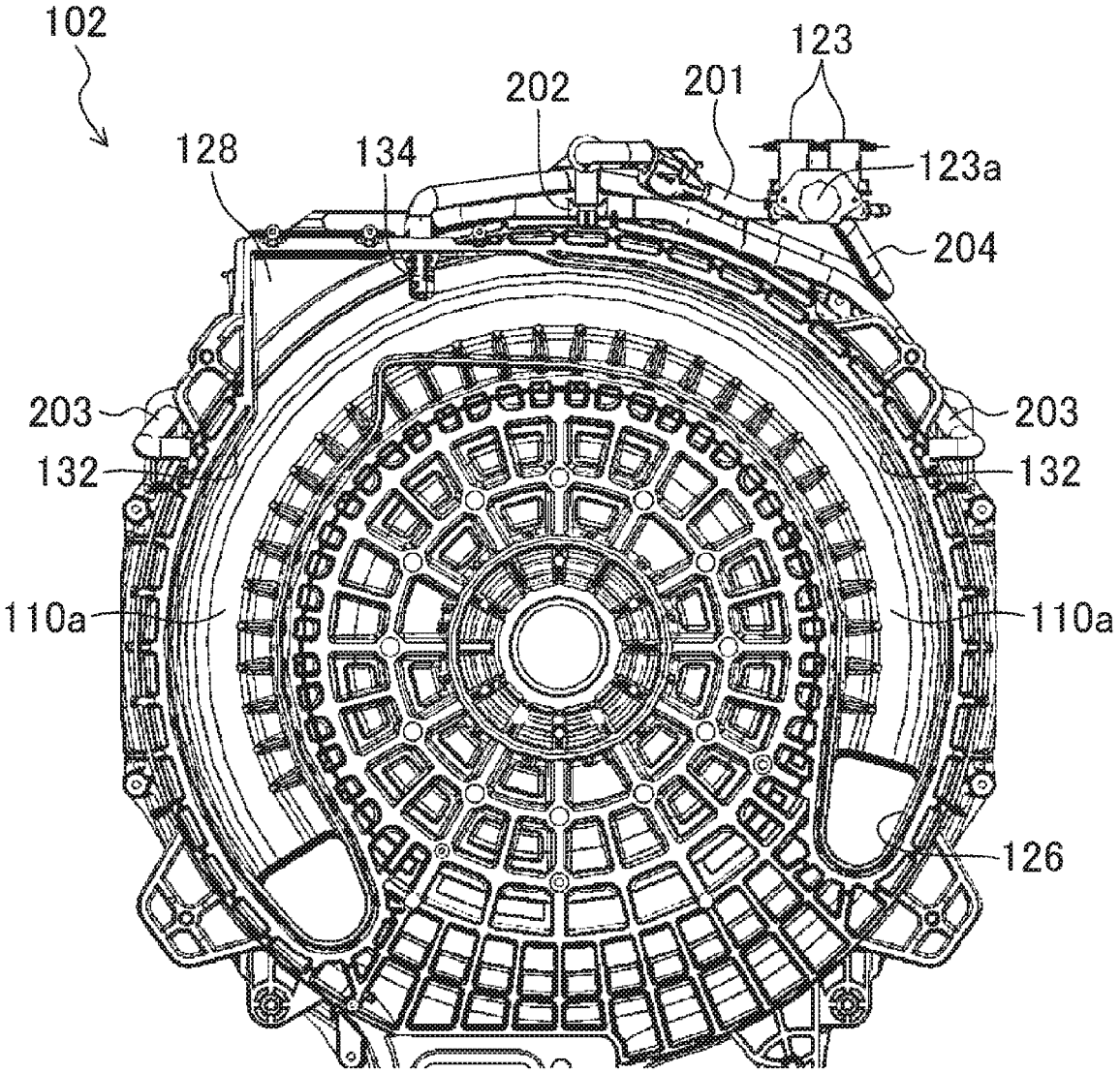
FIG. 79 is the tub constituting the washing and drying machine according to the second embodiment and is a rear view illustrating a configuration in which a water supply pipe is arranged in the configuration (cover is omitted) in which a dehumidifier is installed in each branch duct.
Figure 80:
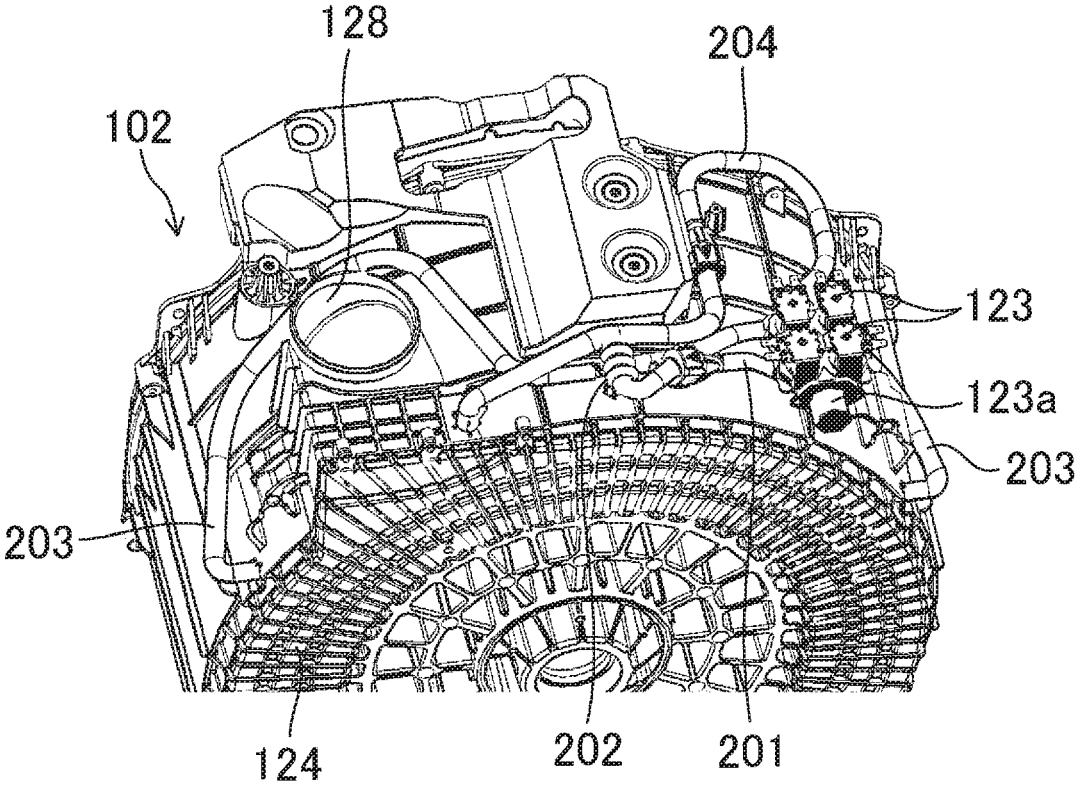
FIG. 80 is a partial perspective view of FIG. 79.

As illustrated in FIGS. 79 and 80, a connection port 123*a* that is, for example, connected to a water pipe, may be installed at an inlet side of the water supply valve 123 having a plurality of valves. A dehumidifying liquid pipe 201 is connected to one valve of the water supply valve 123. An outlet side of the dehumidifying liquid pipe 201 is connected to a nozzle water supply pipes 203 respectively connected to the dehumidifying liquid supply nozzles 132 via a branch portion 202 having a T-shape or a Y-shape.

A duct cleaning pipe 204 is connected to the other valve of the water supply valve 123. An outlet side of the duct cleaning pipe 204 is connected to the duct cleaning nozzle 134 (see FIG. 32). The configurations of the water supply pipes may also be applied to the washing and drying machine 100 according to the first embodiment.

Instead of the configurations in FIGS. 79 and 80, one dehumidifying liquid supply nozzle 132 may be directly connected to the dehumidifying liquid pipe 201 connected to the water supply valve 123, and the other dehumidifying liquid supply nozzle 132 may be branched from the inside of the one dehumidifying liquid supply nozzle 132.

Even in the second embodiment, a dehumidifying liquid may not be supplied to the inside of the circulation duct 110, that is, the dehumidifying liquid supply nozzle 132 may not be installed. In other words, a dehumidifying liquid may not be used in drying clothes after doing laundry, and dehumidification may be performed by air-cooling actions of duct systems.

Figure 32:
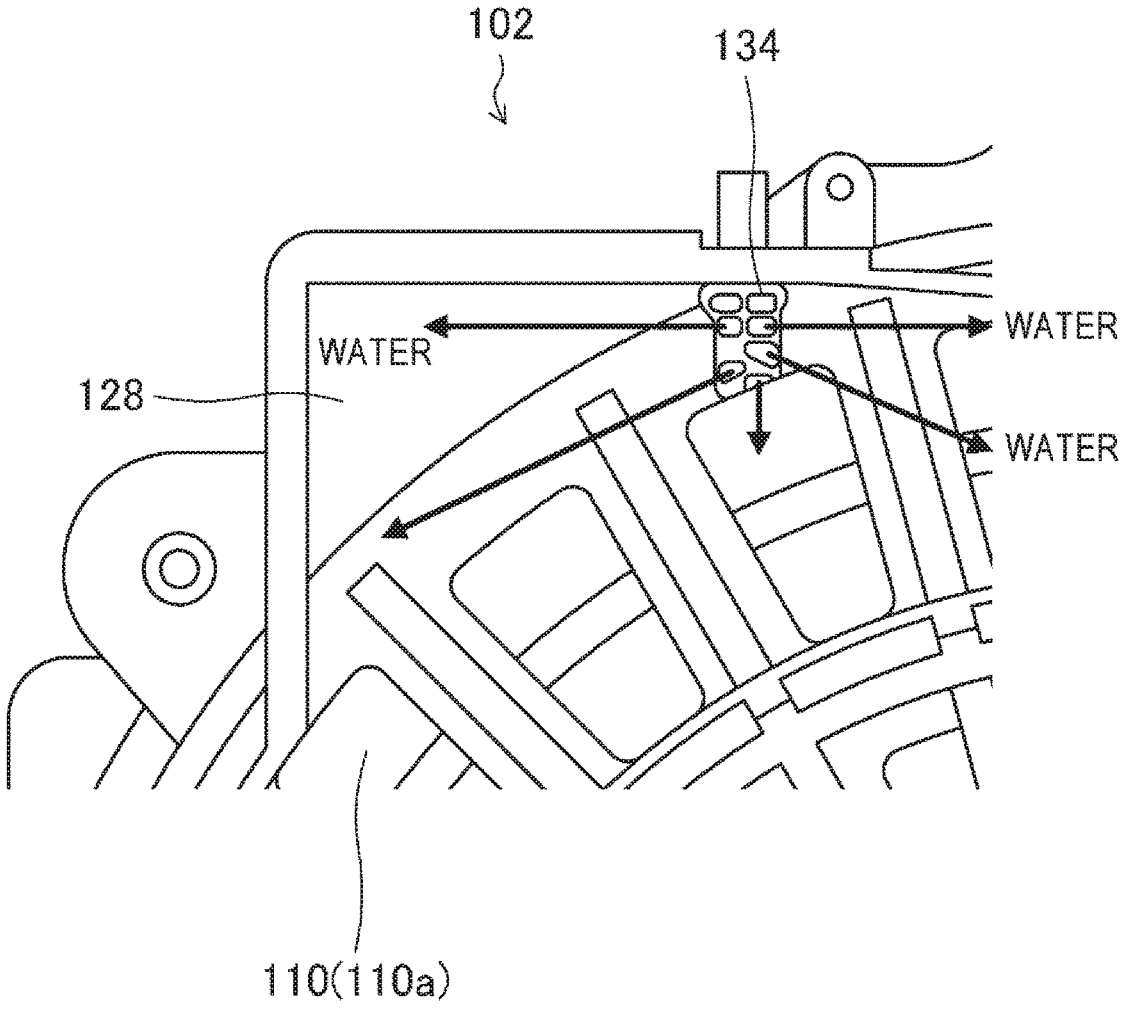
FIG. 32 is the tub constituting the washing and drying machine according to the second embodiment and is an enlarged partial rear view illustrating a portion including a duct cleaning nozzle.

In the present embodiment, as illustrated in FIG. 32, the duct cleaning nozzle 134 configured to supply cleaning water for cleaning the inside of the circulation duct 110 may be arranged in the vicinity of the center of the converging portion 128 of the circulation duct 110. Here, both of the branch ducts 110A constituting the circulation duct 110 and a portion around the connection with the fan casing 112 may be simultaneously cleaned. The plurality of holes installed at the side surface of the duct cleaning nozzle 134 may be arranged so that cleaning water may be released in a shower shape in various cleaning directions. Also, the duct cleaning nozzle 134 may be formed with a part separate from the tub 102 as in the case illustrated in FIG. 28 or may be integrally formed with the tub 102.

Figure 33:
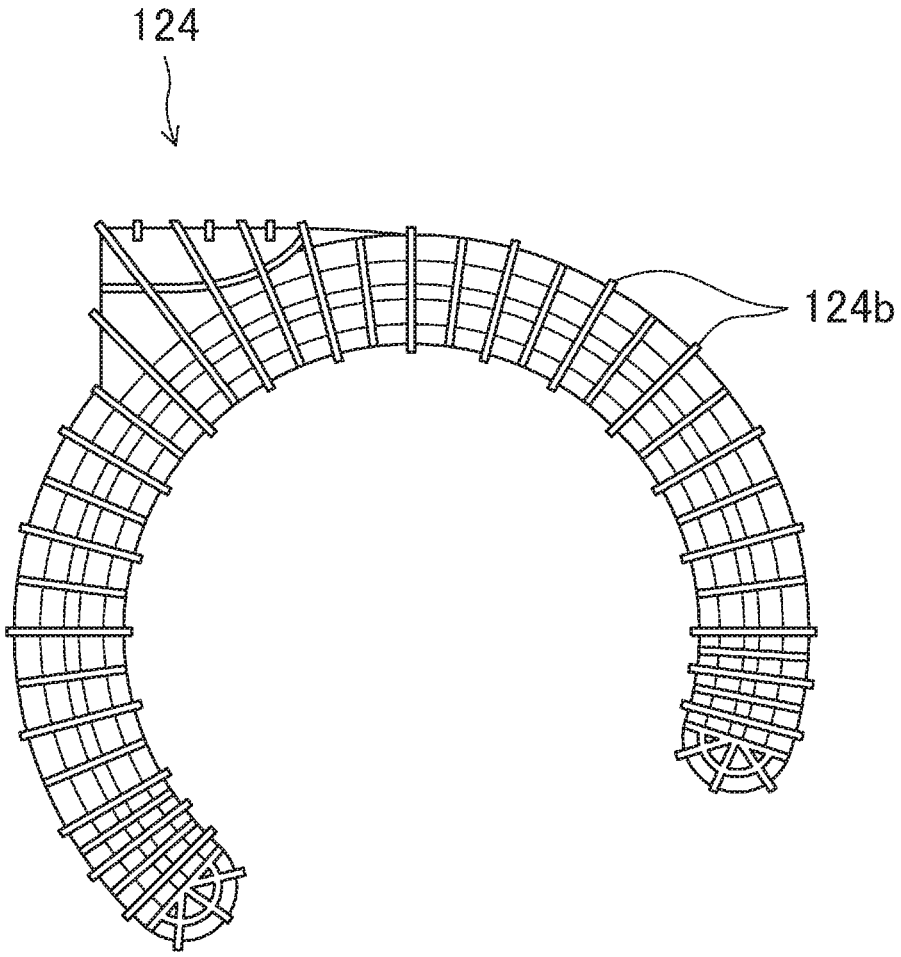
FIG. 33 is a front view illustrating the duct cover installed in the tub constituting the washing and drying machine according to the second embodiment.
Figure 34:
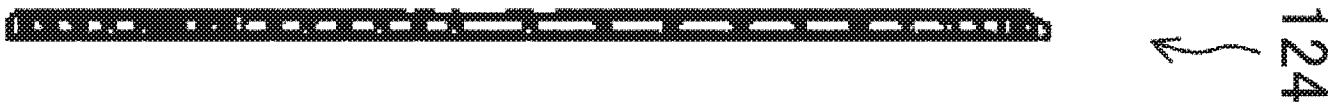
FIG. 34 is a side view of FIG. 33.
Figure 35:
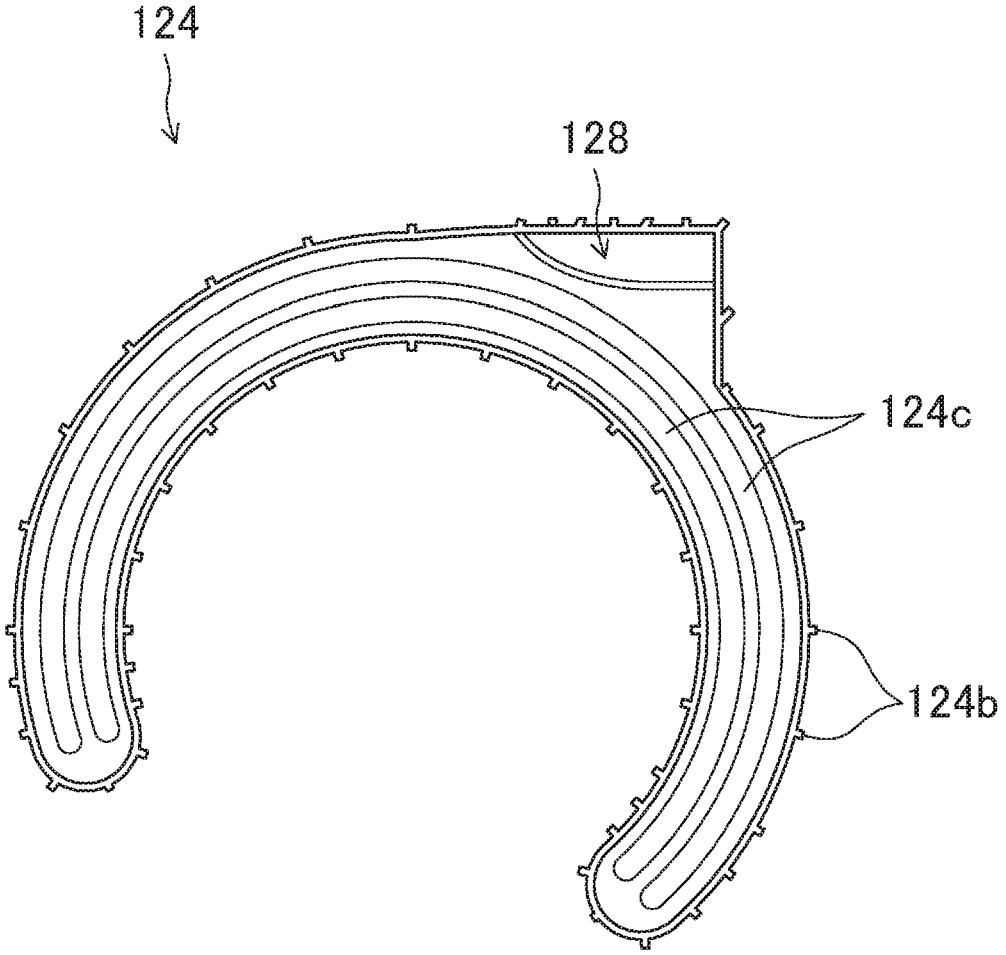
FIG. 35 is a rear view of FIG. 33.

FIGS. 33, 34, and 35 respectively illustrate a front configuration, a side configuration, and a rear configuration of the duct cover 124 constituting the circulation duct 110 according to the present embodiment. As illustrated in FIG. 33, a plurality of reinforcing ribs 124*b* are radially formed from a central position substantially corresponding to the rotary shaft of the drum 104 at an outside of the duct cover 124. Here, the reinforcing ribs 124*b* may be arranged to respectively correspond to the radial ribs 130 formed at the rear surface of the tub 102. Therefore, when the duct cover 124 is installed at the rear surface of the tub 102, the reinforcing ribs 124*b* and the radial ribs 130 may be welded to be integrated with each other.

As illustrated in FIG. 35, a plurality of beads (grooves) 124*c* may be formed in an arc shape inside the duct cover 124. By the plurality of beads 124*c* installed inside the duct cover 124, the strength of the duct cover 124 is improved together with strengths of the radial reinforcing ribs 124*b*. Because the radial ribs 130 do not protrude from an inner surface of the duct cover 124 and each of the beads 124*c* serves as a guide, airflow inside the circulation duct 110 may be smoothly guided to the converging portion 128.

As illustrated in FIG. 36, peaks of the reinforcing ribs 124*b* formed at the duct cover 124 of the circulation duct 110 are formed lower than an aluminum die-cast portion 138 (hereinafter, simply referred to as an aluminum die-cast) that also serves as a drum bearing holder configured to hold a bearing 136 of the rotary shaft of the drum 104 (see FIG. 1). That is, the peaks of the reinforcing ribs 124*b* do not protrude further than a lower end of the bearing 136. Here, the aluminum die-cast 138 may be formed by, for example, being insert-molded to the rear surface of the tub 102. Also, an outer peripheral portion of the aluminum die-cast 138 may be formed to extend up to the side portion of the tub 102.

In the circulation duct 110, an outer peripheral surface excluding the fan connection 129 and the converging portion 128 may be arranged more inward than the outer peripheral surface of the tub 102. Also, in the circulation duct 110, the inner peripheral surface at the rotary shaft side of the drum 104 may be arranged more outward than an outer peripheral surface of the pulley configured to drive rotation of the drum 104 or the DD motor configured to directly drive the drum 104.

Due to this configuration, as illustrated in FIGS. 21 and 22, the branch ducts 110*a* may be formed in an arc shape about the rotary shaft of the drum 104. Because the dehumidifier 110*b* is installed in each of the arc-shaped branch ducts 110*a*, a flow speed of drying air increases at outer peripheral portions of the branch ducts 110*a* and decreases at inner peripheral portions thereof. Therefore, it may be difficult for droplets of the dehumidifying liquid to scatter at the inner peripheral portion.

Figure 81:
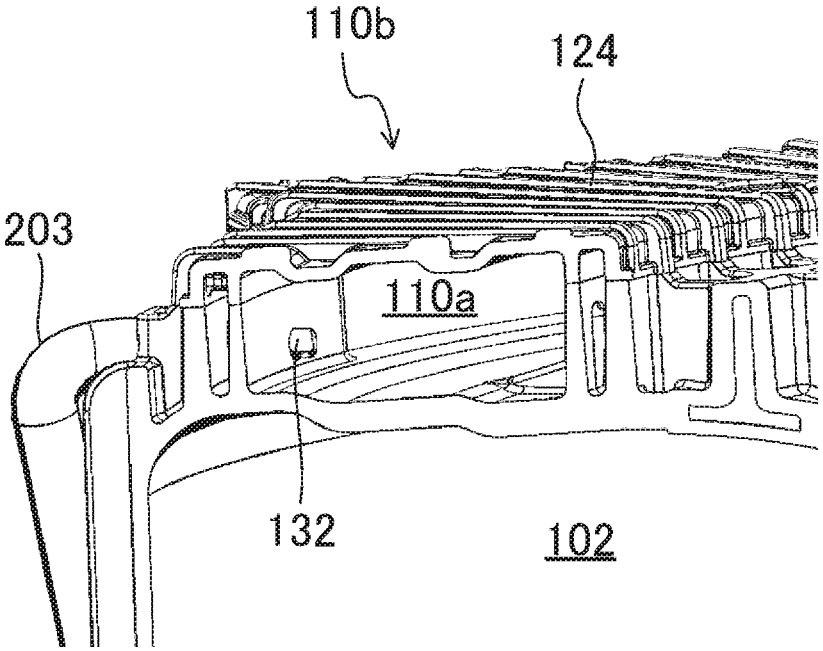
FIG. 81 is a partial cross-sectional view in a plane including a rotary shaft of the drum in the branch duct constituting the washing and drying machine according to the second embodiment.

Also, as illustrated in FIG. 36 and FIG. 81, which is an enlarged partial perspective view of FIG. 36, the circulation duct 110 includes the dehumidifier 110*b*, and the circulation duct 110 (the branch ducts 110*a*) has a height that is larger at an inner peripheral portion than at an outer peripheral portion when viewed from a cross-section of a flat surface including the rotary shaft of the drum 104. This is preferable also for improving a strength of the bearing 136 of the tub 102. Due to this configuration, a height of an inner peripheral portion is larger than a height of an outer peripheral portion in the branch duct 110*a* in which the dehumidifier 110*b* is installed. As a result, because a flow speed of drying air at the inner peripheral portion of the branch duct 110*a* becomes further slower compared to that at the outer peripheral portion, it may be more difficult for droplets of the dehumidifying liquid to scatter at the inner peripheral portions of the branch ducts 110*a*.

Figure 82:
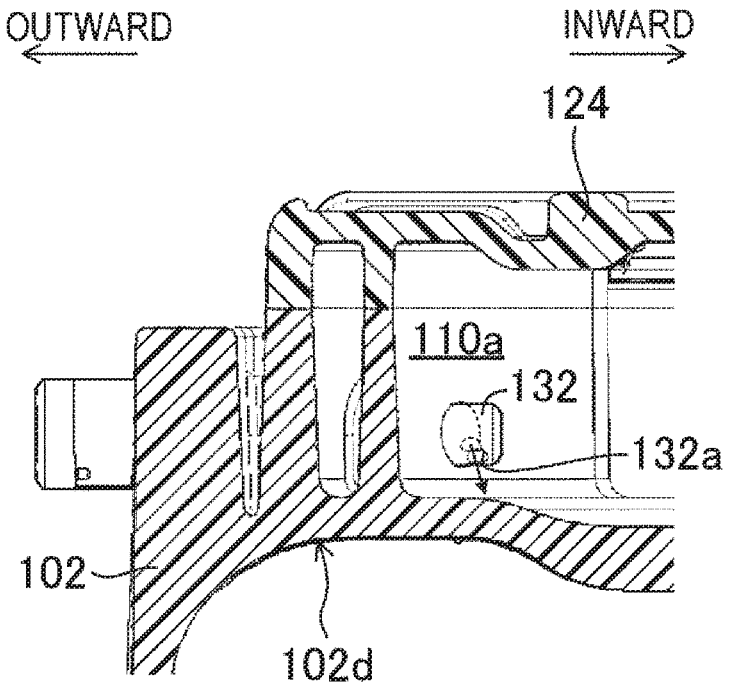
FIG. 82 is an enlarged cross-sectional view illustrating a portion in which a dehumidifying coolant nozzle is arranged in FIG. 81.

Therefore, for example, the dehumidifying liquid supply nozzle 132 illustrated in FIG. 8 may be installed so that a water supply port of the dehumidifying liquid supply nozzle 132 faces the bottom surface of the tub 102. Also, as illustrated in FIGS. 82 and 83, a water supply port 132*a* of the dehumidifying liquid supply nozzle 132 faces a bottom surface 102*d* of the tub 102 (FIGS. 82 and 83), is in a direction lower than the horizontal direction (FIG. 83), and is more preferably toward the inner peripheral portions of the branch ducts 110*a* (toward the central axis of the tub b102, FIG. 82). In this way, a dehumidifying liquid is toward the bottom surface 102*d* of the tub 102 and is surely supplied toward the inner peripheral portions of the branch ducts 110*a*. That is, a downward force and a force toward the inner peripheral portions of the branch ducts 110*a* are applied to the dehumidifying liquid. In the present embodiment, the dehumidifying liquid supply nozzle 132 is arranged at the outer peripheral portions of the branch ducts 110*a*. Due to this, because the flow speed of drying air increases at the outer peripheral portions of the branch ducts 110*a* and at the duct cover 124, when the water supply port of the dehumidifying liquid supply nozzle 132 is installed to face the bottom surface 102*d* of the tub 102, the dehumidifying liquid avoids air with a high flow speed at the outer peripheral portions of the branch ducts 110*a* and the duct cover 124 and is supplied from the bottom surface 102*d* of the tub 102 toward the inner peripheral portions of the branch ducts 110*a* at which the flow speed of air is low. FIG. 81 is an example of this configuration.

Also, for example, the dehumidifying liquid supply nozzle 132 illustrated in FIG. 9 may have the plate-shaped guide 132A configured to guide water from the water supply port, and the guide 132A may be installed so that an upper surface thereof is inclined toward the bottom surface of the tub 102. Even in this way, the dehumidifying liquid avoids air with a high flow speed at the outer peripheral portions of the branch ducts 110*a* and the duct cover 124 and is supplied from the bottom surface 102*d* of the tub 102 toward the inner peripheral portions of the branch ducts 110*a* at which the flow speed of air is low.

Figure 39:
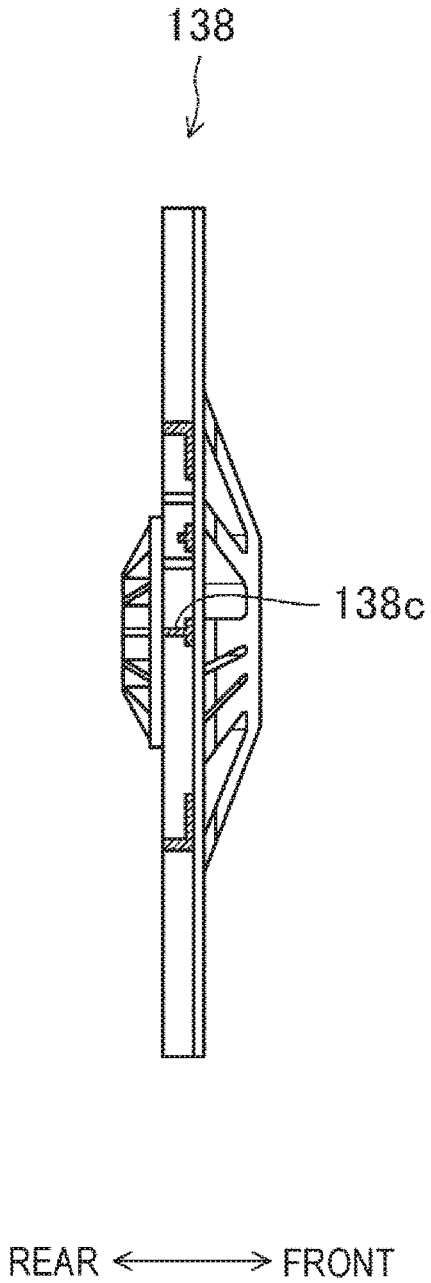
FIG. 39 is a cross-sectional view taken along line XXXIX-XXXIX in FIG. 37.
Figure 40:
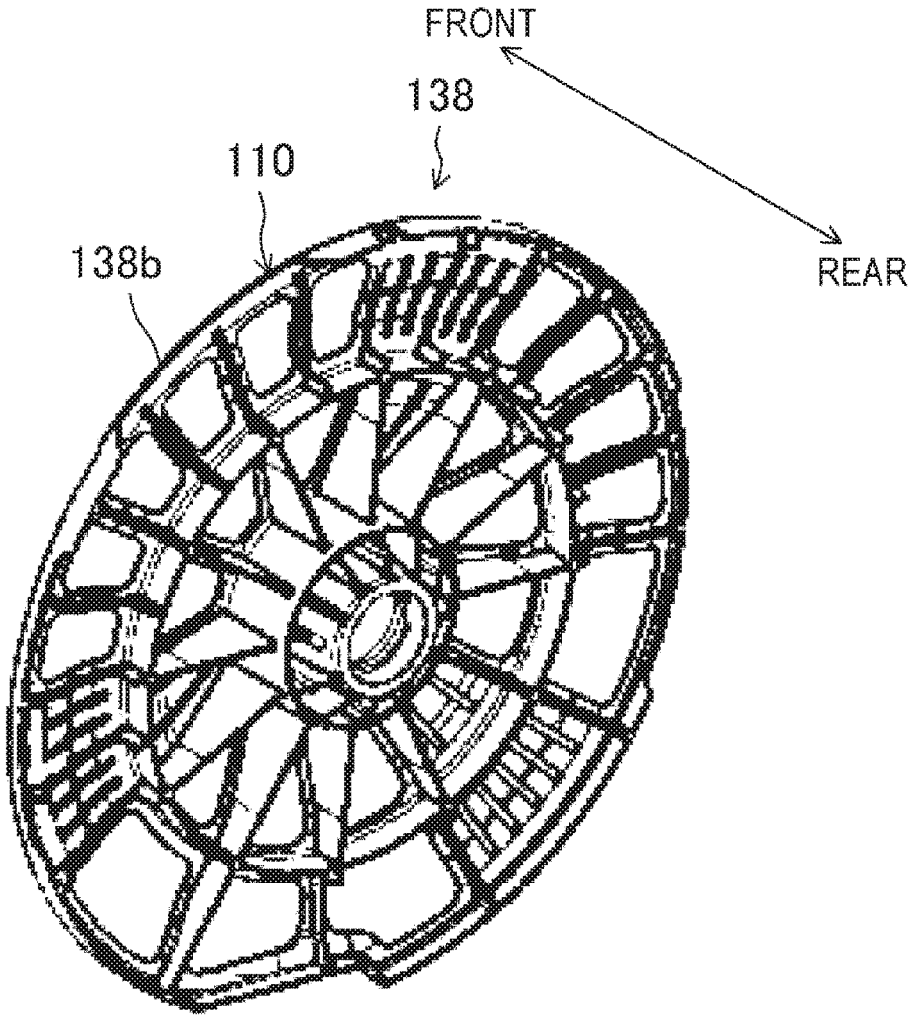
FIG. 40 is a rear perspective view of FIG. 37.
Figure 41:
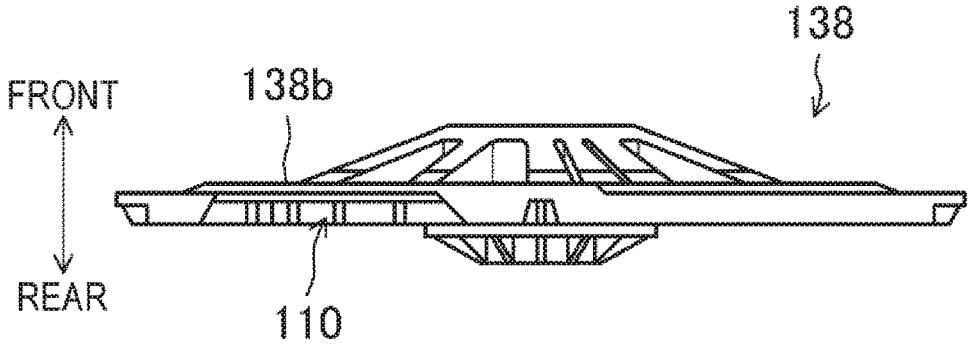
FIG. 41 is a plan view of FIG. 37.
Figure 42:
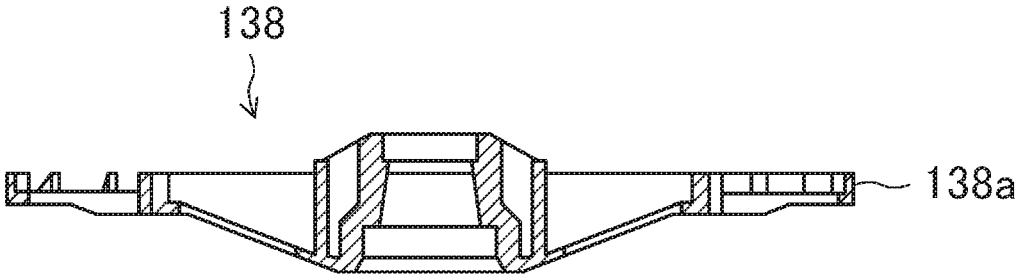
FIG. 42 is a cross-sectional view taken along line XLII-XLII in FIG. 37.

As illustrated in FIGS. 37 to 42, particularly in FIGS. 39, 40, and 42, cylindrical ribs 138*a* ascended toward the rear (rear surface) and toward the front from an outer peripheral portion may be formed at the aluminum die-cast 138. Also, as illustrated in FIGS. 40 and 41, an outer peripheral rib 138*b* toward only the front may be formed at the converging portion 128 of the circulation duct 110 having an integrated structure. Also, as illustrated in FIG. 39, radial ribs 138*c* having a T-shaped cross-section may be formed at positions corresponding to the radial ribs 130 formed in the tub 102 at a portion of the aluminum die-cast 138 corresponding to the circulation duct 110.

Figure 43:
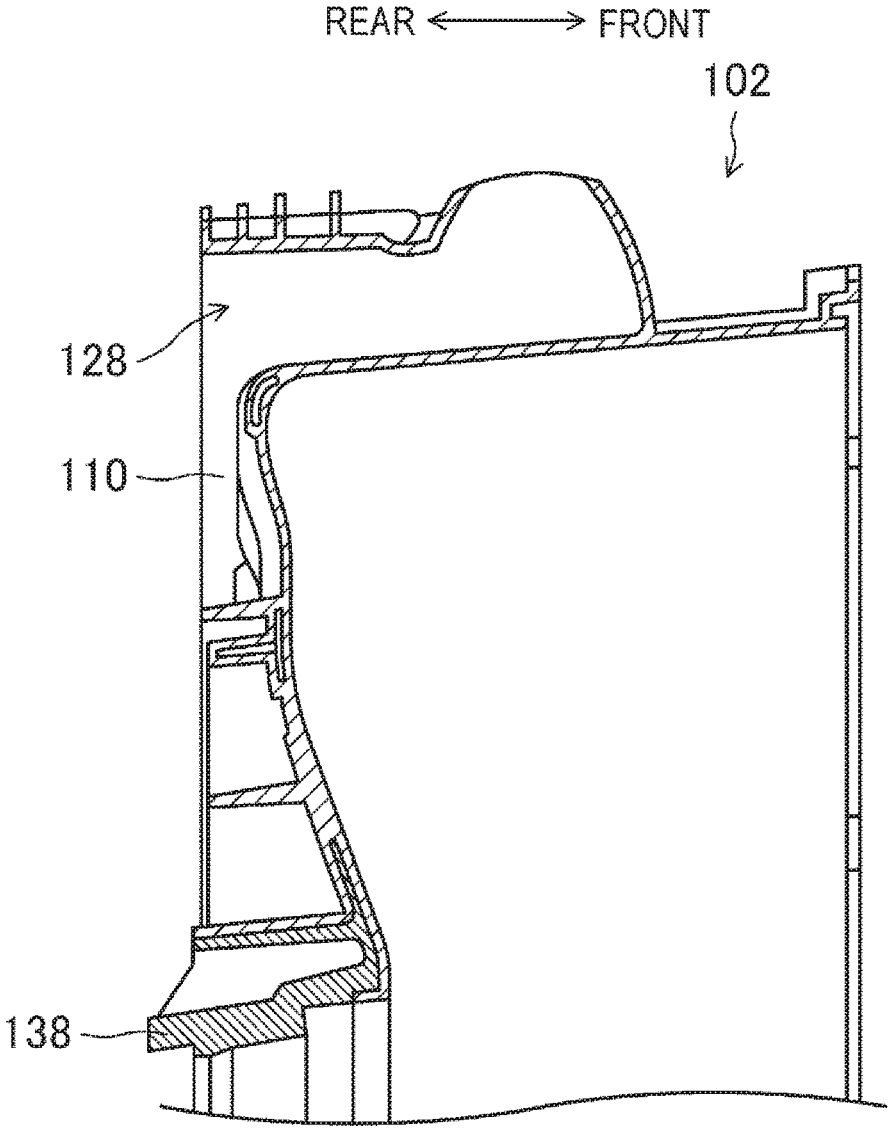
FIG. 43 is a partial cross-sectional view taken along line XLIII-XLIII in FIG. 22.

As illustrated in FIG. 43, a portion of the aluminum die-cast 138 included in the converging portion 128 of the circulation duct 110 may be formed of a smooth curved surface toward the fan connection (toward the front) from the rear surface of the aluminum die-cast 138.

First Modified Example of the Circulation Duct According to the Second Embodiment Hereinafter, a first modified example of the circulation duct according to the present embodiment will be described with reference to FIGS. 44 to 47. In the present modified example, like reference numerals will be assigned to elements which overlap those of the above-described embodiment.

Figure 44:
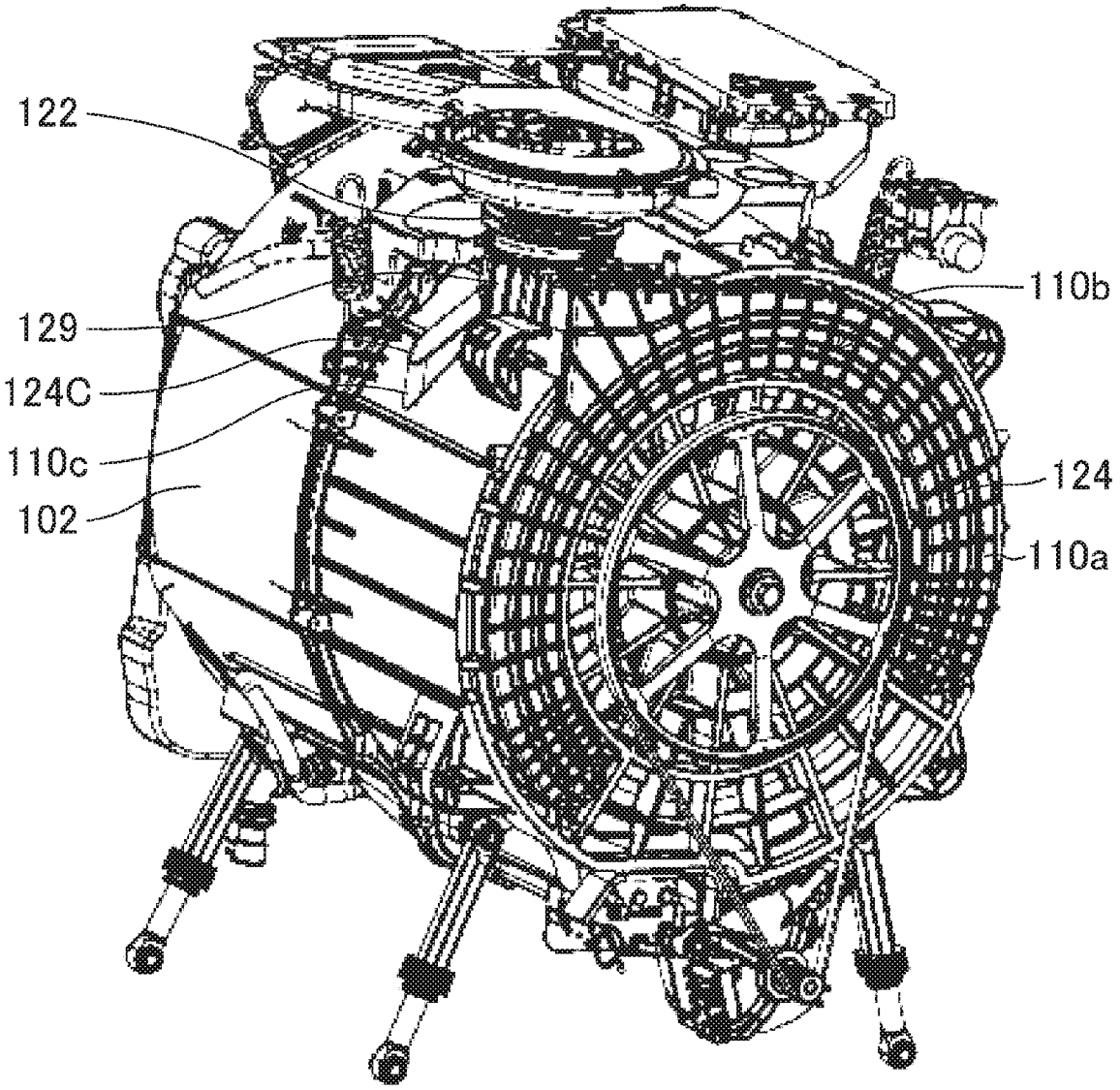
Figure 45:
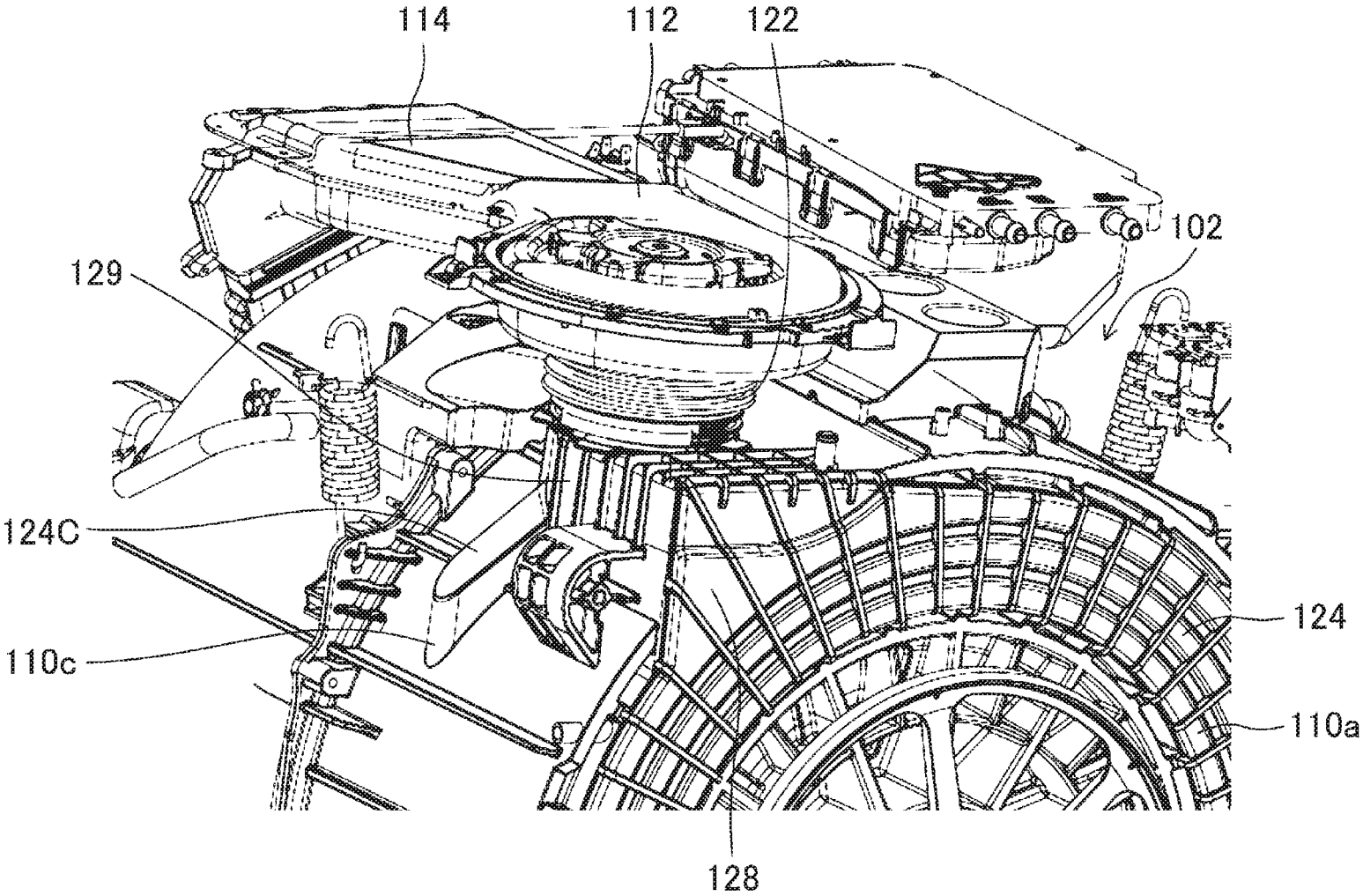
FIG. 45 is an enlarged partial perspective view illustrating a main portion of FIG. 44.

As illustrated in FIG. 44 and FIG. 45, which is an enlarged partial view of FIG. 44, in addition to the branch ducts 110A constituting the circulation duct 110, the third duct system 110C is, for example, installed to converge to the fan connection 129 from the upper side surface of the tub 102. Here, the dehumidifiers 110*b* are respectively installed in the duct systems constituting the branch ducts 110A while the dehumidifier 110*b* is not installed in the third duct system 110C. The third duct system 110C may be used as a bypass flow path for increasing a circulating air flow rate.

Figure 46:
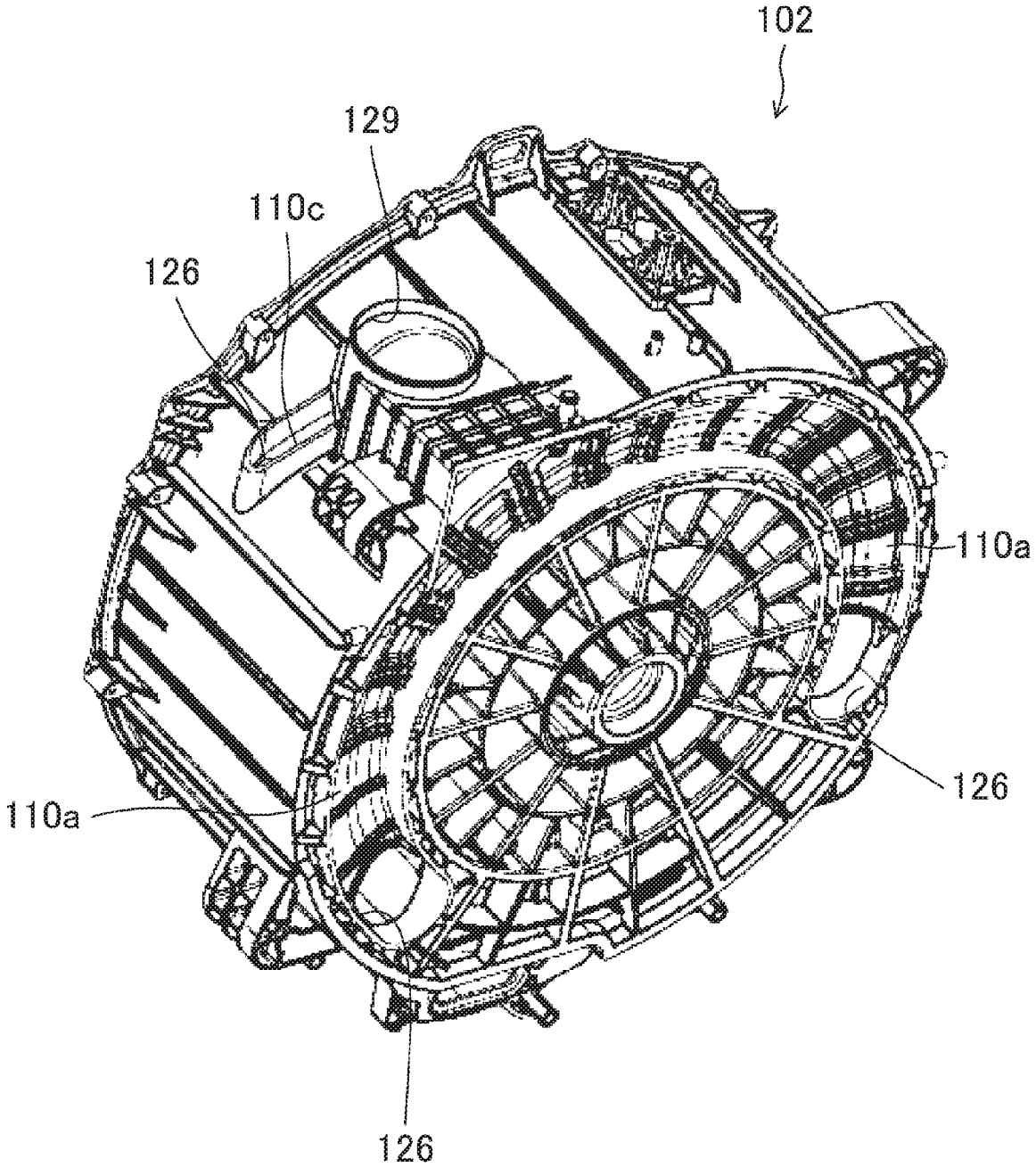
FIG. 46 is a tub constituting the washing and drying machine according to the first modified example of the second embodiment and is a perspective view from the rear side from which the duct cover is omitted.
Figure 47:
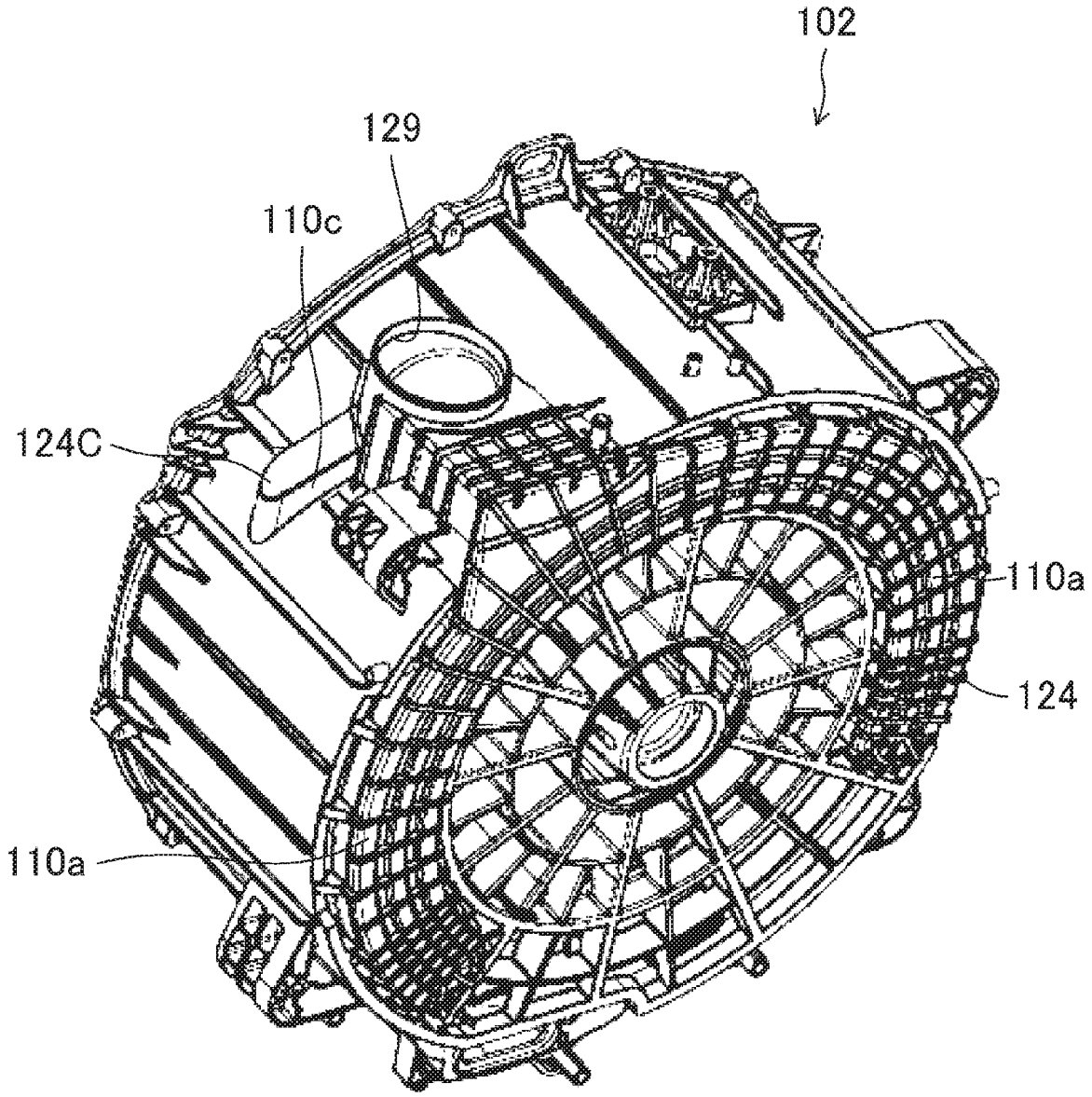
FIG. 47 is a perspective view from the rear side illustrating a state in which the duct cover of the tub constituting the washing and drying machine according to the first modified example of the second embodiment is attached.

As illustrated in FIGS. 44 to 47, particularly in FIG. 46, the third duct system 110C is, for example, formed of a sidewall portion ascended from the upper side surface of the tub 102 and may be integrally formed with the tub 102 to communicate with a lower portion of the fan connection 129. Also, as illustrated in FIG. 47, a duct cover 124B configured to cover an upper surface of the duct system 110C may be fixed or welded to the third duct system 110C.

Figure 48:
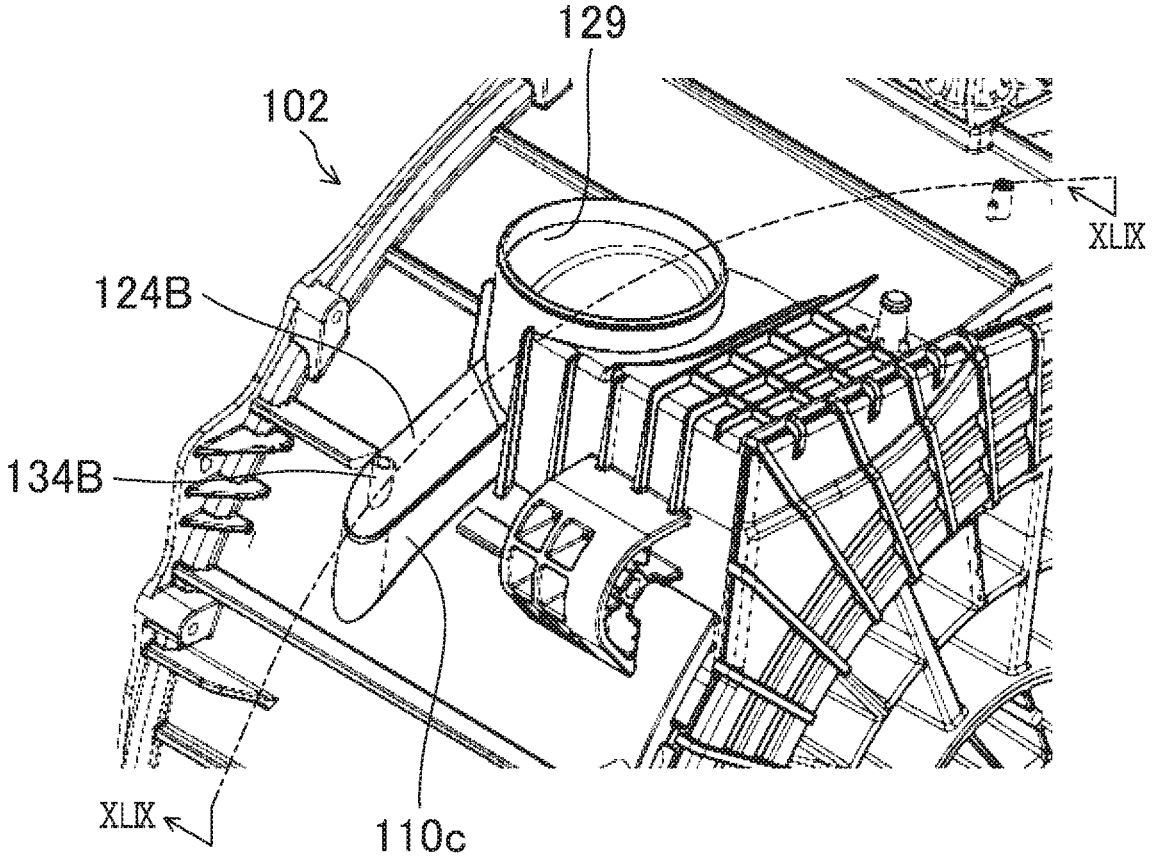
FIG. 48 is a partial perspective view illustrating a duct cleaning nozzle installed in a circulation duct with third duct systems according to another modified example.
Figure 49:
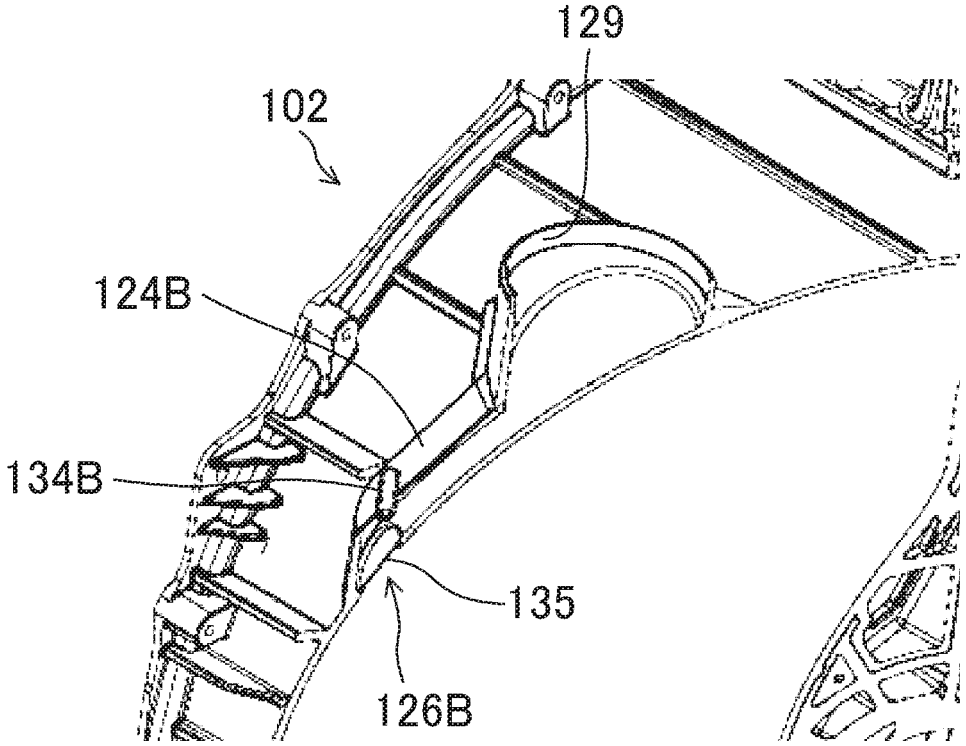
FIG. 49 is a cross-sectional view taken along line XLIX-XLIX in FIG. 48.

As another modified example of the third duct system 110C, as illustrated in FIG. 48 and FIG. 49, which is a cross-sectional view of FIG. 48, the mesh type lint filter 135 may be arranged in the communication hole 126B from the tub 102 of the third duct system 110C, and, for example, the cleaning nozzle 134B configured to clean the lint filter 135 may be installed at duct cover 124B configured to cover the upper surface of the third duct system 110C. An arrangement position of the cleaning nozzle 134B is not limited to the duct cover 124B, and the cleaning nozzle 134B may also be arranged in the duct system 110C.

Second Modified Example of the Circulation Duct According to the Second Embodiment Hereinafter, a second modified example of the circulation duct according to the present embodiment will be described with reference to FIGS. 50 to 64. Even in the present modified example, like reference numerals will be assigned to elements which overlap those of the above-described embodiment.

Figure 50:
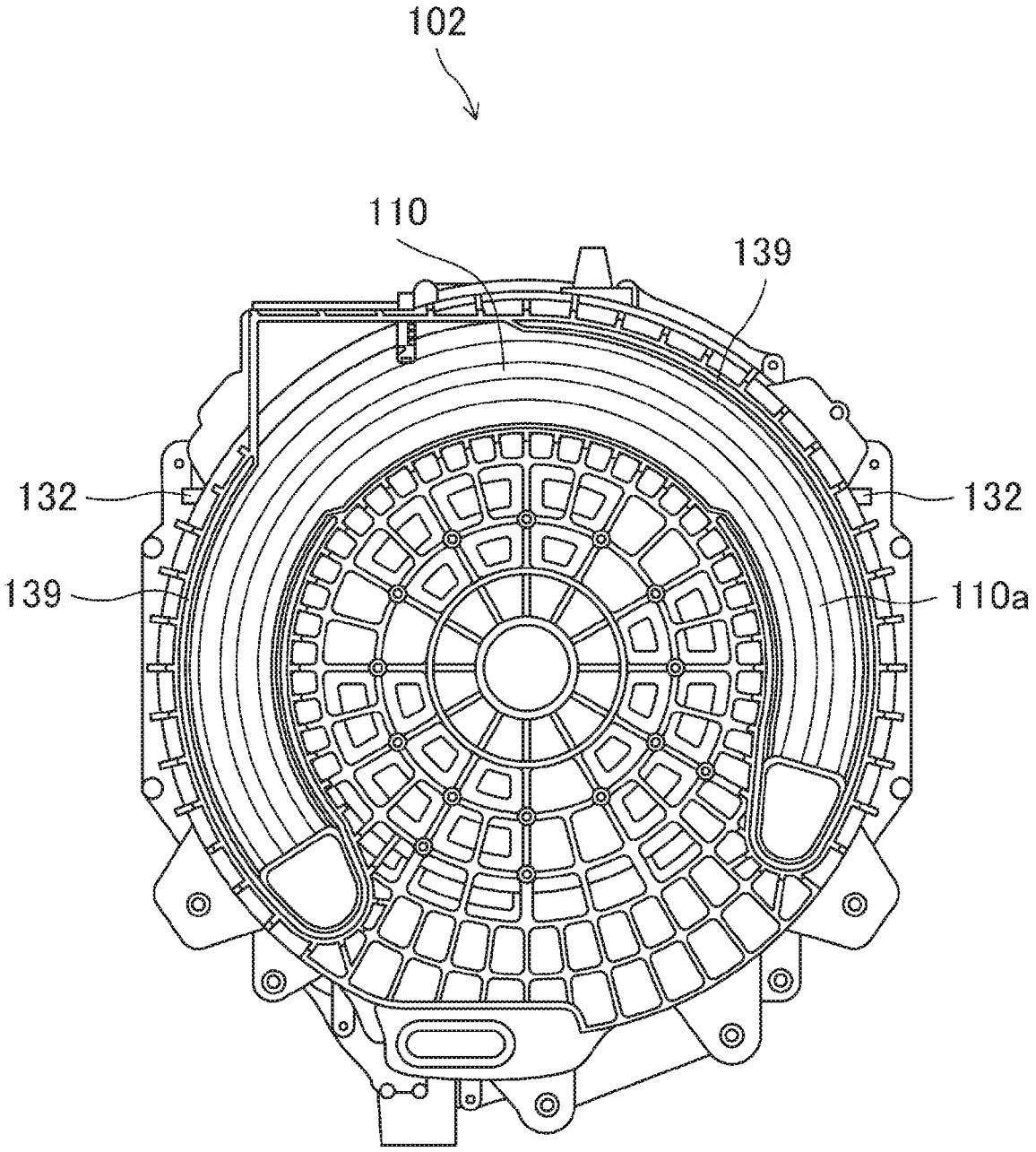
FIG. 50 is a rear view of a washing and drying machine having a circulation duct having a double wall structure according to a second modified example of the second embodiment in a state in which a duct cover is removed.
Figure 54:
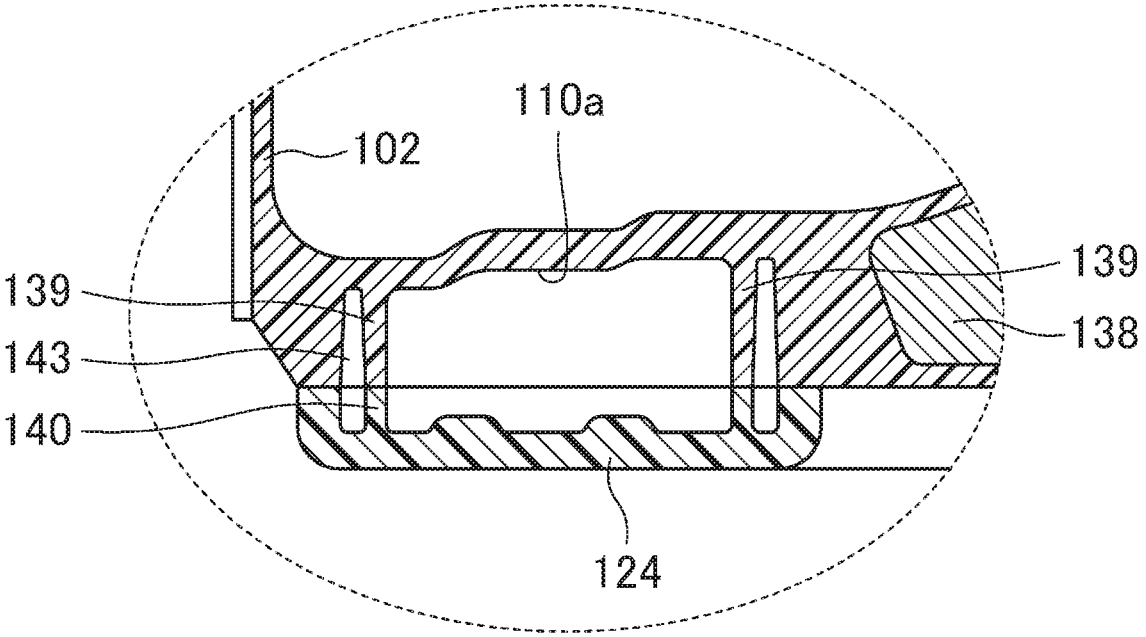
FIG. 54 is an enlarged partial cross-sectional view illustrating a region B in FIG. 53.

As illustrated in FIGS. 50 and 54, double wall structures 139 having an airtight space 143 may be arranged at the insides of the branch ducts 110A constituting the circulation duct 110. Although the double wall structures 139 are arranged up to a portion above the dehumidifying liquid supply nozzle 132 in the example illustrated in FIG. 50, the double wall structures 139 may also be arranged below the dehumidifying liquid supply nozzle 132 as long as the double wall structures 139 are not submerged during washing and rinsing.

Figure 51:
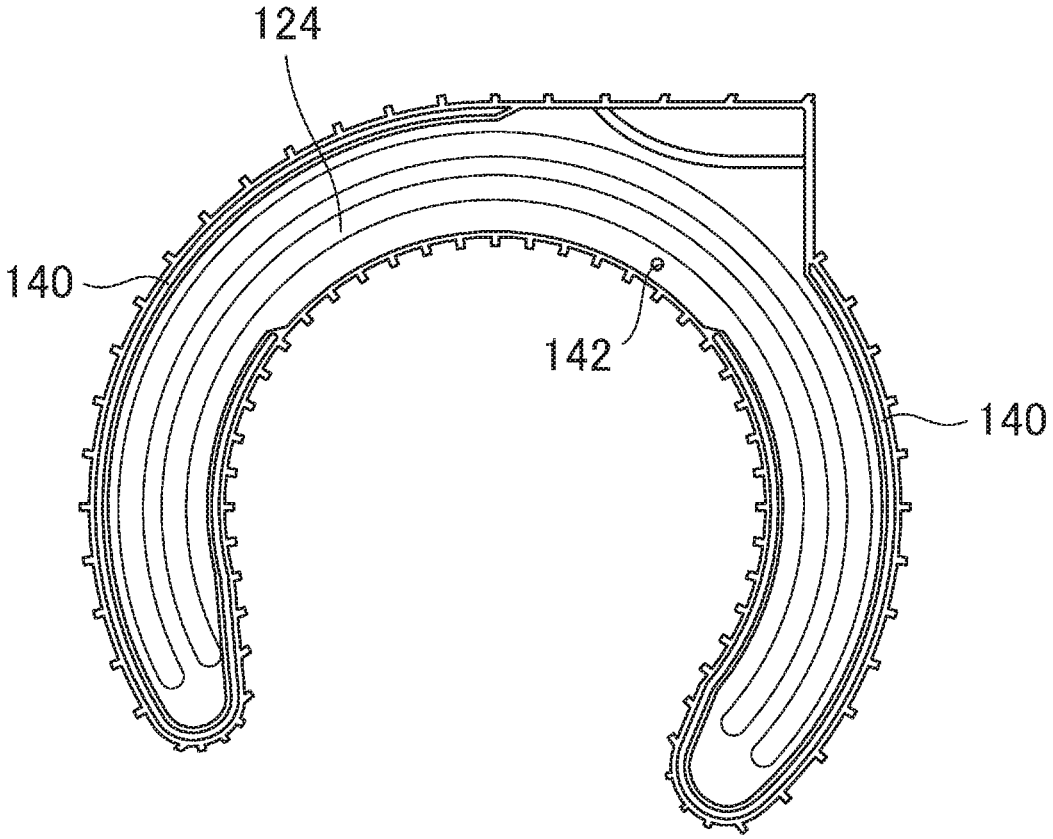
FIG. 51 is a rear view illustrating a duct cover having the double wall structure according to the second modified example of the second embodiment.

As illustrated in FIG. 51, even in the duct cover 124, a double wall structure 140 may be installed at a position facing the double wall structures 139 of the branch ducts 110A. The double wall structure 140 of the duct cover 124 may be integrated with the double wall structures 139 of the branch ducts 110A installed in the tub 102 by, for example, welding (or example, see FIGS. 52, 53, and 54). As illustrated in FIG. 54, in the second modified example, the outer peripheral portion of the aluminum die-cast 138 may be arranged more inward than the inner peripheral surface at the rotary shaft side of the drum in the branch ducts 110A. In this way, because the strength of the tub 102 is improved and the aluminum die-cast 138 is arranged only more inward than the inner peripheral surfaces of the branch ducts 110A, a cross-sectional height of a flow path in the branch ducts 110A may be sufficiently secured. Also, embodiments are not limited thereto, and as in a modified example illustrated in FIG. 55, the outer peripheral portion of the aluminum die-cast 138 may also be arranged between the inner peripheral surface and the outer peripheral surface at the rotary shaft side of the drum in the branch ducts 110A. In this way, an increase in material cost of the aluminum die-cast 138 may be suppressed to be minimum, an improvement in strength of the rear surface of the tub 102 may be promoted, and cross-sectional areas of the branch ducts 110A may be secured.

Also, as illustrated in FIG. 36, the outer peripheral portion of the aluminum die-cast 138 may be formed to extend up to the side portion of the tub 102. In this case, the strength of the rear surface of the tub 102 may be further improved.

Figure 53:
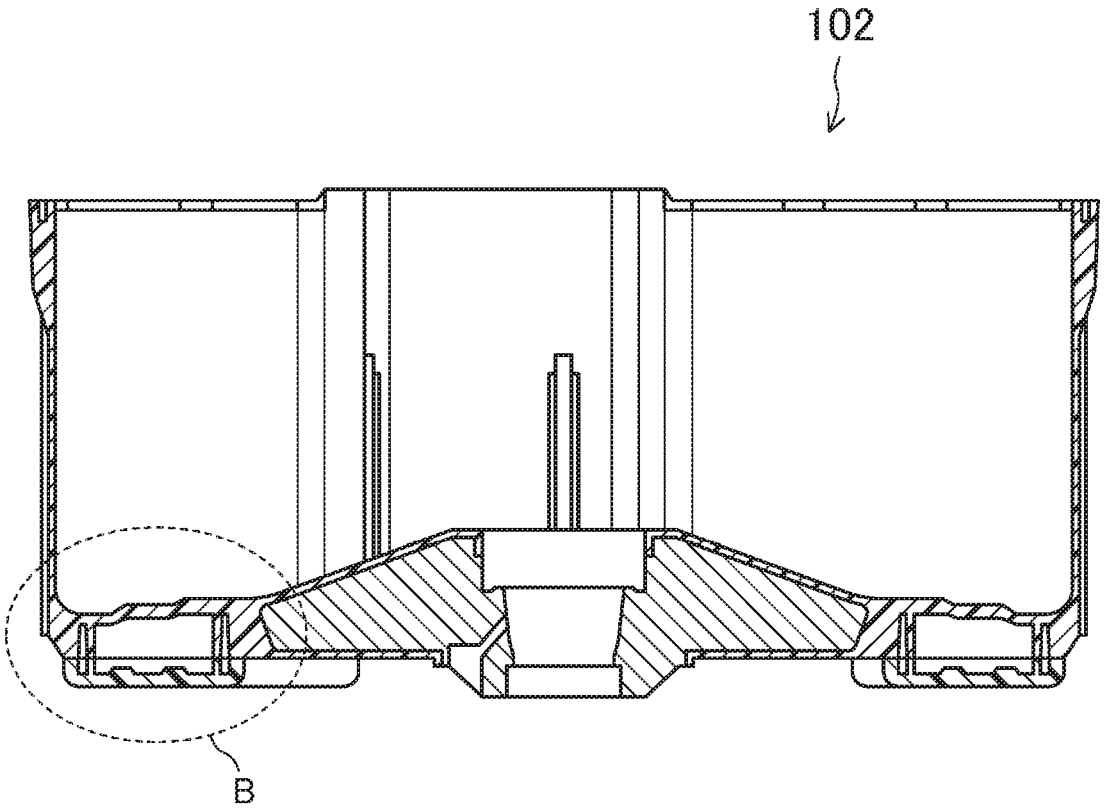
FIG. 53 is a cross-sectional view taken along line LIII-LIII in FIG. 52.
Figure 55:
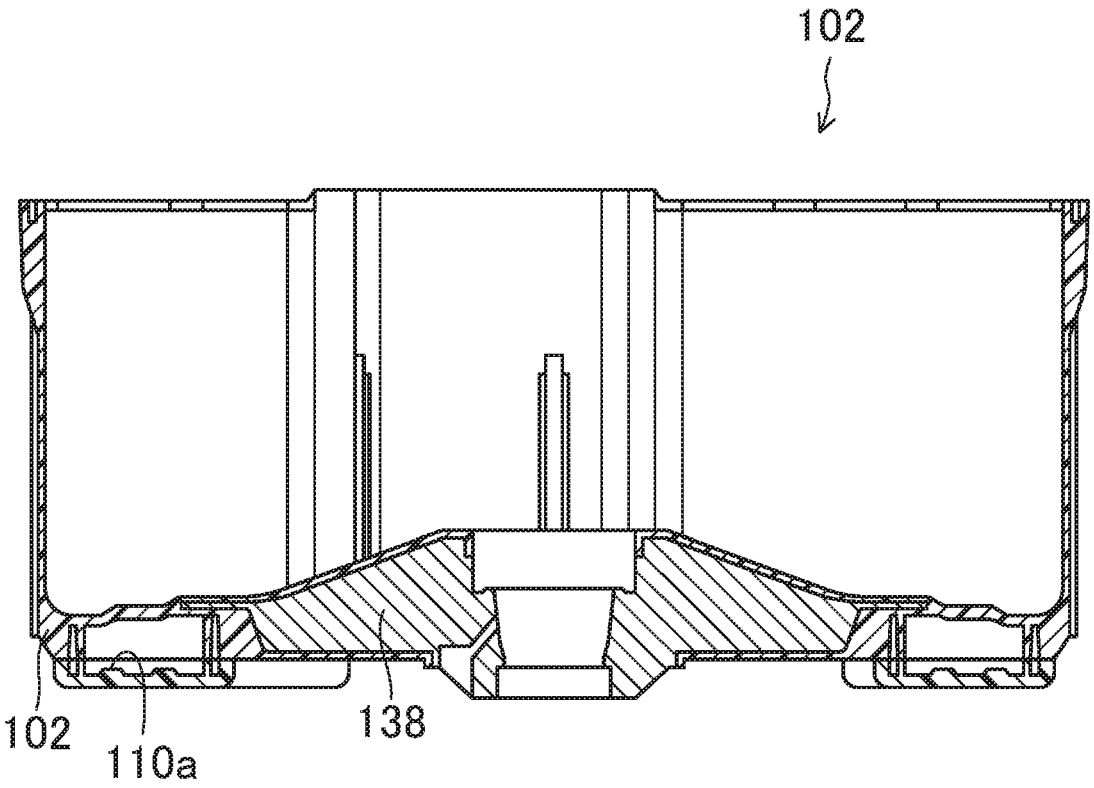
FIG. 55 is a cross-sectional view of a modified example of FIG. 53.

With respect to the above-described configurations of the tub 102 illustrated in FIGS. 53, 55, and 36, the configuration in FIG. 53 may be applied when, for example, the tub 102 is relatively small and a number of rotations thereof during dehydration is relatively small. The configuration in FIG. 36 may be applied when the tub 102 is relatively large and the number of rotations thereof during dehydration is relatively large. The configuration in FIG. 55 may be applied when the tub 102 has an intermediate size and the number of rotations thereof during dehydration is intermediate.

Also a width in a diametric direction of the rotary shaft of the drum in the airtight space 143 generated by the double wall structures 139 and 140 illustrated in FIG. 54 may be set to be in the range of, for example, 2 mm to about 10 mm. Also, inner wall thicknesses of the double wall structures 139 and 140 may be set to be in the range of, for example, 2 mm to about 5 mm.

The duct cover 124 may be coupled by interposing a seal material and fixing the seal material by a screw. Because the strengths of the branch ducts 110A constituting the circulation duct 110 are improved and the watertight portion has a double structure by the double wall structures 139 and 140, safety against leakage from the circulation duct 110 is also improved.

Figure 56:
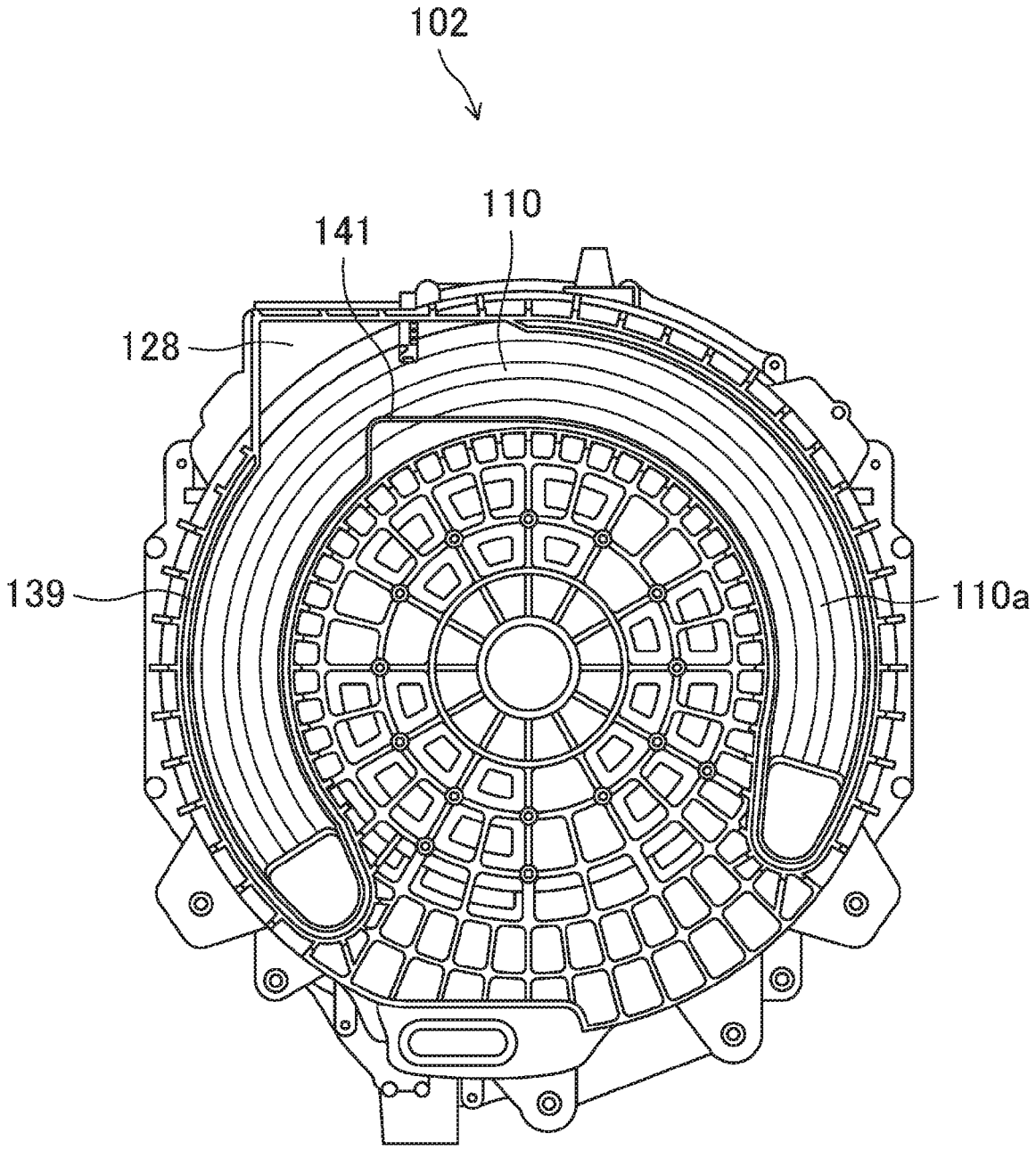
FIG. 56 is a rear view illustrating another modified example of the circulation duct having the double wall structure according to the second modified example of the second embodiment.

FIG. 56 illustrates a modified example of the double wall structures 139 of the branch ducts 110A and the double wall structure 140 of the duct cover 124.

As illustrated in FIG. 56, the double wall structures 139 may be installed to communicate with each other at a portion between the dehumidifiers 110*b* respectively constituting the branch ducts 110A (for example, see FIG. 30). Also, a guide 141 at which a duct width of each of the dehumidifiers 110*b* is maintained toward the converging portion 128 may also be installed. The guide 141 may not be necessarily installed.

Figure 57:
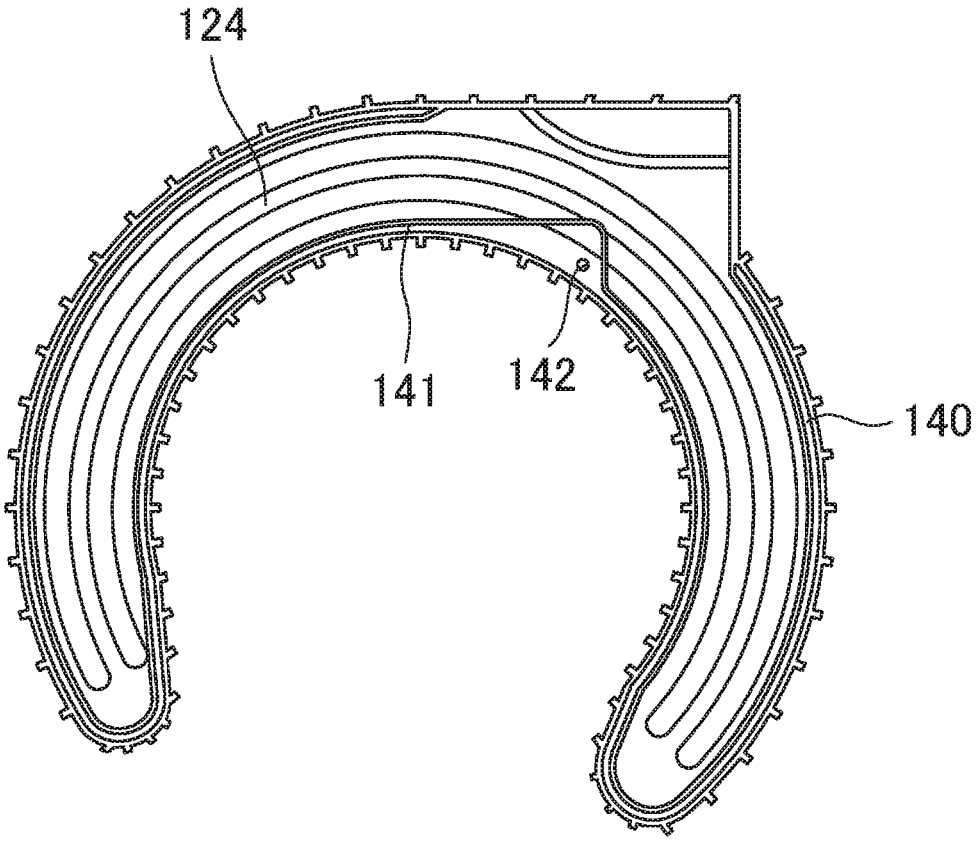
FIG. 57 is a rear view illustrating another modified example of the duct cover having the double wall structure according to the second modified example of the second embodiment.

As illustrated in FIG. 57, even at the duct cover 124, the double wall structure 140 may be installed at a position facing the double wall structures 139 of the branch ducts 110A. A testing portion 142 for testing airtightness of the airtight space 143 placed between the double wall structures may be arranged at the guide 141. The testing portion 142 may be formed at any position as long as the testing portion 142 is not submerged during washing and rinsing and may be installed in a space of each of the double wall structures 139 and 140 when the double wall structures 139 and 140 are not integrated.

Figure 58:
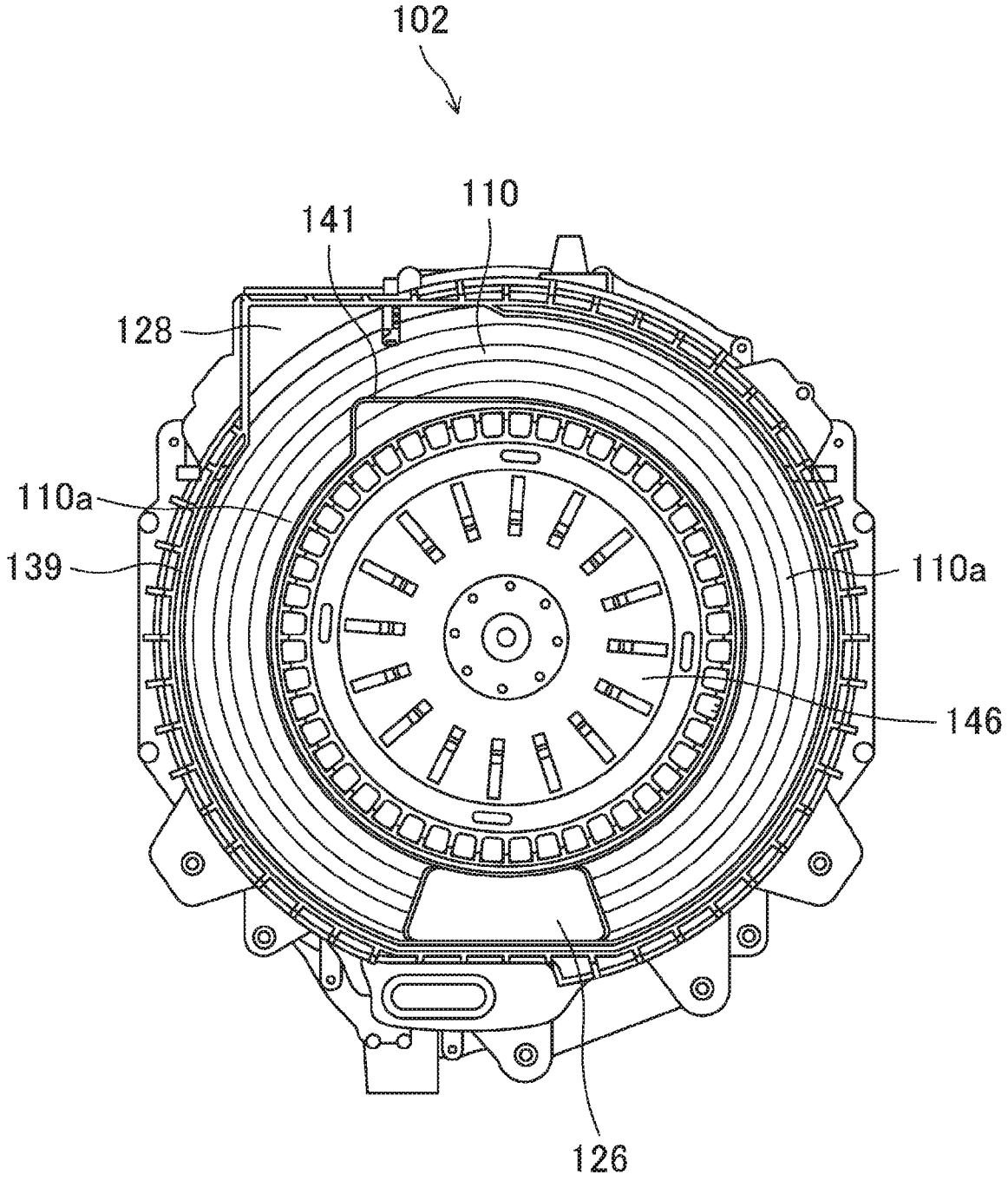
FIG. 58 is a rear view illustrating still another modified example of the circulation duct having the double wall structure according to the second modified example of the second embodiment.
Figure 59:
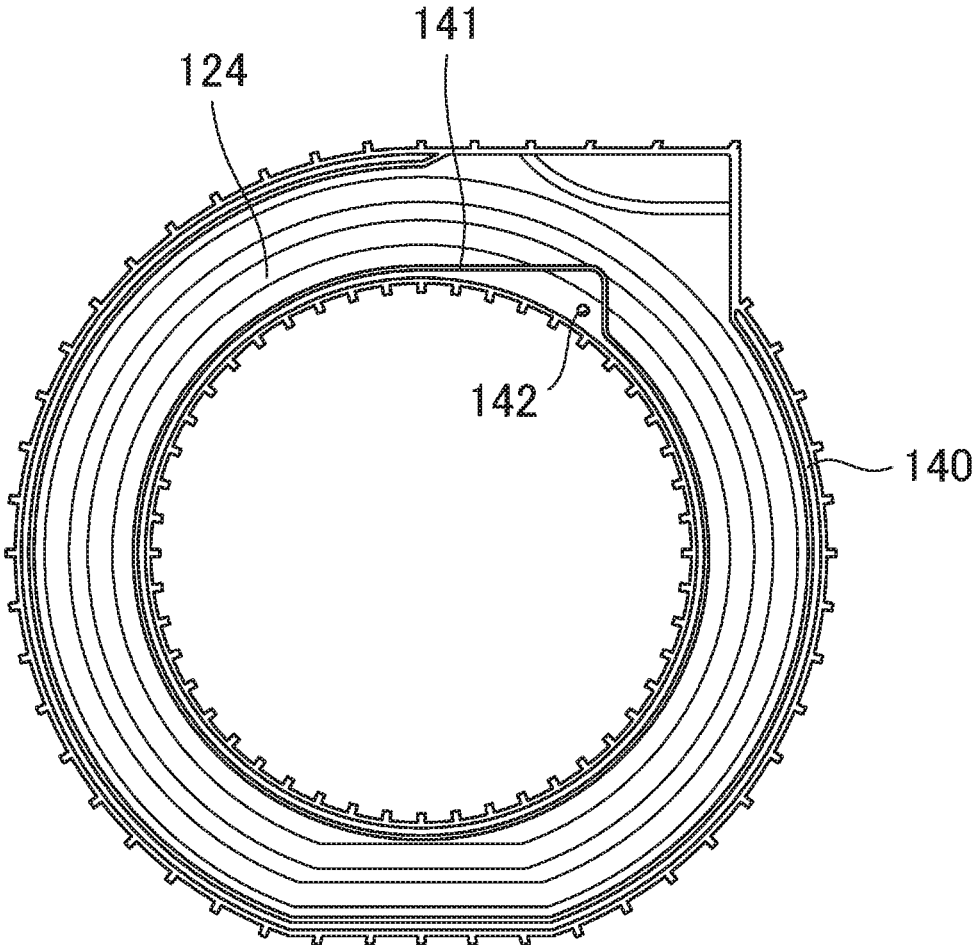
FIG. 59 is a rear view illustrating still another modified example of the duct cover having the double wall structure according to the second modified example of the second embodiment.
Figure 60:
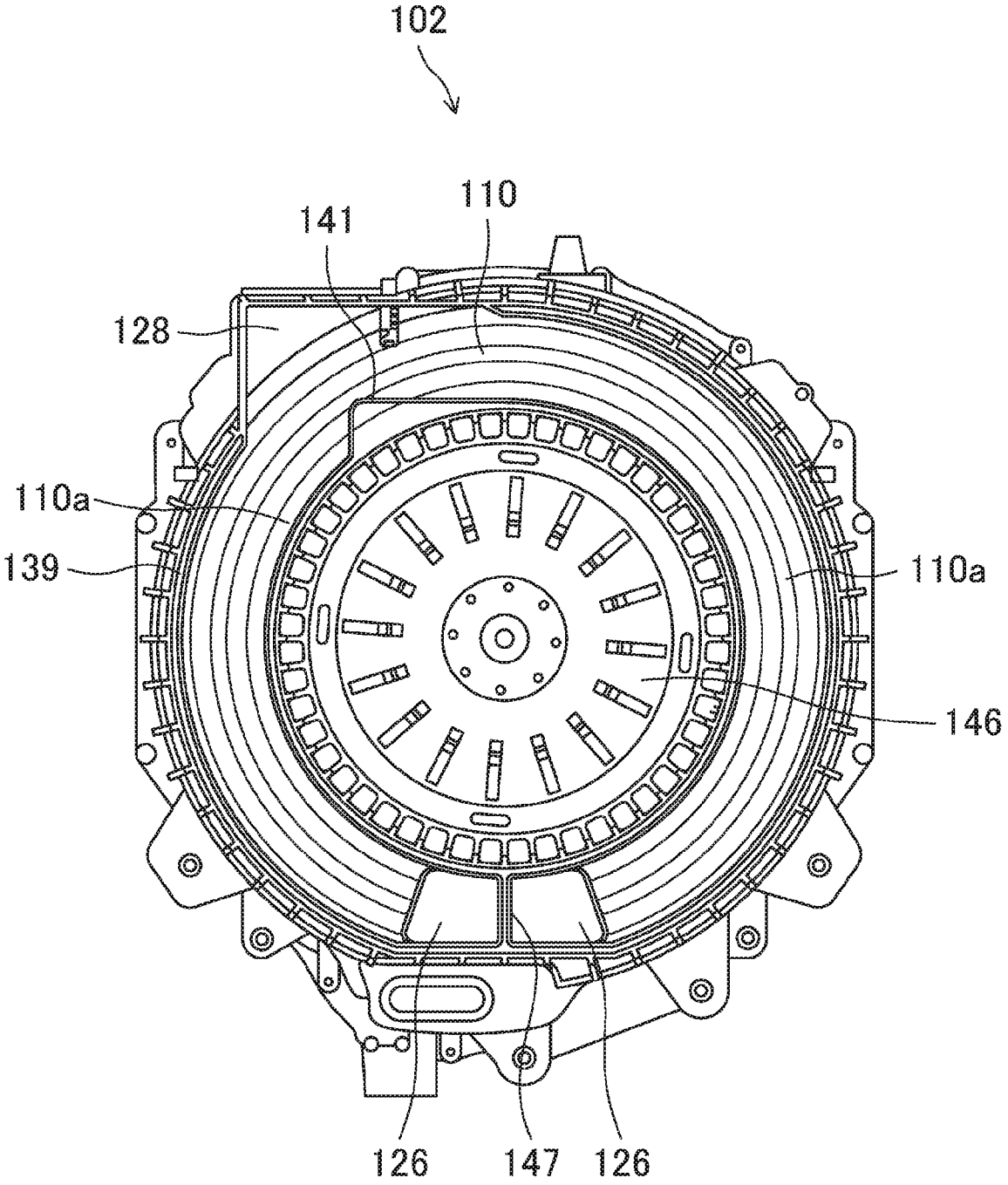
FIG. 60 is a rear view illustrating another modified example of the circulation duct in FIG. 58.
Figure 61:
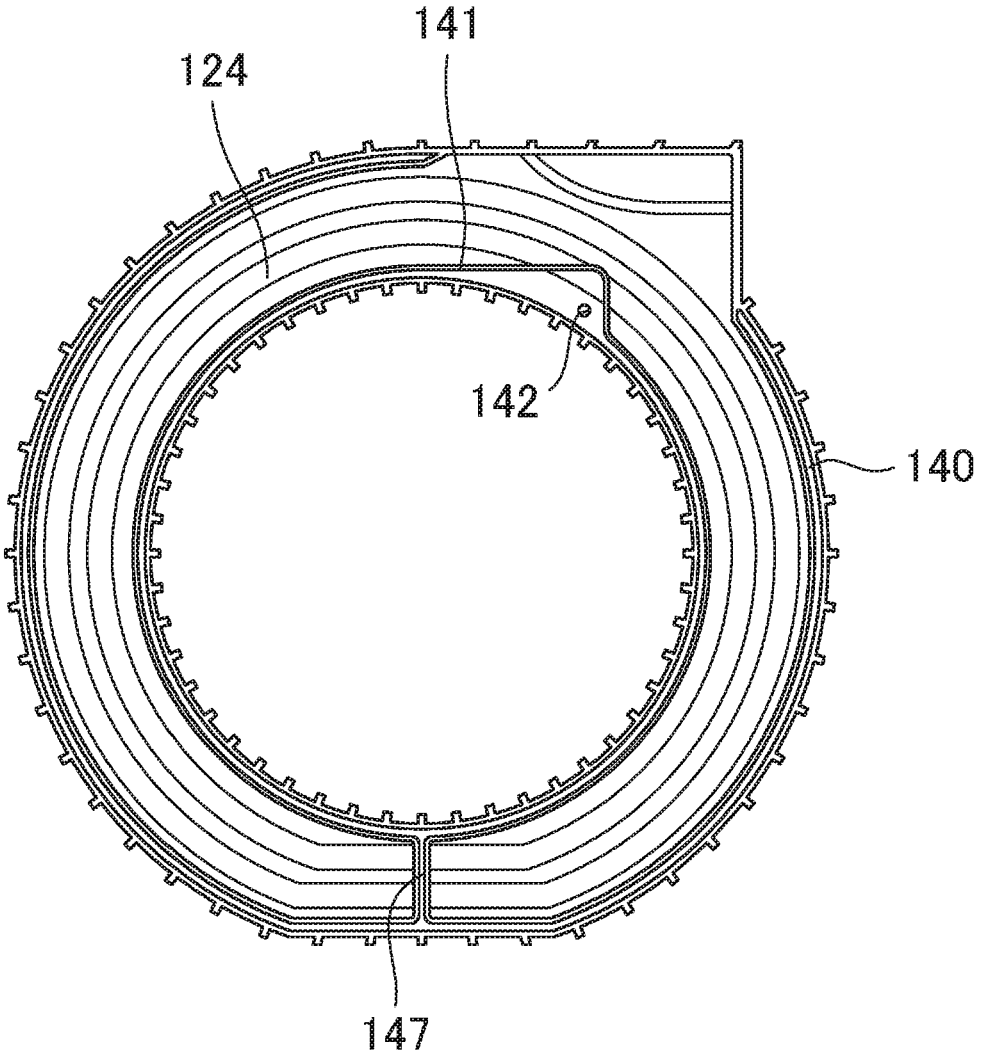
FIG. 61 is a rear view illustrating another modified example of the duct cover in FIG. 59.

As illustrated in FIGS. 58 and 59, as another modified example, the two communication holes 126 communicating with the tub 102 may be integrated into a single communication hole. Also, as illustrated in FIGS. 60 and 61, the partition 147 may be installed to divide the single integrated communication hole 126 at a substantially central portion. In this case, as the double wall structure is also applied to the partition 147, the duct systems may communicate with each other.

Figure 62:
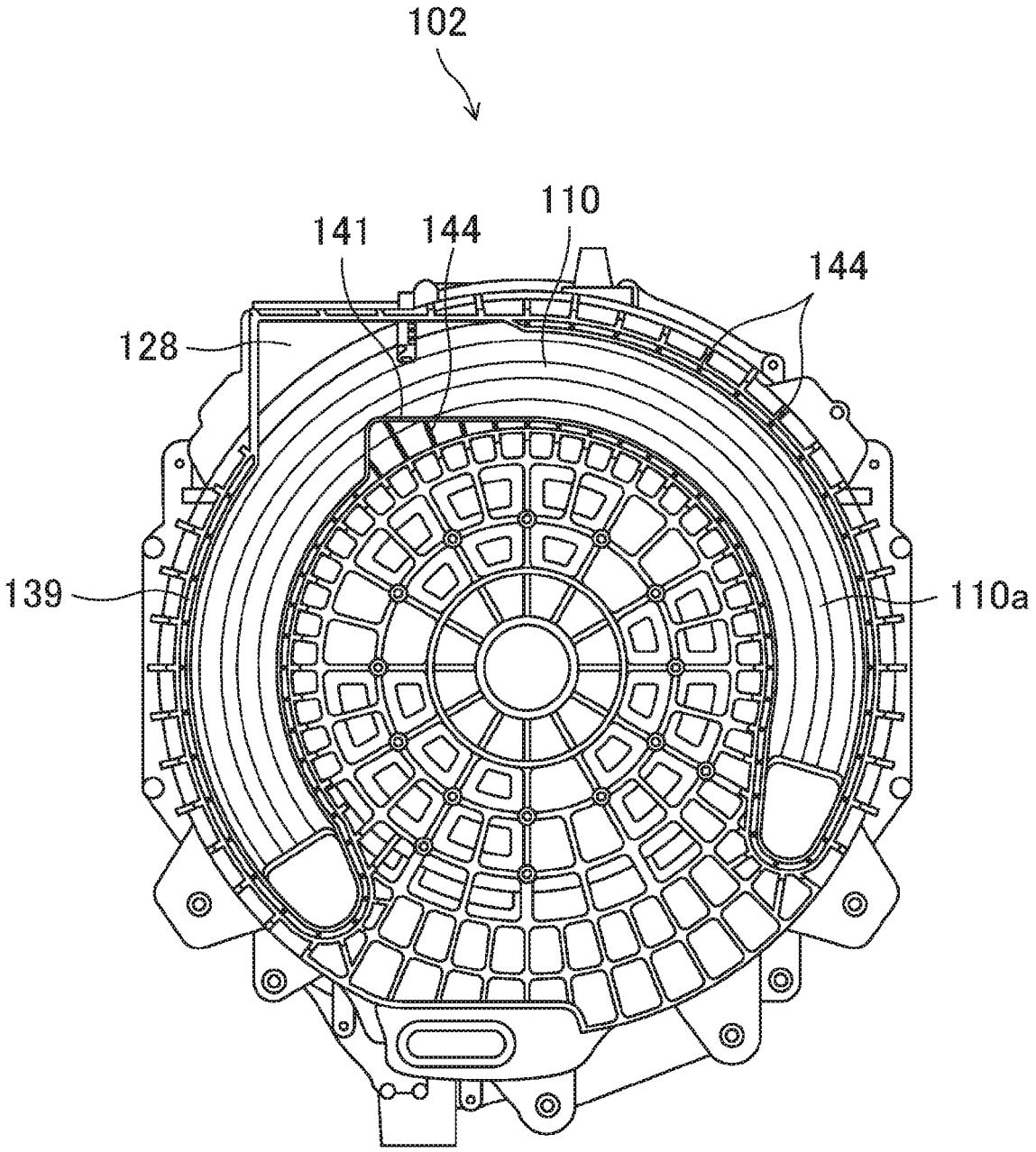
FIG. 62 is a rear view illustrating another modified example of the circulation duct in FIG. 56.
Figure 63:
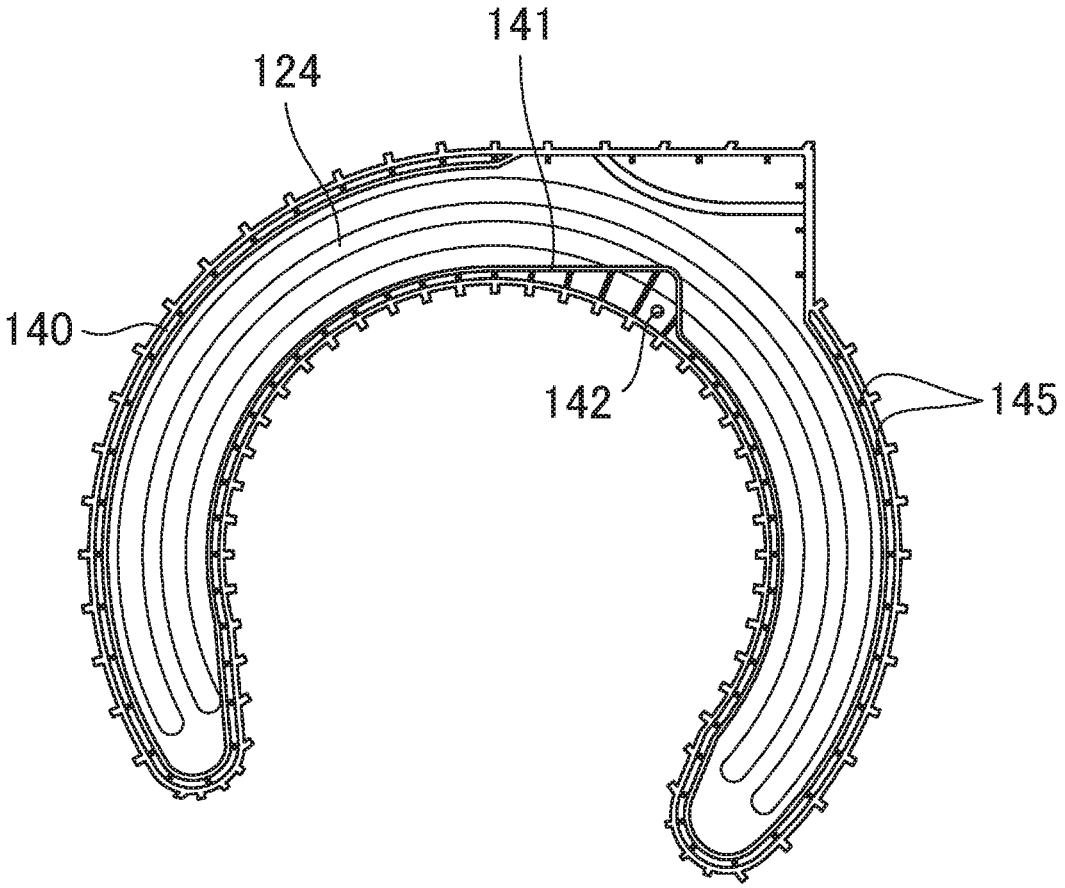
FIG. 63 is a rear view illustrating another modified example of the duct cover in FIG. 57.

As illustrated in FIG. 62, when inner walls and outer walls in the double wall structures 139 are connected by a plurality of ribs 144, the strengths of the branch ducts 110A constituting the circulation duct 110 are further improved. As illustrated in FIG. 63, even in the duct cover 124, ribs 145 may be installed in the double wall structure 140.

Figure 52:
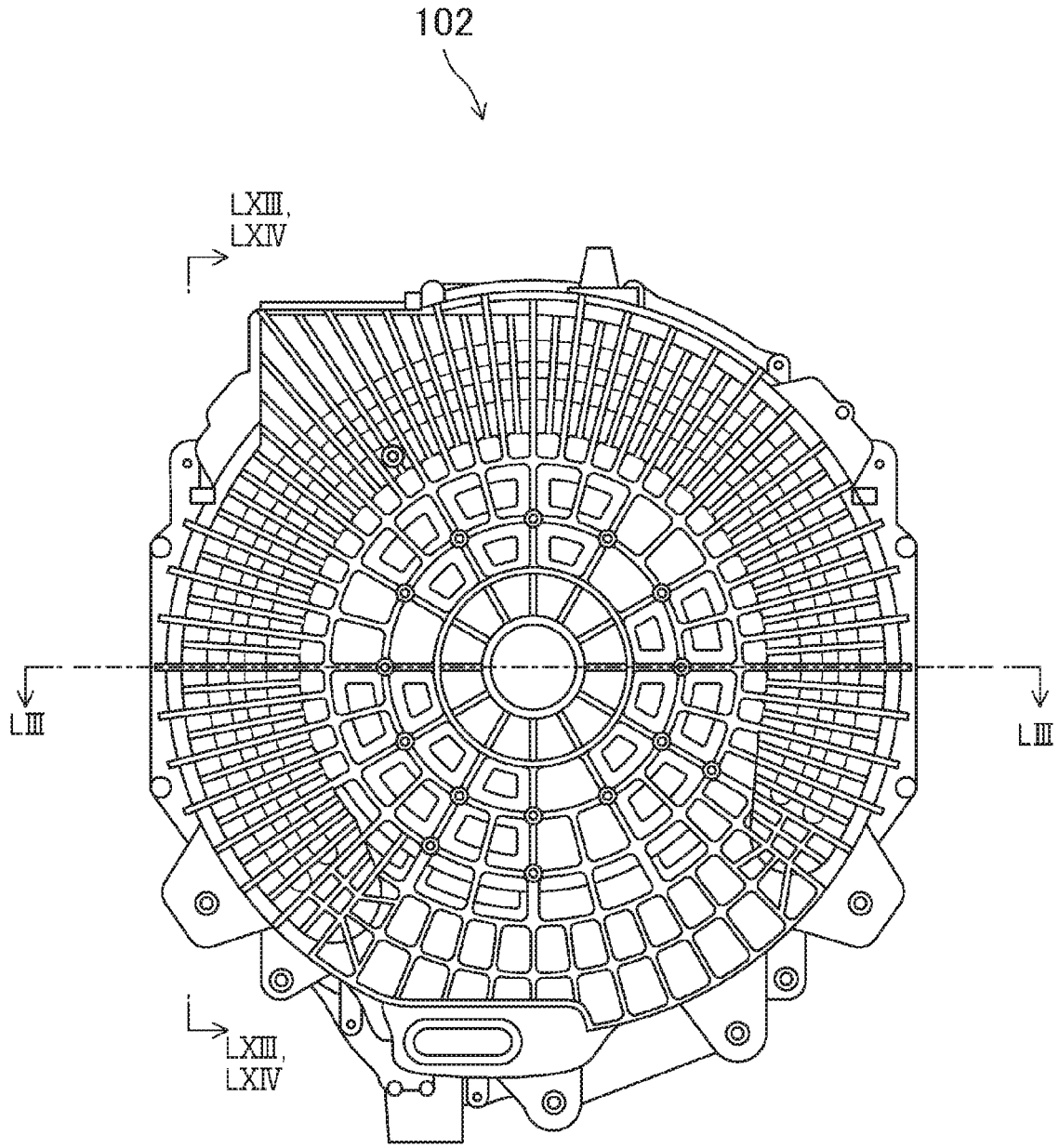
FIG. 52 is a rear view illustrating a state in which the duct cover of the tub constituting the washing and drying machine according to the second modified example of the second embodiment is attached.
Figure 64:
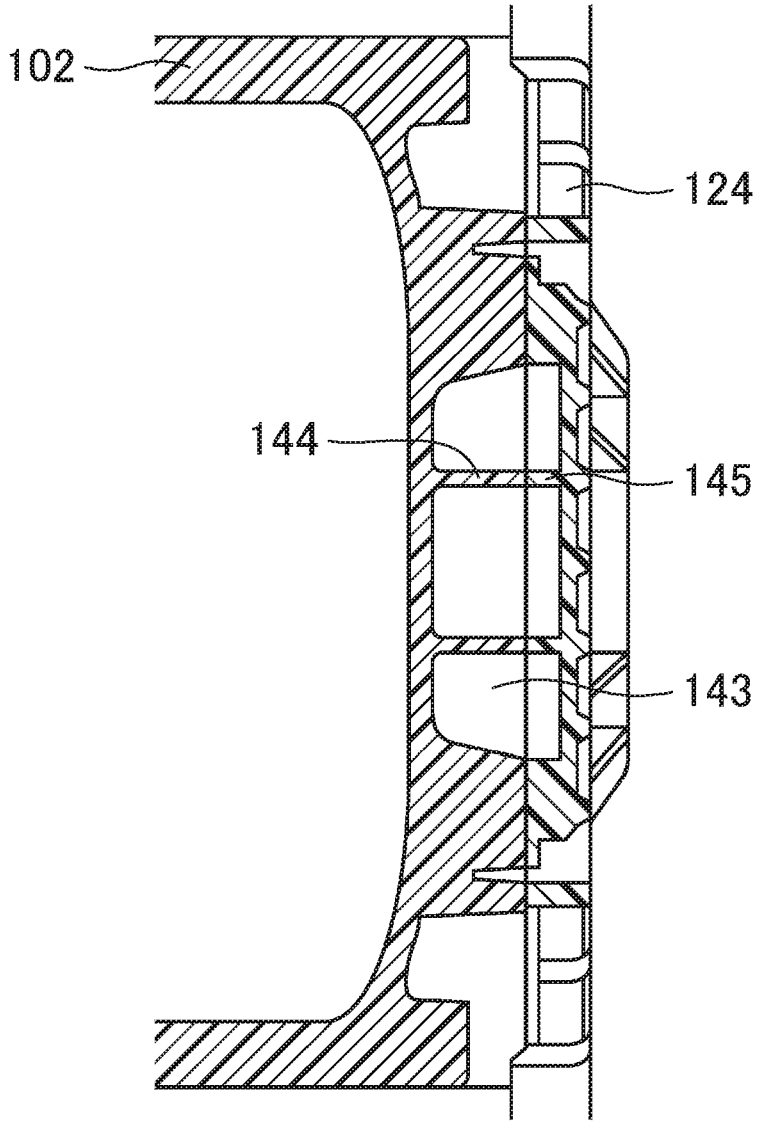
FIG. 64 is a cross-sectional view taken along line LXIV-LXIV in FIG. 52.
Figure 65:
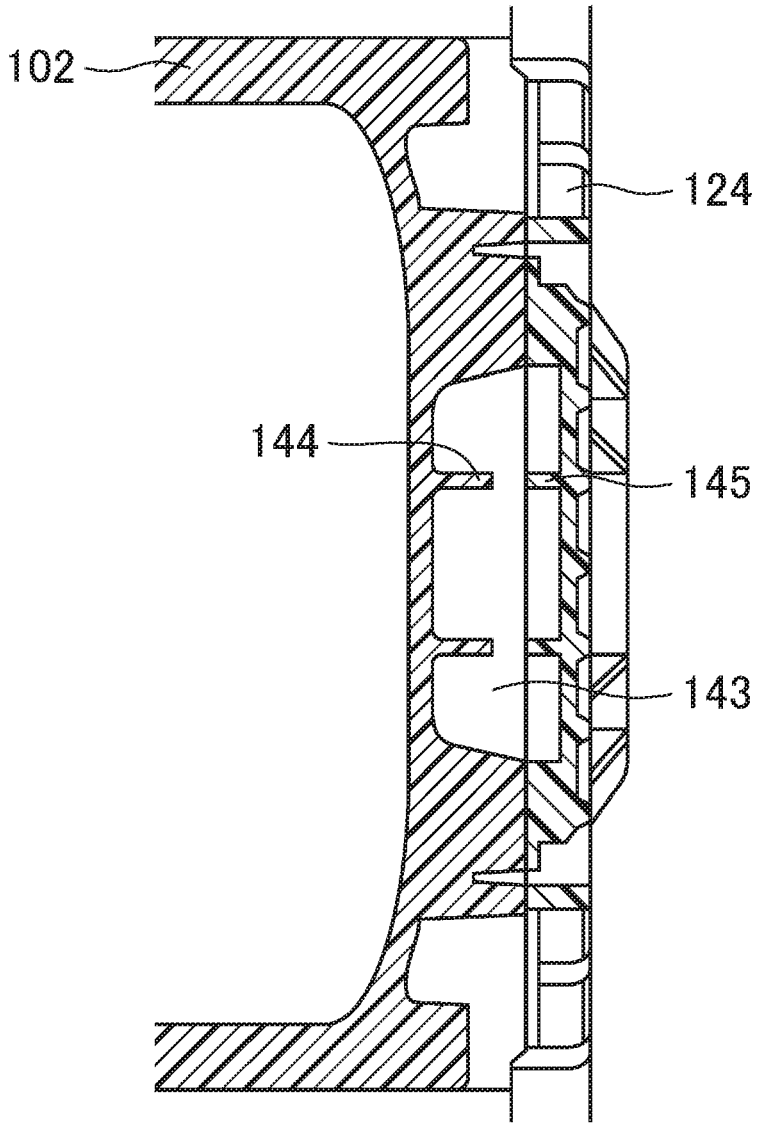
FIG. 65 is a cross-sectional view taken along line LXV-LXV in FIG. 52.
Figure 66:
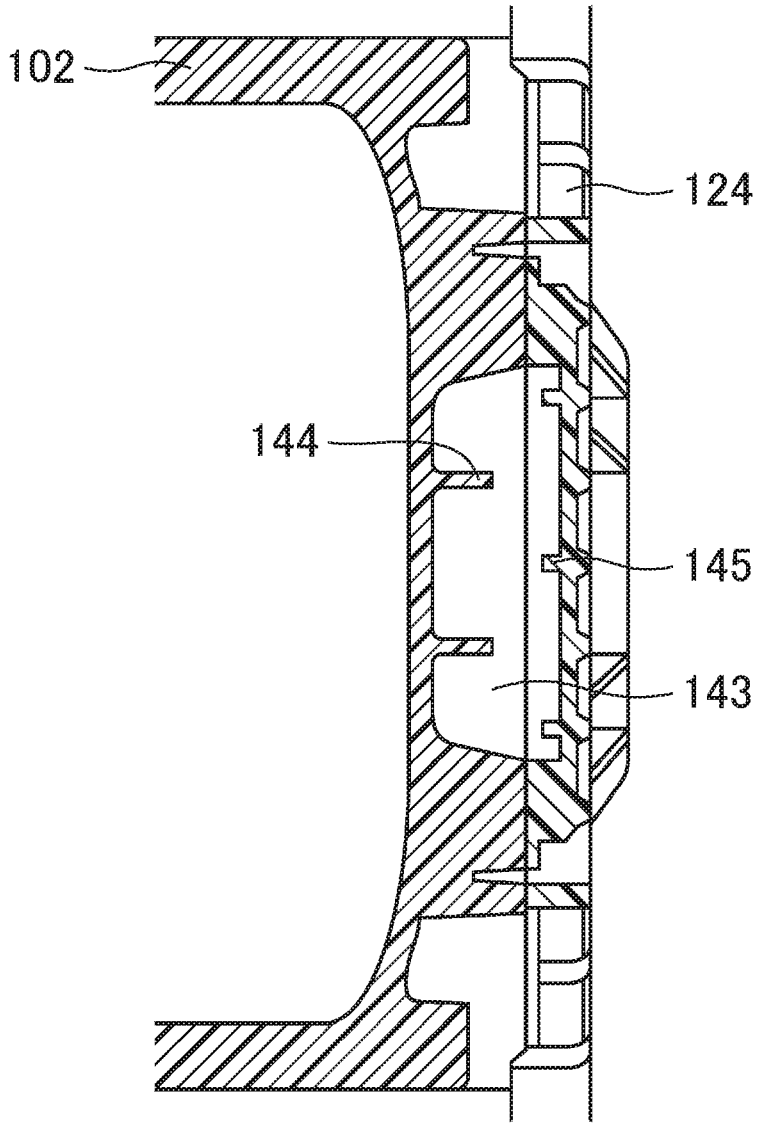
FIG. 66 is a cross-sectional view taken along line LXVI-LXVI in FIG. 52.

Here, in a vertical cross-section illustrated in FIG. 52, the ribs 144 of the branch ducts 110A and the ribs 145 of the duct cover 124 may be arranged at positions facing each other as illustrated in FIGS. 64 and 65. Here, as illustrate in FIG. 64, when the ribs 144 and 145 are in contact with each other, the ribs 144 and 145 may be welded to each other when the tub 102 and the duct cover 124 are welded to each other. In this way, because a welded area of the duct cover 124 is increased, the strength of the circulation duct 110 may be improved. With respect to this, as illustrated in FIG. 65, at least one of the ribs 144 and 145 may be configured to be lower than a height of a wall surface to prevent interfering with communication of the airtight space 143 in the double wall structures 139. Also, as illustrated in FIG. 66, the ribs 144 and 145 may be alternately arranged. Even in this way, interfering with communication of the airtight space 143 may be prevented.

Figure 67:
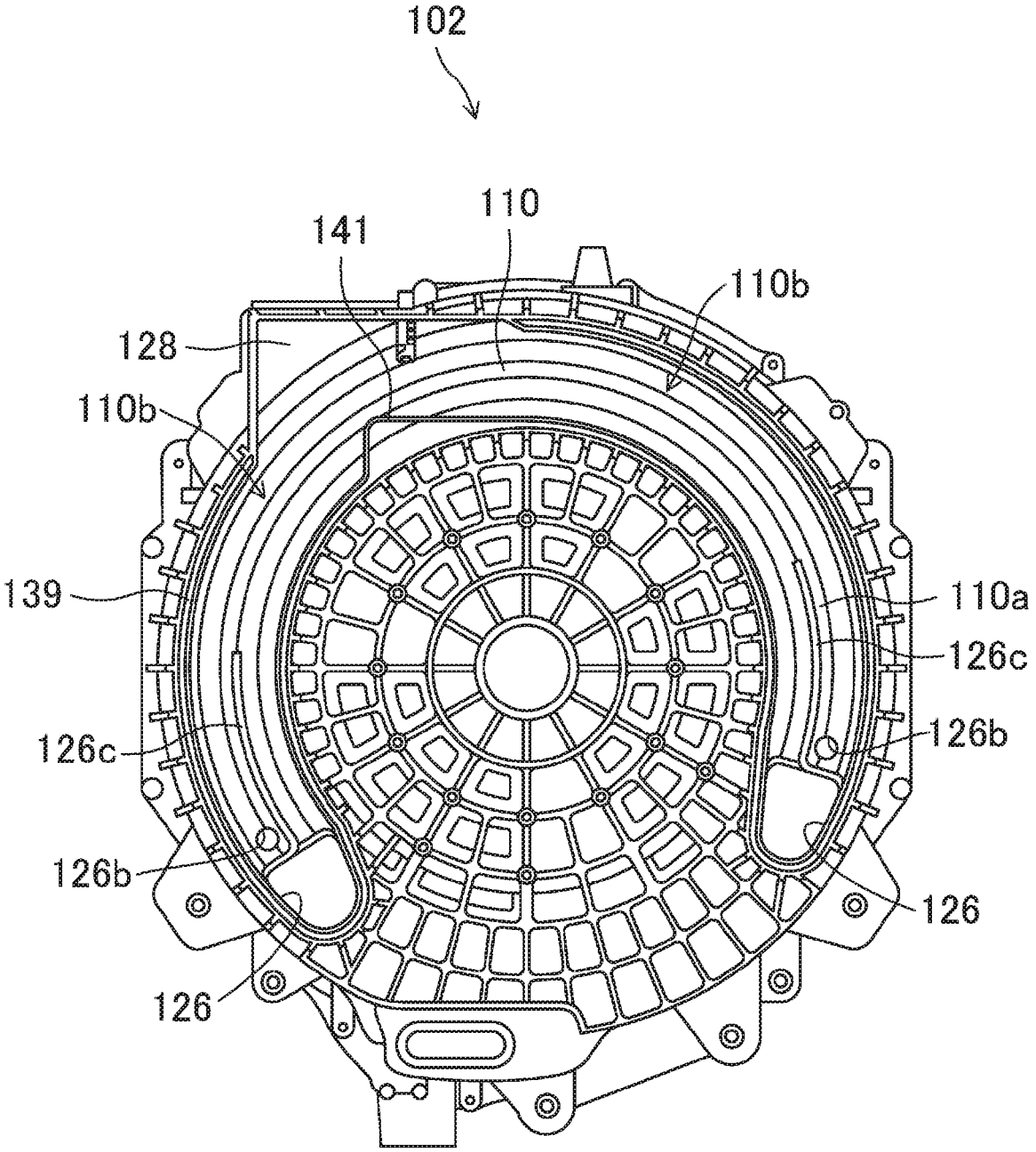
FIG. 67 is a rear view of a tub illustrating a modified example in which an auxiliary communication hole is formed in a branch duct.

As a modified example of the branch ducts 110A in the tub 102, as illustrated in FIG. 67, an auxiliary communication hole 126*b* may be installed in each of the communication holes 126 in the branch duct 110A in which the dehumidifier 110*b* is installed. For example, even when a size of a cross-sectional area of the communication hole 126 in the branch duct 110A is not sufficient, distribution resistance of air is increased, and an air flow rate is decreased, the air flow rate may be increased by the auxiliary communication hole 126*b* according to the present modified example. When the auxiliary communication hole 126*b* is installed in the vicinity of the communication hole 126 as illustrated, because air from the auxiliary communication hole 126*b* is also sufficiently dehumidified, lint may also be collected.

Although the dehumidifier 110*b* is installed at each of the branch ducts 110A, and the auxiliary communication hole 126*b* is installed in each of the communication holes 126 in the example of FIG. 67, the auxiliary communication hole 126*b* may be installed at only one side. That is, it is sufficient that at least one auxiliary communication hole 126*b* is installed in the duct in which dehumidifier 110*b* is installed.

Also, the modified example in which the auxiliary communication hole 126*b* is installed is not limited to being applied to the configuration of the branch ducts 110A illustrated in FIG. 56 and may also be applied to the configurations respectively illustrated in FIGS. 58, 60, and 62. Furthermore, the modified example is not limited to being applied to the configuration (the second embodiment) in which the branch ducts 110A are integrally formed with a constituent member of the tub 102, but may also be applied to the configuration (the first embodiment) in which the branch ducts 11A are separately formed from the tub 102.

As illustrated in FIG. 67, in the present modified example, main communication hole 126 and the auxiliary communication hole 126*b* may be partitioned from each other by a partition rib 126*c*. In this way, each of the branch ducts 110A may include two duct systems. For example, when a dehumidifying liquid is supplied to both of the two duct systems which are partitioned by the partition ribs 126*c*, the two duct systems may be separately used so that priority is given to a dehumidification function in one duct system and priority is given to securing an air flow rate in the other duct system. Also, a dehumidifying liquid may be reused by partitioning a single duct into two duct systems so that the dehumidifying liquid is supplied only to one duct system and the supplied liquid flows to the other duct system.

Figure 68:
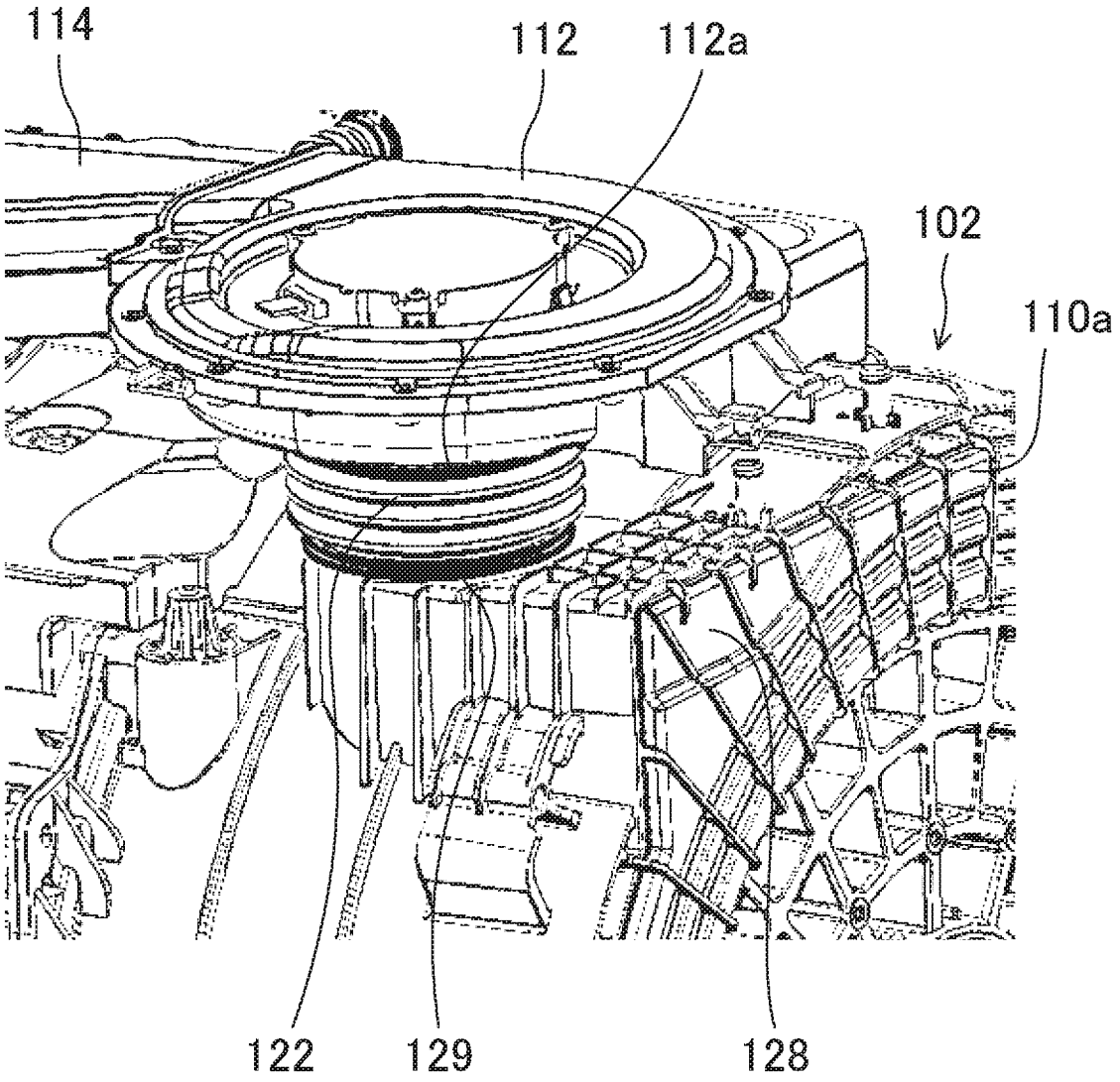
FIG. 68 is a partial perspective view illustrating a vibration absorbing member structure installed between a fan casing and a branch duct in the washing and drying machine according to the second embodiment.
Figure 69:
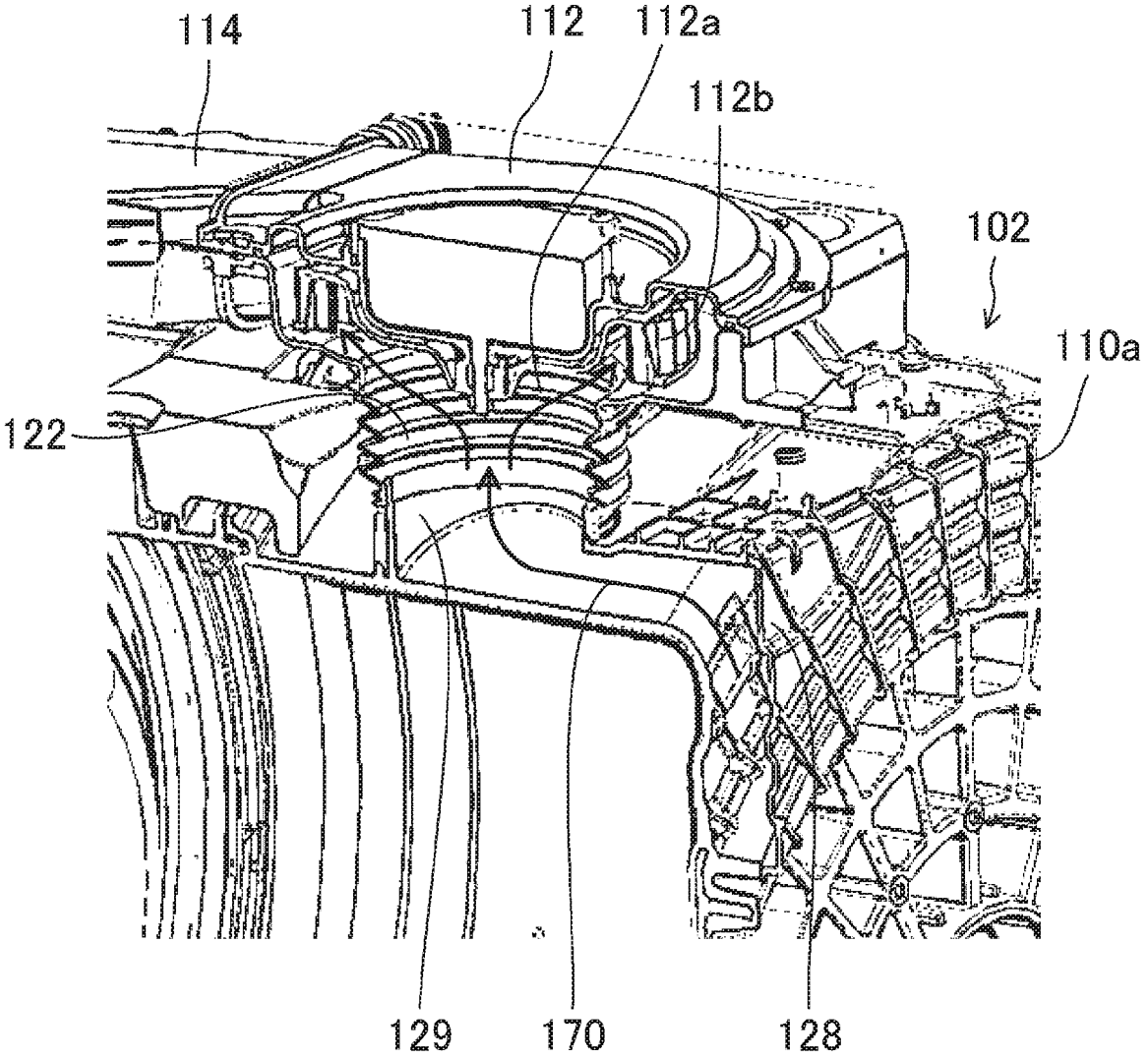
FIG. 69 is a cross-sectional view illustrating the fan casing, the branch duct, and the vibration absorbing member structure in FIG. 68.

In the second embodiment, as illustrated in FIG. 20 and the like and FIGS. 68 and 69, the vibration absorbing member 122 may be arranged between the blowing device and the converging portion 128. Specifically, the vibration absorbing member (first vibration absorbing member) 122 may be arranged to be airtight between the fan casing 112 and the converging portion 128 formed at a lower stream portion of the branch duct 110A. Due to this, vibration that occurs in the drum 104 during rotation and is transmitted to the fan casing 112 via the tub 102 and the branch ducts 110A that support the rotary shaft of the drum 104 may be absorbed by the vibration absorbing member 122. As a result, a negative influence of the vibration from the drum 104 on the fan casing 112 may be suppressed. Also, when the vibration absorbing member 122 is installed, because a flow path to the fan casing 112 becomes longer, air is smoothly introduced (suctioned) into a fan suctioner 112*a* of the fan casing 112.

As illustrated in FIG. 69, in the present embodiment, the converging portion 128 for drying air may be installed in the branch duct 110A. In this case, drying air 170 that converges at the lowest stream side in the branch duct 110A is introduced into the fan casing 112 having a fan 112*b* via the fan connection 129 and the vibration absorbing member 122.

Also, although not illustrated, a separation wall that reaches the fan connection 129 from a lower stream portion in the branch duct 110A may be installed, and drying air from two ducts may converge at a lower stream portion (in the vicinity of the fan suctioner 112*a*) of the fan connection 129.

Also, the vibration absorbing member 122 may also be installed in the washing and drying machine 100 according to the first embodiment.

Figure 70:
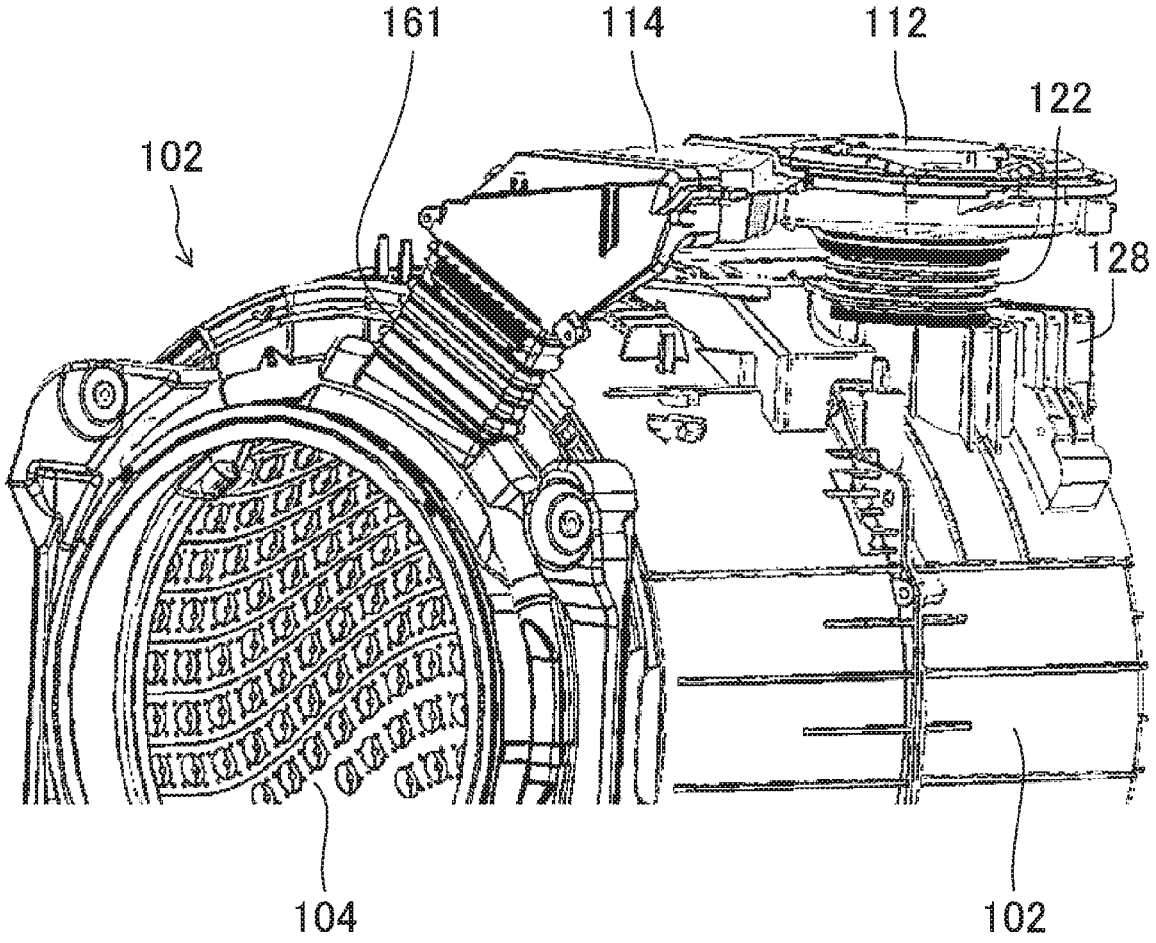
FIG. 70 is a partial perspective view illustrating a vibration absorbing member structure installed between a heater case and the tub in the washing and drying machine according to the second embodiment.
Figure 71:
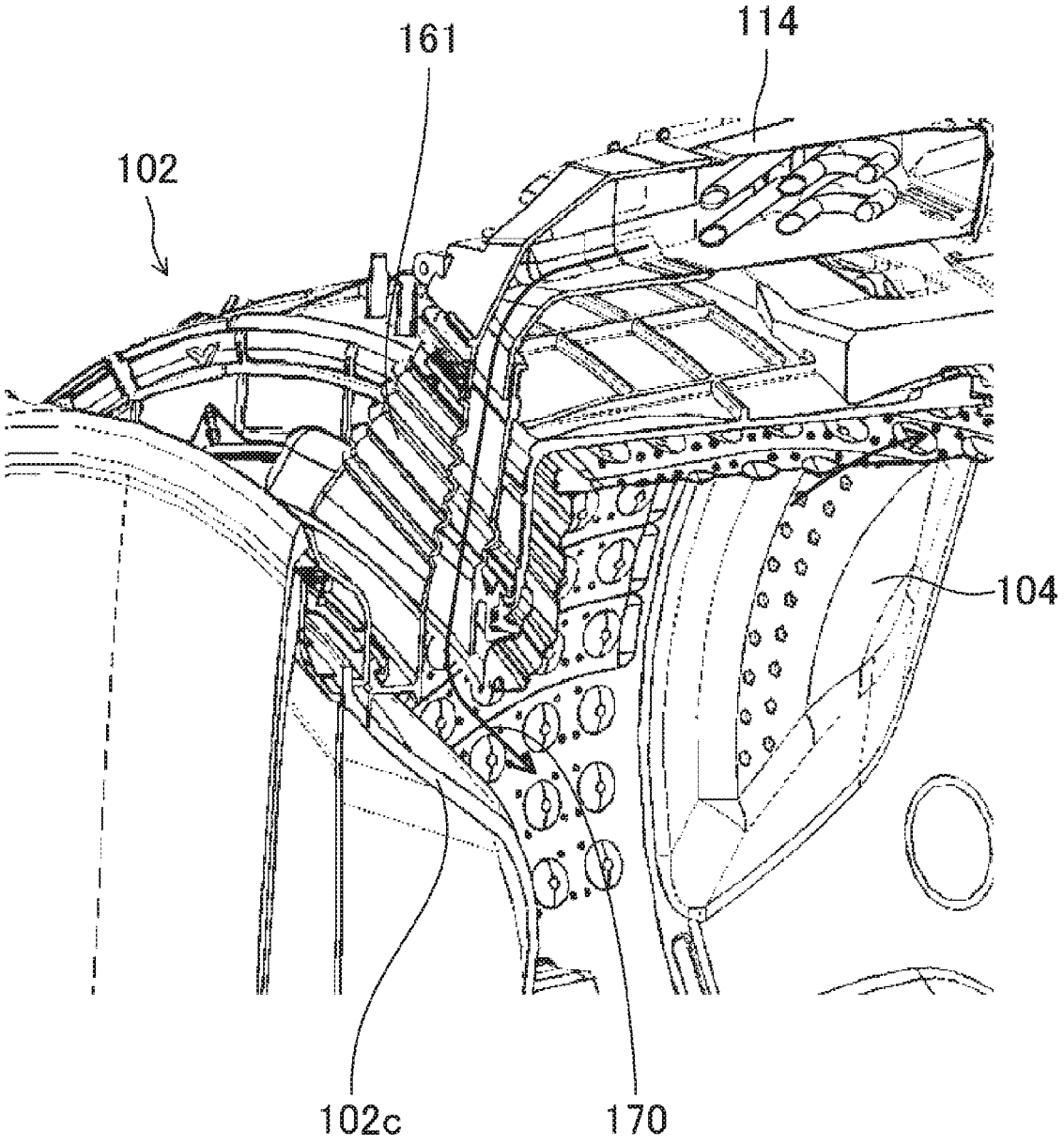
FIG. 71 is a cross-sectional view illustrating the heater case, the tub, a drum, and the vibration absorbing member structure in FIG. 70.

As illustrated in FIG. 1 with respect to the first embodiment and FIGS. 70 and 71 with respect to the second embodiment, a vibration absorbing member 161 may be arranged between the tub 102 and the heating device. Specifically, the vibration absorbing member (second vibration absorbing member) 161 may be arranged to be airtight between the heater case 114 and the tub 102, here, a door glass 102*c*, in the circulation flow path. In this way, vibration that occurs in the drum 104 during rotation and is transmitted to the heater case 114 via the tub 102 that supports the rotary shaft of the drum 104 may be absorbed by the vibration absorbing member 161. As a result, a negative influence of the vibration from the drum 104 on the heater case 114 may be suppressed. Also, because the vibration absorbing member 161 is installed, air may be smoothly introduced into the drum 104.

By the washing and drying machine according to the above-described embodiments and the modified examples thereof, because the circulation duct includes a plurality of duct systems, i.e., two or more duct systems, a heat exchange area is expanded and heat exchange efficiency is improved. Thus, an air flow rate (an air velocity) in each of the duct systems of the circulation duct is smaller compared to a case in which there is only one duct system even when a circulating air flow rate is increased. As a result, when a dehumidifying liquid is used, because droplets of the dehumidifying liquid may be suppressed from scattering, a heat exchange may be efficiently performed, a space may be saved, and drying time may be shortened.

Also, in the first embodiment and the second embodiment, the dehumidifier 110*b* installed in the washing and drying machine 100 is a water-cooling type, and the dehumidifying liquid supply nozzle 132 is employed as an example of a water supply device embedded in the dehumidifier 110*b*. However, the dehumidifier 110*b* according to the present disclosure is not limited to the water-cooling type and, for example, a heat pump type dehumidifier, i.e., a warm air dehumidifier, may also be applied.

Third Embodiment

A third embodiment of the present disclosure will be described with reference to the drawings.

In the present embodiment, flow control of a water supply device and an air flow rate control of a blowing device in the washing and drying machine according to the first embodiment illustrated in FIGS. 1 and 2 will be described. Therefore, description on the configuration itself of the washing and drying machine 100 will be omitted. Various modified examples described above with reference to the first embodiment may also be applied to the present embodiment.

As illustrated in FIGS. 2 and 3, in the present embodiment, a duct system constituting the circulation duct 110 is divided into a plurality of duct systems, e.g., two duct systems, and the duct systems are configured to converge at an upstream side of a connection with the fan casing 112, for example, at a portion right before the connection with the fan casing 112. Also, the dehumidifier 110*b* is installed in each of the two duct systems.

In the present embodiment, although the branch ducts 110A are formed of members separate from the tub 102 as illustrated in FIGS. 3 and 4, embodiments are not illustrated thereto. As in the second embodiment (FIG. 20, and the like), a bottom surface and both side surfaces of the branch ducts may be formed as grooves at the tub 102, and a cover may be installed in the grooves. That is, the branch ducts 110A may be integrally formed with the tub.

Figure 72:
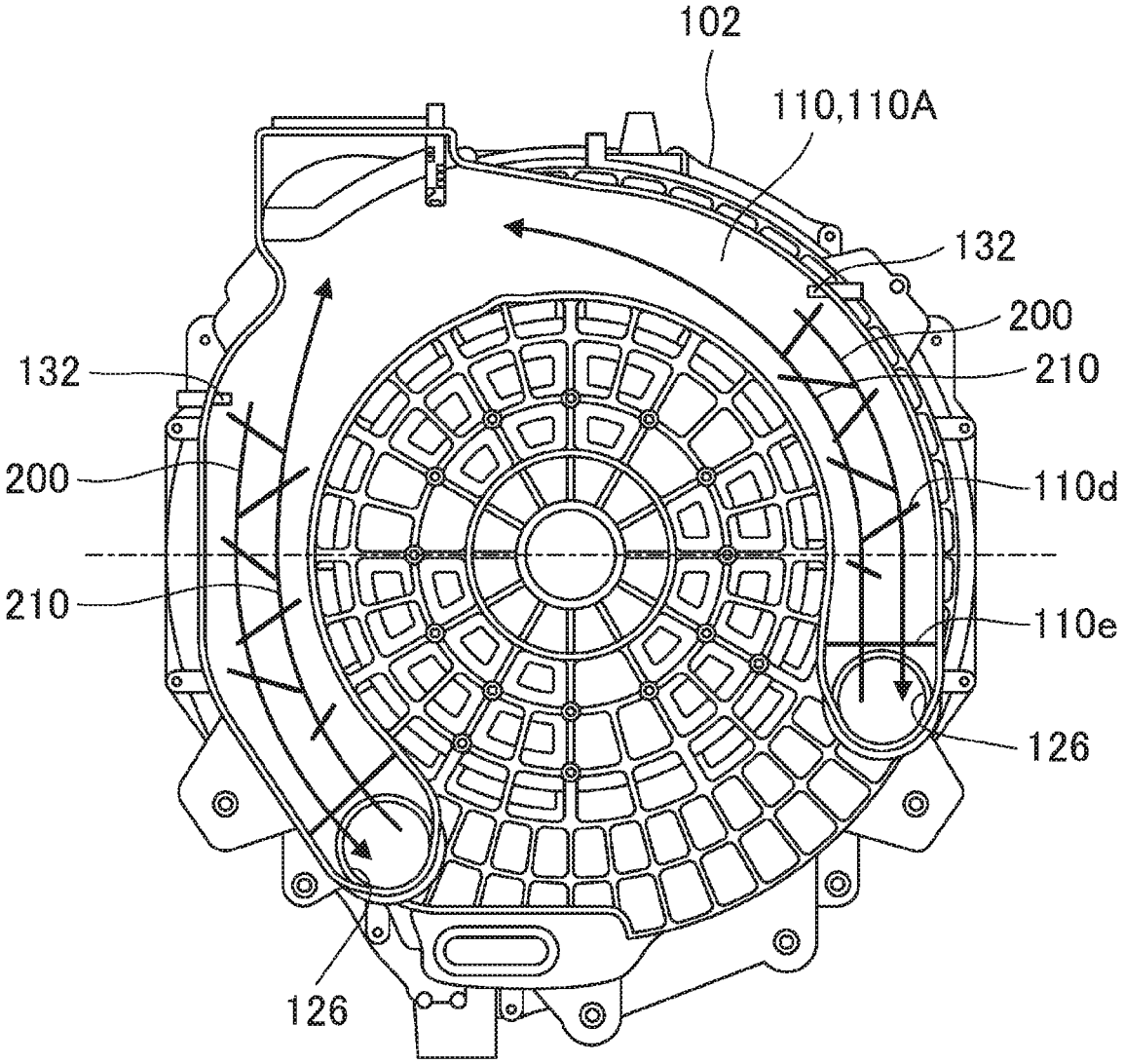
FIG. 72 is a front view schematically illustrating flows of a dehumidifying liquid and circulating air in a state in which a cover of a circulation duct constituting a washing and drying machine according to a third embodiment of the present disclosure is omitted.

FIG. 72 schematically illustrates a state in which a dehumidifying liquid 200 and circulating air 210 flow in the branch ducts 110A constituting the circulation duct 110 according to the present embodiment. The dehumidifying liquid supplied from the dehumidifying liquid supply nozzle 132 flows over each wall surface of the branch ducts 110A, enters the tub 102 via the communication holes 126 at a lower portion, and is finally drained by a drainage pump. The circulating air 210 ascends after being introduced into the branch ducts 110A via the communication holes 126. Here, the air and the dehumidifying liquid may flow in directions opposite from each other. When the air passes through dehumidifying liquid stirring ribs 110*e* and the dehumidifying liquid guide rib 110*d* installed in the branch ducts 110A, some of the dehumidifying liquid may be scattered. Here, the dehumidifying liquid is stirred with the air so that a heat exchange occurs therebetween and moisture included in the air is condensed and discharged together with the dehumidifying liquid. Due to this stirring action, lint included in the air is also simultaneously removed.

In the present embodiment, because the circulation duct 110 is bifurcated, the flow rate of the circulating air 210 flowing through each of the branch ducts 110A is halved even when the circulating air 210 from the fan is circulated only at the same flow rate as the case in which only one duct is present. Therefore, scattering of the dehumidifying liquid may be prevented. Here, even when droplets of the dehumidifying liquid are included, two airflows are stirred by colliding with each other at the converging portion 128 so that the droplets may easily collide with wall surfaces of the duct. As a result, the droplets coalesce with droplets that have already condensed on the wall surfaces of the duct, and finally, the droplets are discharged by dropping along the walls surfaces of the duct.

Generally, when an air flow rate of the circulating air 210 is increased, the dehumidifying liquid 200 stirred by the dehumidifying liquid stirring ribs 110*e* tends to flow downward. However, some of the dehumidifying liquid 200 is exchanged due to air flowing from the communication holes 126 and remains around the communication holes 126. When an amount of the dehumidifying liquid 200 remaining around the communication holes 126 is small, although flow path resistance of the circulating air 210 is decreased, drying time is increased because a dehumidification rate in the dehumidifier 110*b* is low and lint may easily pass through the flow path. Conversely, when an amount of the dehumidifying liquid 200 remaining around the communication holes 126 is large, although the dehumidification rate in the dehumidifier 110*b* is high drying time is increased because it is difficult for lint to pass through the flow path, flow path resistance is increased and the circulating air flow rate is decreased.

Therefore, in the present embodiment, by performing on/off control related to supply of the dehumidifying liquid 200, the dehumidifying liquid 200 is continuously supplied or an on-state period is maintained for a large amount of time at an early stage of water supply, and when the dehumidifying liquid 200 remains, the on-state period is shortened and an off-state period is increased. In this way, an amount of remaining dehumidifying liquid 200 may be adjusted, and because drying may be performed in an optimal state, water may be saved.

Also, by controlling a flow rate of supplying the dehumidifying liquid 200, the flow rate may be increased at an early stage of water supply, and the flow rate may be reduced when the dehumidifying liquid remains so that an amount of remaining dehumidifying liquid 200 may be adjusted. Therefore, because drying may be performed in an optimal state, water may be saved.

Figure 73:
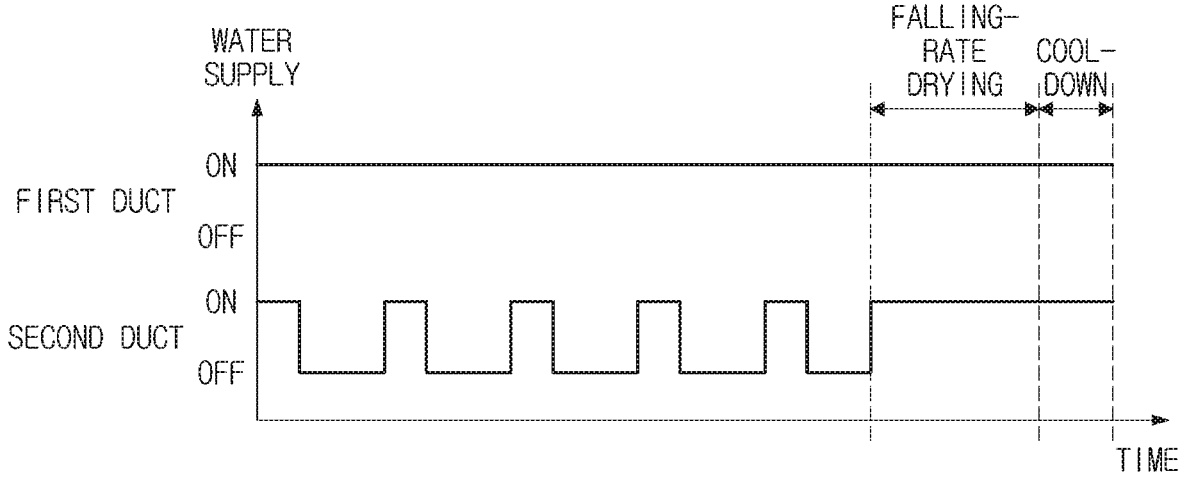
FIG. 73 is a graph illustrating water supply control for each duct of branch ducts constituting a circulation duct in a drying process of the washing and drying machine according to the third embodiment.
Figure 74:
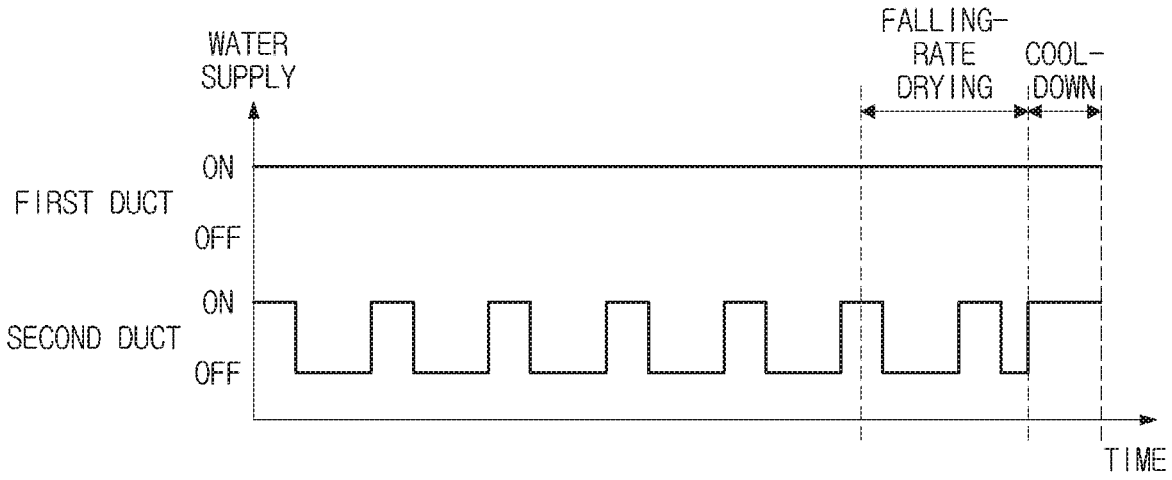
FIG. 74 is a graph illustrating another example of water supply control for each duct of the branch ducts constituting the circulation duct in the drying process of the washing and drying machine according to the third embodiment.
Figure 75:
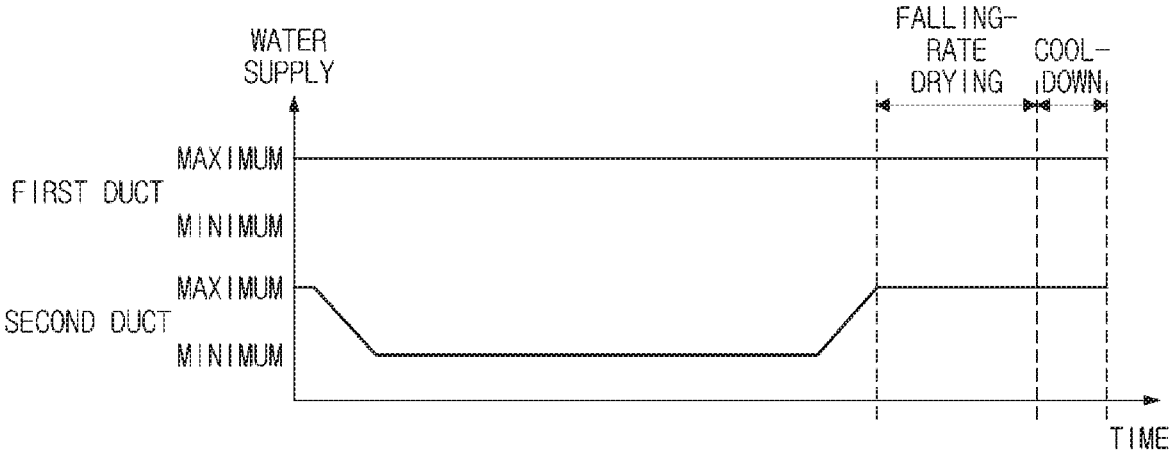
FIG. 75 is a graph illustrating still another example of water supply control for each duct of the branch ducts constituting the circulation duct in the drying process of the washing and drying machine according to the third embodiment.
Figure 76:
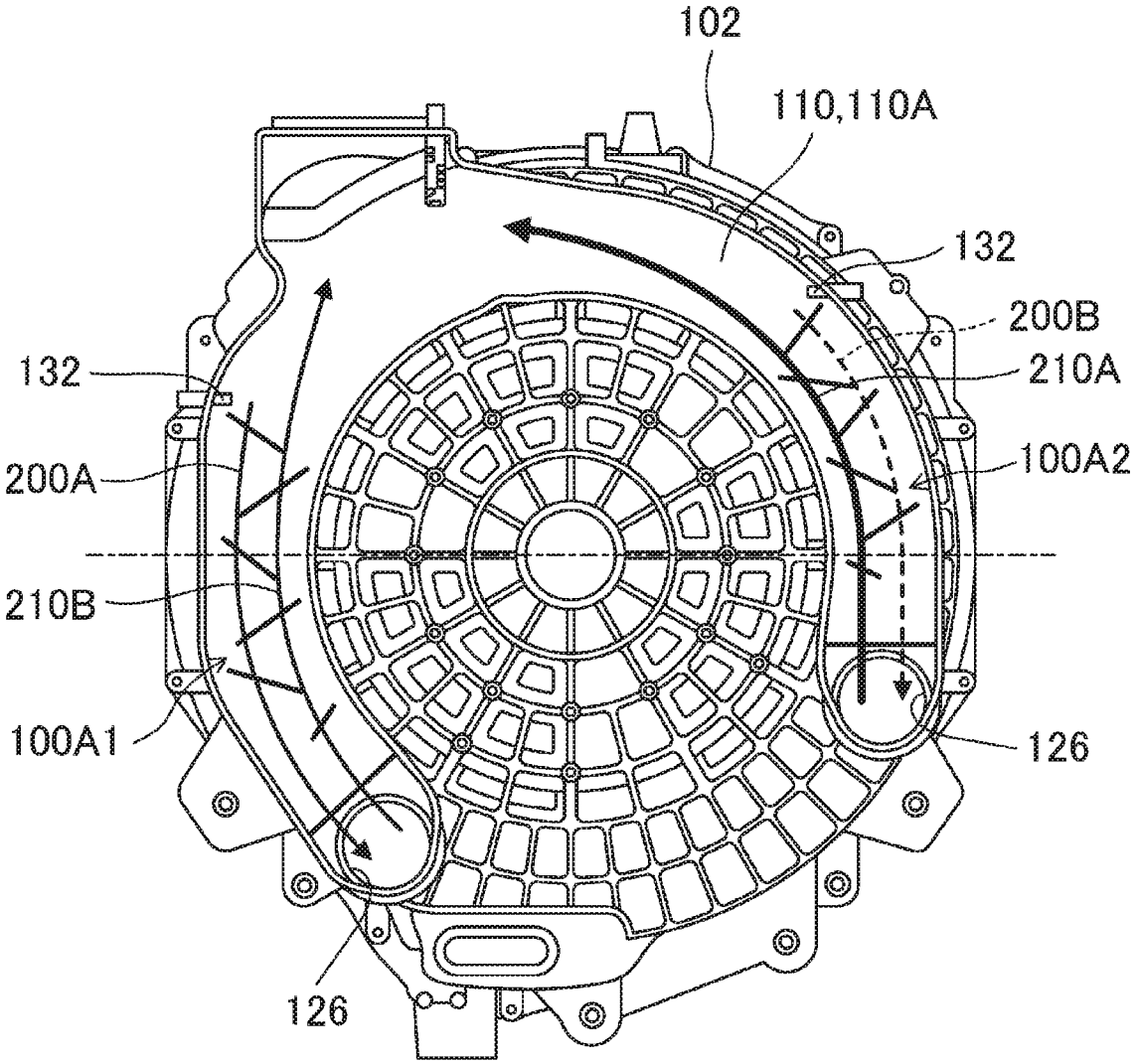
FIG. 76 is a front view schematically illustrating a flow of circulating air in a state in which a cover of the circulation duct constituting the washing and drying machine according to the third embodiment is omitted and a dehumidifying liquid is controlled.

Also, by independently controlling supply of the dehumidifying liquid to each of the branch ducts 110A, any one of the ducts may be used as a bypass flow path. By independently controlling supply of dehumidifying liquid to each of the branch ducts 110A, any one of the ducts may be used as a bypass air flow path. For example, as illustrated in FIGS. 73, 74, 75, and 76, a first duct 100A1 may serve as a continuous water supply 200A, and a second duct 100A2 may serve as an intermittent water supply 200B, or a flow rate in the second cut 100A2 may be temporarily reduced. In this case, flow path resistance of the second duct 100A2 is decreased, and an air flow rate 210A in the second duct 100A2 is larger than an air flow rate 210B in the first duct 100A1. As a result, an overall circulating air flow rate in the second duct 100A2 may be increased. For example, FIG. 73 illustrates a case in which the second duct 100A2, in which the flow rate of dehumidifying liquid is reduced, is remained in an on-state after a falling-rate drying process, and FIG. 74 illustrates a case in which the second duct 100A2 serves as an intermittent water supply until the falling-rate drying process. Here, falling-rate drying refers to drying in which a speed of drying clothes is gradually decreased. Generally, it is determined that constant-rate drying is changed to falling-rate drying when a temperature of circulating air exceeds a predetermined temperature.

Figure 77:
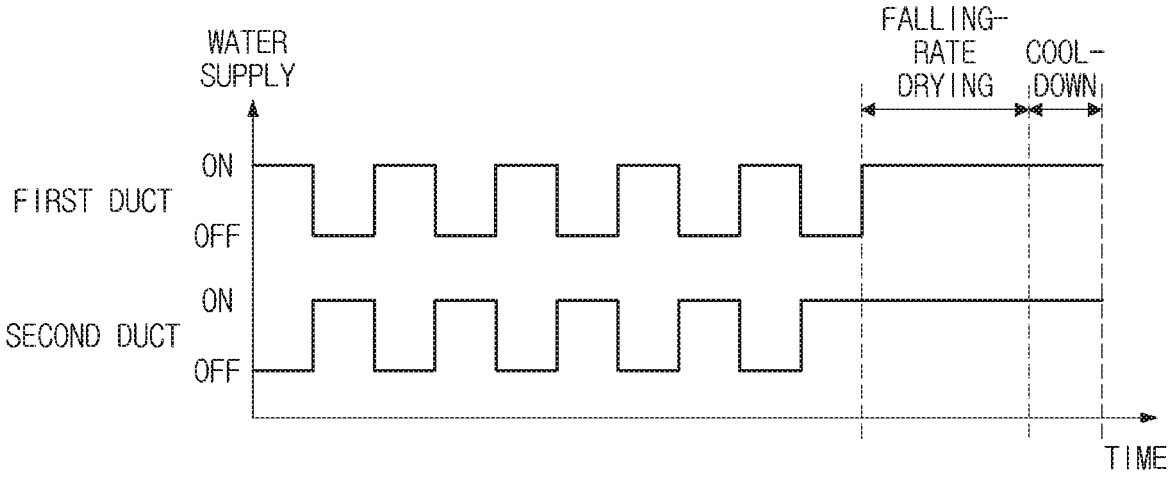
FIG. 77 is a graph illustrating yet another example of water supply control for each duct of the branch ducts constituting the circulation duct in the drying process of the washing and drying machine according to the third embodiment.

Also, as illustrated in FIG. 77, control may be performed so that a water supply amount is repeatedly increased and decreased alternately in the branch ducts 110A within a predetermined period, for example, from the start of a drying process to the start of a falling-rate drying process. Also, water supply to one duct may be intermittent water supply, and water supply to the other duct may be stopped. That is, because a bypass flow path may be established when a difference occurs between a water supply amount to one duct and a water supply amount to the other duct, a combination of controls for providing a difference in an absorption amount for both of the ducts may be applied regardless of the present embodiment.

Even when supply of the dehumidifying liquid is collectively controlled instead of being independently controlled for each of the branch ducts 110A, the balance between amounts of water supplied to the branch ducts 110A may be changed by adjusting diameters of openings of the branch portions provide in the branch ducts 110A or diameters of the nozzles holes of the dehumidifying liquid supply nozzle 132. Therefore, a bypass flow path also be established in this case.

However, after the falling-rate drying process or in a cool-down process, as illustrated in FIGS. 73 to 75 and 77, water supply control may be performed so that an amount of water that allows the dehumidifying liquid to remain in the communication holes 126, i.e., that does not cause diffusion of the dehumidifying liquid to be stopped in the middle, is supplied to both of the ducts.

Figure 78:
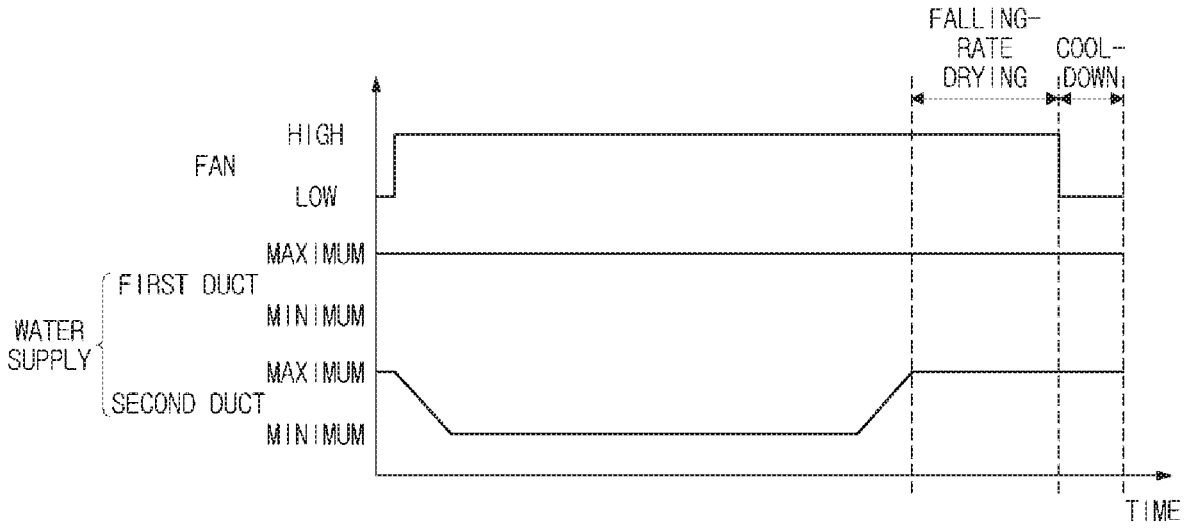
FIG. 78 is a graph illustrating an example of water supply control and blowing control for each duct of the branch ducts constituting the circulation duct in the drying process of the washing and drying machine according to the third embodiment.

Also, as illustrated in FIG. 78, right after that start of water supply, i.e., when water is supplied for the first time or when there is no dehumidifying liquid remaining in the communication holes 126, because it is easy to receive airflow, the number of rotations of the fan may be controlled to be temporarily decreased to decrease an amount of circulating air. Also, as illustrated in FIG. 78, during the cool-down in which the heater is turned off, blowing control for reducing the number of rotations of the fan may be performed so that scattering of a dehumidifying liquid is further suppressed and drying quality is improved.

The water supply may simultaneously start with the start of a drying operation or may be started after a predetermined amount of time from the start of the drying operation. When the water supply starts after the predetermined amount of time from the start of the drying operation, water may be saved.

Also, the above-described controls performed on the first duct 110A1 and the second duct 110A2 may be performed in a reverse order.

By the above-described washing and drying machine, because the circulation duct is branched into two duct systems, a heat exchange area may be expanded and heat exchange efficiency may be improved. Thus, an air flow rate (an air velocity) in each of the duct systems of the circulation duct is smaller compared to a case in which there is only one duct system even when a circulating air flow rate is increased so that droplets of coolant may be suppressed from scattering. As a result, because a heat exchange may be efficiently performed, a space may be saved, and drying time may be shortened.

According to the washing and drying machine of the present disclosure, a heat exchange area is expanded, and heat exchange efficiency is improved. Also, when dehumidifying coolant is used, a heat exchange can be efficiently performed by suppressing scattering of droplets of the coolant, and as a result, a space can be saved and drying time can be shortened.

Specific embodiments have been illustrated and described above. However, the present disclosure is not limited to the above-described embodiments, and one of ordinary skill in the art to which the disclosure pertains should be able to modify and practice the present disclosure in various ways without departing from the technical gist of the disclosure described in the claims below.

INDUSTRIAL APPLICABILITY

The washing and drying machine according to the present disclosure can be applied for purposes of saving space and shortening drying time.

What is claimed is:

1. A washing and drying machine comprising:
- a drum configured to rotate about a rotary shaft;
- a tub provided at an outside of the drum to accommodate the drum;
- a circulation flow path configured to circulate air into and out of the drum;
- a circulation duct provided on the circulation flow path, the circulation duct including:
  - a fan connection, and
  - a plurality of independent duct systems that converge at an upstream side of the fan connection, wherein the circulation duct is provided from the tub to the fan connection by branch ducts;
- a dehumidifier installed in one or more of the plurality of independent duct systems;
- a water supply pipe installed around the plurality of independent duct systems, the water supply pipe including a valve; and
- at least one processor configured to independently adjust an amount of dehumidifying coolant being supplied to the branch ducts by controlling the valve.

2. The washing and drying machine of claim 1, wherein a communication hole is provided in the one or more of the plurality of independent duct systems in which the dehumidifier is installed to communicate with the tub.

3. The washing and drying machine of claim 2, wherein the communication hole is partitioned from a second communication hole by partition ribs.

4. The washing and drying machine of claim 1, further comprising a vibration absorbing duct connecting the tub to the circulation duct.

5. The washing and drying machine of claim 1, further comprising a converging portion connected to the circulation duct at a location where the plurality of independent duct systems converge.

6. The washing and drying machine of claim 5, wherein the converging portion is located at a downstream side in a direction in which air introduced into the circulation duct flows.

7. The washing and drying machine of claim 5, further comprising:
- a blower arranged on the circulation flow path to circulate air; and
- a vibration absorbing duct that connects the converging portion to the blower.

8. The washing and drying machine of claim 1, further comprising a heater arranged on the circulation flow path to heat air.

9. The washing and drying machine of claim 8, further comprising a vibration absorbing duct that connects the tub and the heater.

10. The washing and drying machine of claim 1, further comprising:
- the dehumidifier arranged on the circulation flow path to dehumidify air; and
- a nozzle provided to supply a dehumidifying coolant to the dehumidifier.

11. The washing and drying machine of claim 1, further comprising a blower arranged on the circulation flow path to circulate air, wherein the circulation duct includes:
- a blower connection connected to the blower in a manner that air that passed through the circulation duct is introduced into the blower;
- a body in which the blower connection is provided; and
- a cover coupled to the body to define the plurality of independent duct systems together with the body.

12. The washing and drying machine of claim 2, wherein the communication hole is located upstream from the rotary shaft in a direction in which air introduced into the circulation duct flows.

13. The washing and drying machine of claim 1, wherein the circulation duct is integrally formed with the tub.

14. The washing and drying machine of claim 3, wherein the second communication hole is formed to have a different height than the communication hole.

15. The washing and drying machine of claim 1, further comprising:
- a blower arranged on the circulation flow path to circulate air; and
- the water supply pipe installed around the plurality of independent duct systems and configured to supply water to the dehumidifier, wherein:
- the water supply pipe is a branch pipe having a branch portion that is branched into two or more portions,
- the branch pipe is connected to one or more of the plurality of independent duct systems, and
- the valve whose opening toward the branch portion is adjustable is installed in the branch portion of the water supply pipe.

16. The washing and drying machine of claim 15, wherein the at least one processor is configured to control the blower to adjust flow of air flowing in the circulation flow path.

17. The washing and drying machine of claim 16, wherein the at least one processor is further configured to control the valve installed in the branch portion to control a flow rate of a dehumidifying coolant being supplied to the branch ducts.

18. The washing and drying machine of claim 17, wherein when supplying the dehumidifying coolant to each of the branch ducts, the at least one processor is further configured to control the valve installed in the branch portion to use any one of the branch ducts as a bypass air flow path by making a total amount of the dehumidifying coolant supplied to one of the branch ducts to be smaller than a total amount of the dehumidifying coolant supplied to another one of the branch ducts.

19. The washing and drying machine of claim 17, wherein when supplying the dehumidifying coolant to each of the branch ducts, the at least one processor is further configured to control the valve installed in the branch portion to make a supplied amount of the dehumidifying coolant to be repeatedly increased and decreased alternately within a predetermined period.

20. The washing and drying machine of claim 17, wherein when supplying the dehumidifying coolant to each of the branch ducts, the at least one processor is further configured to control:

the valve installed in the branch portion to prevent diffusion of the dehumidifying coolant from being stopped at a bleed-out port of the tub after falling-rate drying; and the valve installed in the branch portion to prevent diffusion of the dehumidifying coolant from being stopped at the bleed-out port of the tub during cool-down.

* * * * *